US007448709B2

(12) United States Patent
Nakajima et al.

(10) Patent No.: US 7,448,709 B2
(45) Date of Patent: Nov. 11, 2008

(54) PRINTING HEAD, IMAGE PRINTING APPARATUS USING THE SAME, AND CONTROL METHOD THEREFOR

(75) Inventors: Yoshinori Nakajima, Kanagawa (JP); Jiro Moriyama, Kanagawa (JP); Takayuki Murata, Kanagawa (JP); Nobuyuki Hirayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 387 days.

(21) Appl. No.: 11/177,303

(22) Filed: Jul. 11, 2005

(65) Prior Publication Data

US 2005/0243128 A1 Nov. 3, 2005

Related U.S. Application Data

(62) Division of application No. 10/113,677, filed on Apr. 2, 2002, now Pat. No. 6,997,533.

(30) Foreign Application Priority Data

Apr. 2, 2001 (JP) ..... 2001-103639
Jul. 30, 2001 (JP) ..... 2001-230323

(51) Int. Cl.
*B41J 29/38* (2006.01)

(52) U.S. Cl. ..... 347/12; 347/9; 347/10

(58) Field of Classification Search ..... 347/9, 347/10, 12

See application file for complete search history.

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,608,577 A 8/1986 Hori
4,723,129 A 2/1988 Endo et al.

(Continued)

FOREIGN PATENT DOCUMENTS

EP 0 631 870 B1 4/1995

(Continued)

OTHER PUBLICATIONS

Machine Translation.

*Primary Examiner*—Julian D Huffman
(74) *Attorney, Agent, or Firm*—Fitzpatrick, Cella, Harper & Scinto

(57) ABSTRACT

This invention provides a printing head which can prevent an increase in the number of block enable signal lines, and can prevent changes in printing ink density caused by interference due to the relative pressures of nozzles generated in ink discharge, and an image printing apparatus using the printing head. For this purpose, an increase in the number of input signal lines along with an increase in the number of blocks is prevented using a block clock signal or the like instead of a block enable signal as an input signal to the printing head. Three ring counters generate signals having different nozzle driving orders. These signals are selectively used by a ring counter selection signal. Ink is not always discharged from the nozzles in the same output order. This can prevent changes in ink density caused by pressure interference.

7 Claims, 55 Drawing Sheets

U.S. PATENT DOCUMENTS

| | | | |
|---|---|---|---|
| 4,740,796 | A | 4/1988 | Endo et al. |
| 4,894,667 | A | 1/1990 | Moriyama |
| 4,901,092 | A | 2/1990 | Moriyama |
| 5,023,630 | A | 6/1991 | Moriyama |
| 5,164,747 | A | 11/1992 | Osada et al. |
| 5,221,931 | A | 6/1993 | Moriyama |
| 5,343,227 | A | 8/1994 | Hirosawa et al. |
| 5,646,659 | A | 7/1997 | Moriyama et al. |
| 5,682,190 | A | 10/1997 | Hirosawa et al. |
| 5,745,129 | A | 4/1998 | Moriyama et al. |
| 5,873,661 | A | 2/1999 | Murata et al. |
| 6,059,394 | A | 5/2000 | Moriyama |
| 6,123,411 | A | 9/2000 | Inui et al. |
| 6,155,666 | A | 12/2000 | Sugimoto et al. |
| 6,334,666 | B1 | 1/2002 | Inui et al. |
| 6,471,322 | B2 | 10/2002 | Kanda et al. |
| 6,523,922 | B2 | 2/2003 | Hirayama |
| 2002/0036781 | A1 | 3/2002 | Hirayama |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 6-305148 | 11/1994 |

FIG. 12

| DRIVING ORDER | 502 RING COUNTER | 503 RING COUNTER | 504 RING COUNTER |
|---|---|---|---|
| 1 | a | b | h |
| 2 | b | c | e |
| 3 | h | a | d |
| 4 | e | f | b |
| 5 | g | d | c |
| 6 | f | g | f |
| 7 | d | h | a |
| 8 | c | e | g |

BLOCK NUMBER

FIG. 18

| DRIVING ORDER | RING COUNTER OUTPUT SIGNAL |
|---|---|
| 1 | a |
| 2 | b |
| 3 | c |
| 4 | d |
| 5 | e |
| 6 | f |
| 7 | g |
| 8 | h |

64 NOZZLES

BLOCK NUMBER

FIG. 19

| COLUMN | DEFAULT VALUE |
|---|---|
| 1 | a |
| 2 | b |
| 3 | c |
| 4 | d |
| 5 | e |
| 6 | f |
| 7 | g |
| 8 | h |
| 9 | a |
| 10 | b |
| ⋮ | ⋮ |

BLOCK NUMBER

FIG. 25

| SCAN | RING COUNTER |
|---|---|
| 1 | 502 |
| 2 | 503 |
| 3 | 502 |
| 4 | 503 |
| 5 | 502 |
| 6 | 503 |

⋮

FIG. 26

| SCAN | DEFAULT VALUE |
|---|---|
| 1 | a |
| 2 | g |
| 3 | a |
| 4 | g |
| 5 | a |
| 6 | g |

⋮

FIG. 31

| COUNTER | DECODER 1 | DECODER 2 | DECODER 3 |
|---|---|---|---|
| 0 | a | b | h |
| 1 | b | c | e |
| 2 | h | a | d |
| 3 | e | f | b |
| 4 | g | d | c |
| 5 | f | g | f |
| 6 | d | h | a |
| 7 | c | e | g |

FIG. 33

| COUNTER | DECODER OUTPUT SIGNAL |
|---|---|
| 0 | a |
| 1 | b |
| 2 | c |
| 3 | d |
| 4 | e |
| 5 | f |
| 6 | g |
| 7 | h |

64 NOZZLES

BLOCK NUMBER

PRINTING HEAD, IMAGE PRINTING APPARATUS USING THE SAME, AND CONTROL METHOD THEREFOR

This is a divisional application of application Ser. No. 10/113,677, filed Apr. 2, 2002.

FIELD OF THE INVENTION

The present invention relates to a printing head, image printing apparatus using the same, and control method therefor and, more particularly, to an ink-jet printing head.

BACKGROUND OF THE INVENTION

An example of information output apparatuses for a word processor, personal computer, facsimile apparatus, and the like is a printer for printing information such as desired characters or images on a sheet-like printing medium such as a paper sheet or film.

The printing method of the printer includes various known methods such as a thermal method and ink-jet method. In particular, the ink-jet method of discharging ink to print information has recently received a great deal of attention because of non-contact printing on a printing medium such as a paper sheet, and easy color printing.

The ink-jet arrangement comprises a printing head for discharging ink in accordance with desired print information. The printing head prints information while reciprocating in a direction perpendicular to the feed direction of a printing medium such as a paper sheet. In general, this serial printing method is widely adopted in terms of low cost and easy downsizing.

The ink-jet painting head has ink-jet discharge nozzles serving as a plurality of aligned printing elements, and is mounted on the carriage of the printer main body. While the printing head is moved by the carriage, it prints information by discharging ink.

Examples of the driving method are an all-nozzle discharge method of discharging ink from all the nozzles at once, and a time division discharge method of discharging ink by time division by grouping nozzles to be driven into several blocks.

The all-nozzle discharge method requires a large power supply in order to simultaneously drive all the nozzles. This method is not suitable for an ink-jet printer which aims at low cost and small size.

In the time division discharge method of discharging ink by grouping nozzles into several blocks and driving them by time division, large power need not be supplied at once. Thus, the time division discharge method is employed in an ink-jet printer which aims at low cost and small size.

For example, a printing head shown in FIG. 1A has 32 nozzles 1 to 32. The 32 nozzles discharge ink every four nozzles in one driving operation. The printing head is divisionally driven eight times to discharge ink from all the 32 nozzles (for one column).

More specifically, the 32 nozzles are grouped into eight blocks: the first block (1, 9, 17, and 25), the second block (2, 10, 18, and 26), the third block (3, 11, 19, and 27), . . . , the eighth block (8, 16, 24, and 32).

Nozzles belonging to the first block (1, 9, 17, and 25) are simultaneously driven (discharge ink) at a timing B0; nozzles belonging to the second block (2, 10, 18, and 26), at a timing B1; and nozzles belonging to the third block (3, 11, 19, and 27), at a timing B2. Finally, nozzles belonging to the eighth block (8, 16, 24, and 32) are simultaneously driven (discharge ink) at a timing B7 to complete discharge of one column (all the 32 nozzles).

FIG. 1B shows lines of print dots (discharge dot layout) formed using the printing head in FIG. 1A.

In the printing head shown in FIG. 1A, the printing head is divisionally driven eight times. A dot layout formed by discharge of one column (32 nozzles) is represented by ● in FIG. 1B. One vertical line shown in FIG. 1B is formed by discharge of four columns (32 nozzles×4).

For descriptive convenience, FIGS. 1A and 1B show an 8-block, 32-nozzle printing head. The printing head may be an 8-block, 64-nozzle printing head, or a printing head having about several hundred nozzles in eight or 16 blocks.

As shown in FIG. 1A, the carriage is inclined at an angle θ from the printing head. While the carriage moves a printing head 1 in the main scanning direction, the printing head discharges ink. Vertical lines as a discharge dot layout shown in FIG. 1B become straight line by line.

In this manner, the printing head shown in FIG. 1A is driven by the time division discharge method of, grouping nozzles into several blocks, and driving the nozzles by time division, thereby discharging ink. This printing head can provide, e.g., a discharge dot layout of straight vertical lines, as shown in FIG. 1B, at low cost and small size without supplying large power at once.

In the example of FIGS. 1A and 1B, the 32 nozzles are grouped into eight blocks each including four nozzles. Ink is discharged in a 1-block (4-nozzle) unit. All the 32 nozzles (one column) can discharge ink by eight discharge operations.

FIG. 2 shows an arrangement of the printing head. In FIG. 2, reference numeral 100 denotes a printing head main body driving section. In this example, the driving section 100 has 64 ink-discharge nozzles.

The 64 nozzles are driven every eight nozzles shown in FIG. 3 as one block. All the 64 nozzles discharge ink by eight driving operations.

More specifically, all the 64 nozzles are grouped into block a (1, 9, 17, 25, 33, 41, 49, and 57), block b (4, 12, 20, 28, 36, 44, 52, and 60), block c (7, 15, 23, 31, 39, 47, 55, and 63), block d (2, 10, 18, 26, 34, 42, 50, and 58), block e (5, 13, 21, 29, 37, 45, 53, and 61), block f (8, 16, 24, 32, 40, 48, 56, and 64), block g (3, 11, 19, 27, 35, 43, 51, and 59), and block h (6, 14, 22, 30, 38, 46, 54, and 62).

In FIG. 2, ink is discharged from the respective nozzles under heating control of ink within the nozzles by using a heat enable signal 101, block enable signal 104, and latch enable signal 106.

The heat enable signal 101 is a signal for permitting heating of a nozzle. The block enable signal 104 is a signal for permitting heating of nozzles belonging to a block to be selected (to be driven). A latch enable signal 106 is a signal for permitting heating of a predetermined nozzle to be selected (to be driven).

If the heat enable signal 101 and block enable signal 104 are selected, and the latch enable signal 106 (in the presence of image data for causing a nozzle at a predetermined position to discharge ink) is selected, a predetermined nozzle is heated to print information on a printing medium by ink discharge.

More specifically, in FIG. 2, the block enable signal 104 (3 bits in this example), and a decoder 108 for generating a block selection signal 109 for selecting a block designated by the block enable signal 104 exist to drive the 64 nozzles grouped into eight blocks.

Image data is temporarily sent to an image data latch 103 together with a data clock signal 105 and the latch enable signal 106. After the image data latch 103 holds all signals necessary to drive all the nozzles, data 107 is transferred to a designated nozzle.

FIG. 4 is a timing chart showing respective printing driving control signals. The block selection signal 109 sequentially operates (enables) the blocks in order to go through the respective grouped blocks (8 nozzles×8 blocks) once. In the example of FIG. 4, the block selection signal 109 sequentially enables block 0 to block 7. In FIG. 4, the latch enable signal 106, serial image data signal 102, and data clock signal 105 transmit next data.

As described above, the nozzles in the printing head main body driving section 100 are driven by driver switching using an AND output of the three, block selection signal 109, heat enable signal 101, and intra-latch data 107.

In recent years, demands have arisen for ink-jet printers which operate at high speed. To meet these demands, printing heads having a larger number of nozzles are required.

To implement a low-cost, small-size ink-jet printer, the time division discharge method of grouping nozzles into several blocks and driving the nozzles by time division so as to eliminate the necessity for supply of large power at once must be adopted. Further, the number of nozzles must be increased along with the increase in speed.

However, the following two problems arise when nozzles are grouped into several blocks, the nozzles are driven by the time division discharge method, and the number of nozzles (nozzle density) present in the printing head is increased to cope with the increase in speed.

First, the image quality is degraded by pressure interference (crosstalk) generated in ink discharge.

The printing head receives interference (crosstalk) owing to the pressure between nozzles that is generated in ink discharge. The printing density changes every discharge nozzle in accordance with the nozzle driving order, resulting in low image quality. The influence of the pressure interference (crosstalk) becomes more prominent as the number of nozzles (nozzle density) present in the printing head increases. This degradation in image quality must be prevented even if the number of nozzles is increased to cope with the increase in speed.

This will be explained in more detail. In the ink-jet printer, ink vibrates within the printing head after the nozzle of the printing head discharges ink. The vibrations influence ink discharge in the next period. When ink expands externally from an orifice owing to the vibrations, an ink droplet to be discharged in the next period becomes larger than the normal ink droplet. When ink contracts internally from the orifice, an ink droplet to be discharged in the next period becomes smaller than the normal ink droplet. In this way, ink discharge in the next period is influenced by the vibrations, decreasing the image quality of a printed image. If ink is discharged after ink vibrations settle so as to prevent the influence of vibrations on ink discharge in the next period, the printing speed decreases. In the prior art, the nozzles of respective grouped blocks are driven in a fixed order, ink vibrations in the printing head may greatly vary periodically, and the influence of the vibrations becomes serious. It is, therefore, difficult to achieve both prevention of degradation in image quality and high-speed printing.

Second, if the number of nozzles is increased along with the increase in speed, the number of signal lines increases due to an increase in the number of nozzle control block enable signals.

In the above-described decoder system, an increase in the number of nozzles in the time division discharge method increases the number of nozzle blocks. The number of block enable signals for selecting blocks increases, and the number of signal lines also increases.

For example, when the number of nozzle blocks is 8, as shown in FIG. 2, the block enable signal for selecting blocks requires only 3 bits. If the number of nozzle blocks increases to, e.g., 16, the block enable signal must require 4 bits.

As the first method of decreasing the number of block enable signal lines, Japanese Patent Laid-Open No. 06-305148 discloses a method using a block clock and ring counter.

More specifically, as shown in FIG. 5, Japanese Patent Laid-Open No. 06-305148 discloses a method of mounting a ring counter 309 in a printing head, and generating block enable signals 301 to 308 for selecting the blocks of nozzles to be driven by a signal from the ring counter 309.

FIG. 6 shows the waveforms of signals used in this arrangement. In FIG. 6, reference numerals 401 to 403 denote image data transfer signals. The ring counter 309 is operated by a block clock signal 404 to obtain the ring counter outputs 301 to 308. As is apparent from the comparison between the waveforms of the block enable signals 301 to 308 in FIG. 6 and the block selection signal 109 output from the decoder 108 in FIG. 4, the waveforms of the block enable signals 301 to 308 in FIG. 6 play the same role as the block selection signal 109 output from the decoder 108 in FIG. 4.

As the second method of decreasing the number of block enable signal lines, there is proposed a method of transmitting a data signal and block enable signal by using the same signal line. For example, the data signal is sent in the same data unit as that of the block enable signal, and the block enable signal for the data is always sent before the data signal.

To divide a 64-bit data signal into eight blocks and transmit the divided data in the second method, (8 data bits+3 block bits)×8=88-bit data signal must be transferred. Compared to transfer of only a data signal, the data signal transfer amount becomes 1.375 times.

SUMMARY OF THE INVENTION

The present invention has been made to overcome the conventional drawbacks, and has as its object to provide a printing head which adopts Japanese Patent Laid-Open No. 06-305148 to prevent an increase in the number of block enable signal lines, can efficiently suppress ink vibrations within the printing head that occur in ink discharge even when an image is printed at high speed, and can reduce degradation in the image quality of a printed image caused by changes in ink density, an image printing apparatus using the printing head, and a control method therefor.

It is another object of the present invention to provide a printing head which can decrease the number of block enable signal lines, can minimize data transfer, can efficiently suppress ink vibrations within the printing head that occur in ink discharge even when an image is printed at high speed, and can reduce degradation in the image quality of a printed image caused by changes in ink density, an image printing apparatus using the printing head, and a control method therefor.

To achieve the above objects, an ink-jet printing apparatus which prints an image on the basis of print data by scanning, on a printing medium in a direction transverse to a layout direction of a plurality of printing elements, a carriage which enables to support a printing head having the plurality of printing elements, comprising: driving means for grouping the plurality of printing elements into a plurality of blocks every predetermined number of printing elements, and driving printing elements belonging to each block at the same driving timing; holding means for holding a plurality of different patterns indicating a driving order of the plurality of blocks; and driving order determination means for selecting any one any one pattern from the plurality of different patterns, and outputting the selected pattern as the driving order of the plurality of blocks, wherein the driving order of the plurality of blocks is changed according to the selected pattern outputted by the driving order determination means.

To achieve the above objects, an ink-jet printing apparatus which prints an image on the basis of print data by scanning, on a printing medium in a direction cross to a layout direction of a plurality of printing elements, a carriage which enables to support a printing head having the plurality of printing elements, comprising: driving means for grouping the plurality of printing elements into a plurality of blocks every predetermined number of printing elements, and driving printing elements belonging to each block at the same driving timing; output means for outputting a default value signal that is a driving signal to drive a first block in the plurality of blocks; and driving order determination means for outputting the driving order of the plurality of blocks based on the default value signal, wherein the driving order of the plurality of blocks is changed according to the default value signal outputted by the output means.

To achieve the above objects, a printing head used in an ink-jet printing apparatus which prints an image on the basis of print data by scanning, on a printing medium in a direction transverse to a layout direction of a plurality of printing elements, a carriage which enables to support a printing head having the plurality of printing elements, comprising: driving means for grouping the plurality of printing elements into a plurality of blocks every predetermined number of printing elements, and driving printing elements belonging to each block at the same driving timing; holding means for holding a plurality of different patterns indicating a driving order of the plurality of blocks; and driving order determination means for selecting any one pattern from the plurality of different patterns, and outputting the selected pattern as the driving order of the plurality of blocks, wherein the driving order of the plurality of blocks is changed according to the selected pattern outputted by the driving order determination means.

To achieve the above objects, a printing head used in an ink-jet printing apparatus which prints an image on the basis of print data by scanning, on a printing medium in a direction cross to a layout direction of a plurality of printing elements, a carriage which enables to support a printing head having the plurality of printing elements, comprising: driving means for grouping the plurality of printing elements into a plurality of blocks every predetermined number of printing elements, and driving printing elements belonging to each block at the same driving timing; output means for outputting a default value signal that is a driving signal to drive a first block in the plurality of blocks; and driving order determination means for outputting the driving order of the plurality of blocks based on the default value signal, wherein the driving order of the plurality of blocks is changed according to the default value signal outputted by said output means.

To achieve the above objects, a control method for an ink-jet printing apparatus which prints an image on the basis of print data by scanning, on a printing medium in a direction transverse to a layout direction of a plurality of printing elements, a caffiage which enables to support a printing head having the plurality of printing elements, comprising: a driving step of grouping the plurality of printing elements into a plurality of blocks every predetermined number of printing elements, and driving printing elements belonging to each block at the same driving timing; a holding step of holding a plurality of different patterns indicating a driving order of the plurality of blocks; and a driving order determination step of selecting any one pattern from the plurality of different patterns, and outputting the selected pattern as the driving order of the plurality of blocks, wherein the driving order of the plurality of blocks is changed according to the selected pattern outputted by the driving order determination step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 12 is a table for explaining the driving order of ring counters used in the first embodiment;

FIG. 18 is a table for explaining an output signal from a ring counter used in the second embodiment;

FIG. 19 is a table for explaining the default value of each column used in the second embodiment;

FIG. 25 is a table for explaining the selection order of ring counters used in the third embodiment;

FIG. 26 is a table for showing an example of a default value used in the third embodiment;

FIG. 31 is a table showing the decoding state of a decoder used in the fifth embodiment;

FIG. 33 is a table showing the decoding state of a decoder used in the sixth embodiment;

DETAILED DESCRIPTION OF THE PREFERRED EMBODIMENTS

Preferred embodiments of the present invention will now be described in detail in accordance with the accompanying drawings.

These embodiments will describe an ink-jet printing head, a serial ink-jet printer serving as an image printing apparatus in which the printing head is mounted, and a control method therefor. However, the scope of the present invention is not limited to the described embodiments.

First Embodiment

An ink-jet printer in which an ink-jet printing head is mounted will be described according to the first embodiment.

<Brief Description of a Printing Apparatus>

Figure 7:
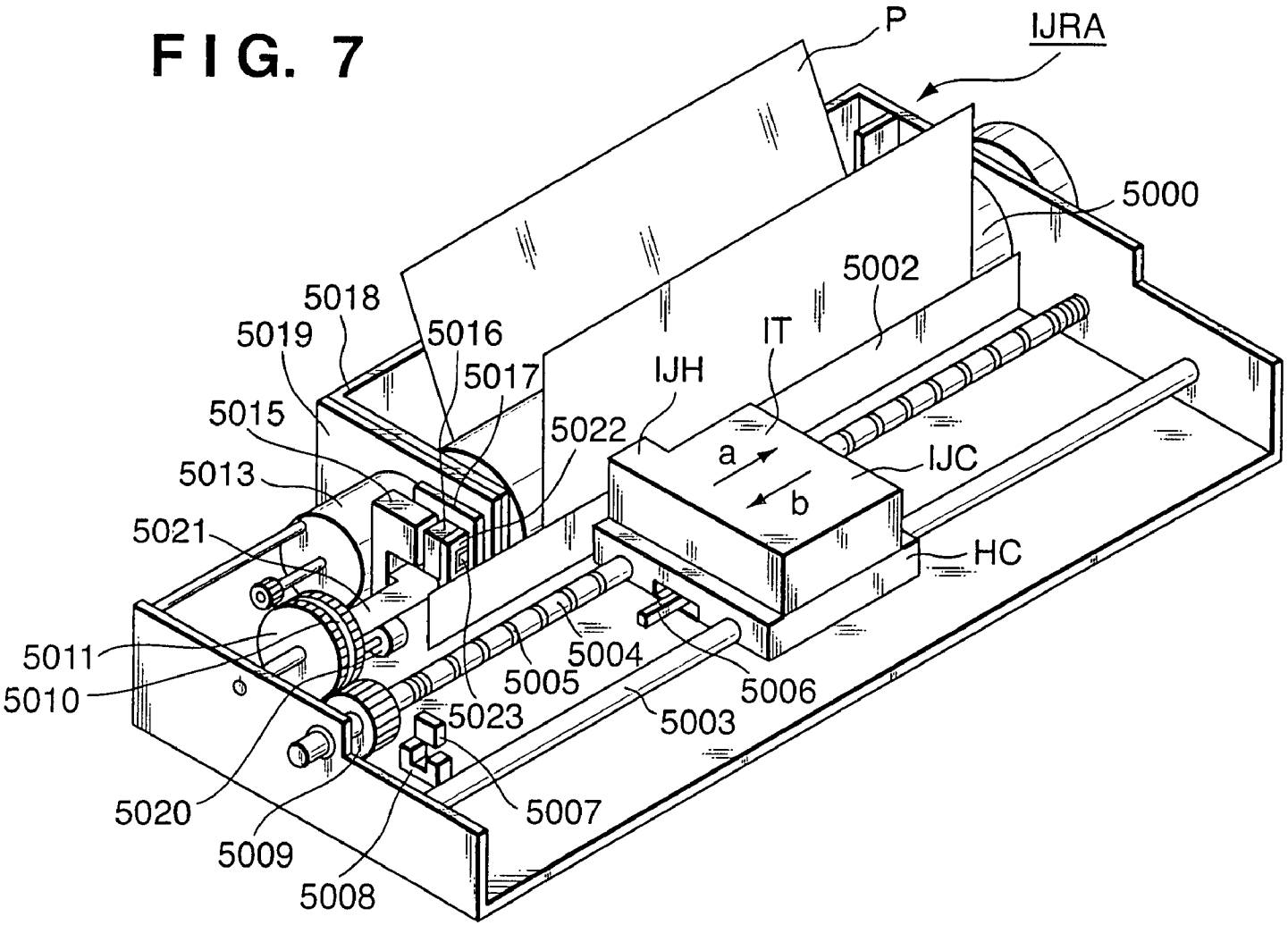
FIG. 7 is a perspective view showing the outer appearance of an ink-jet printer in an embodiment.

FIG. 7 is a perspective view showing the outer appearance of an ink-jet printer IJRA as a typical embodiment of the present invention. Referring to FIG. 7, a carriage HC engages with a spiral groove 5004 of a lead screw 5005, which rotates via driving force transmission gears 5009 to 5011 upon forward/reverse rotation of a drive motor 5013. The carriage HC has a pin (not shown), and is reciprocally moved in directions of arrows a and b in FIG. 7.

An integrated ink-jet cartridge IJC which incorporates a printing head IJH and an ink tank IT is mounted on the carriage HC. Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

<Description of a Control Arrangement>

Next, the control structure for performing the printing control of the above apparatus is described.

Figure 8:
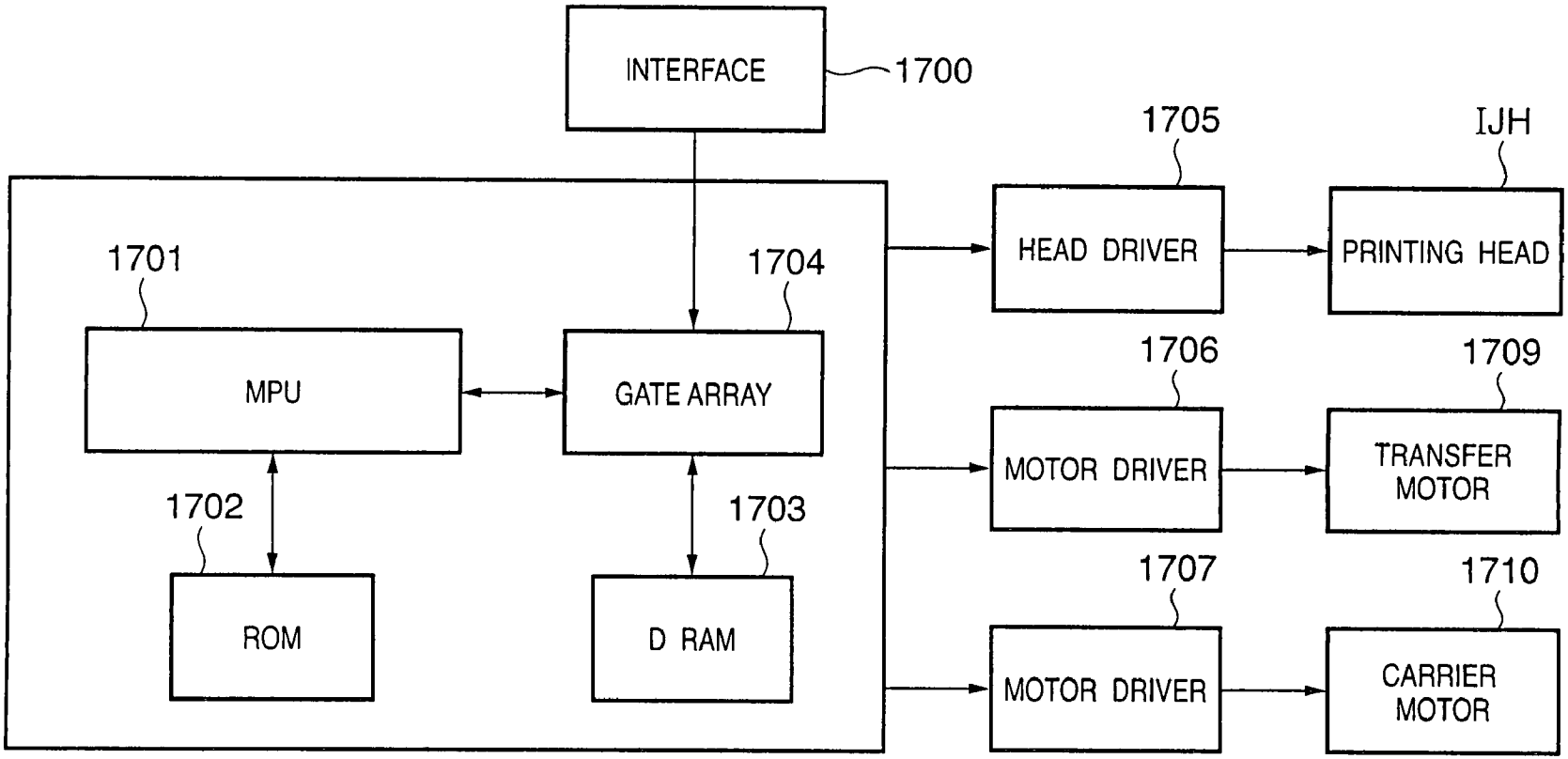
FIG. 8 is a block diagram showing the arrangement of the control circuit of the ink-jet printer in the embodiment.

FIG. 8 is a block diagram showing the arrangement of a control circuit of the ink-jet printer. Referring to FIG. 8 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printing head and the like). Reference numeral 1704 denotes a gate array (G.A.) for performing supply control of print data to the printing head IJH. The gate array 1704 also performs data transfer control among the interface 1700, the MPU 1701, and the RAM 1703. Reference numeral 1710 denotes a carrier motor for transferring the printing head IJH in the main scanning direction; and 1709, a transfer motor for transferring a paper sheet. Reference numeral 1705 denotes a head driver for driving the printing head; and 1706 and 1707, motor drivers for driving the transfer motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printing head is driven in accordance with the print data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

Note that the ink tank IT and the printing head IJH are integrally formed to construct an exchangeable ink cartridge IJC, however, the ink tank IT and the printing head IJH may be separately formed such that when ink is exhausted, only the ink tank IT can be exchanged for new ink tank.

<Ink Cartridge>

Figure 9:
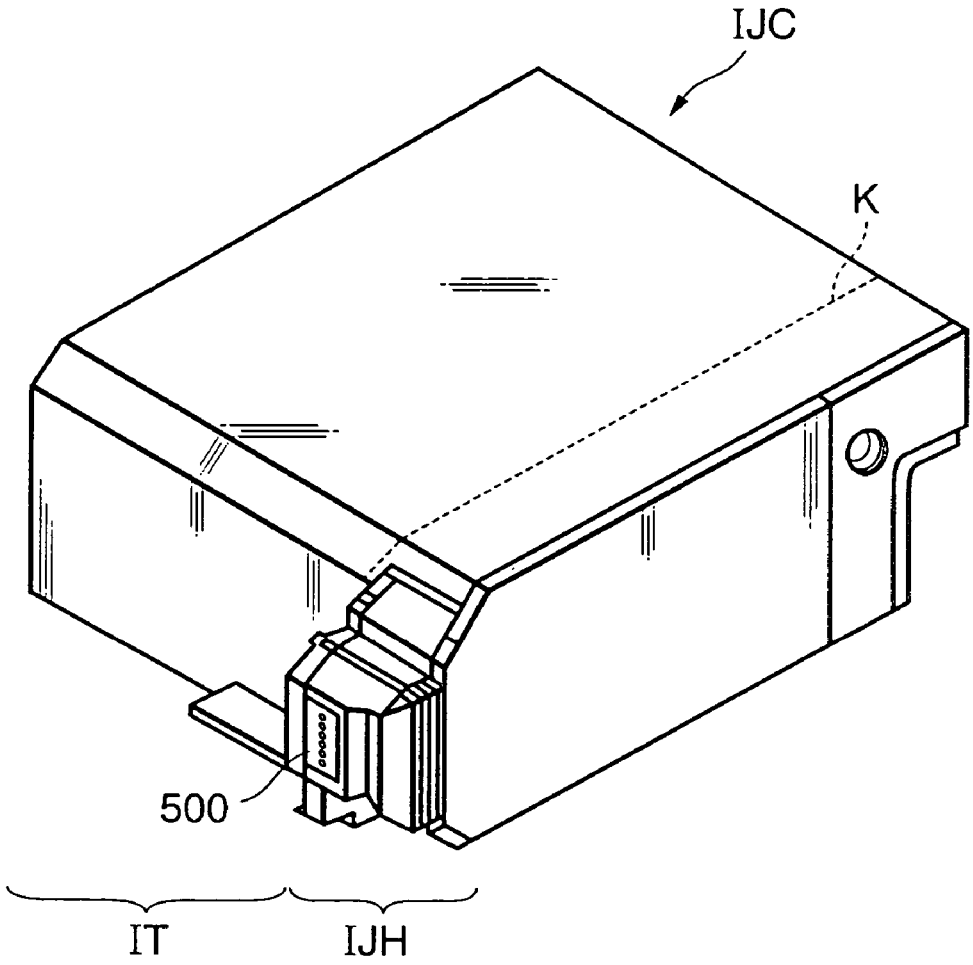
FIG. 9 is a perspective view showing the outer appearance of an ink cartridge which allows separating an ink tank from a head in the embodiment.

FIG. 9 is a perspective view showing the structure of the ink cartridge IJC where the ink tank and the head can be separated. As shown in FIG. 9 in the ink cartridge ITC, the ink tank IT and the printing head IJH can be separated along a line K. The ink cartridge IJC has an electrode (not shown) for receiving an electric signal supplied from the carriage HC side when it is mounted on the carriage HC. By the electric signal, the printing head IJH is driven as above, and discharges ink.

Note that in FIG. 9, numeral 500 denotes an ink-discharge orifice array. Further, the ink tank IT has a fiber or porous ink absorbing body. The ink is held by the ink absorbing body.

Figure 46:
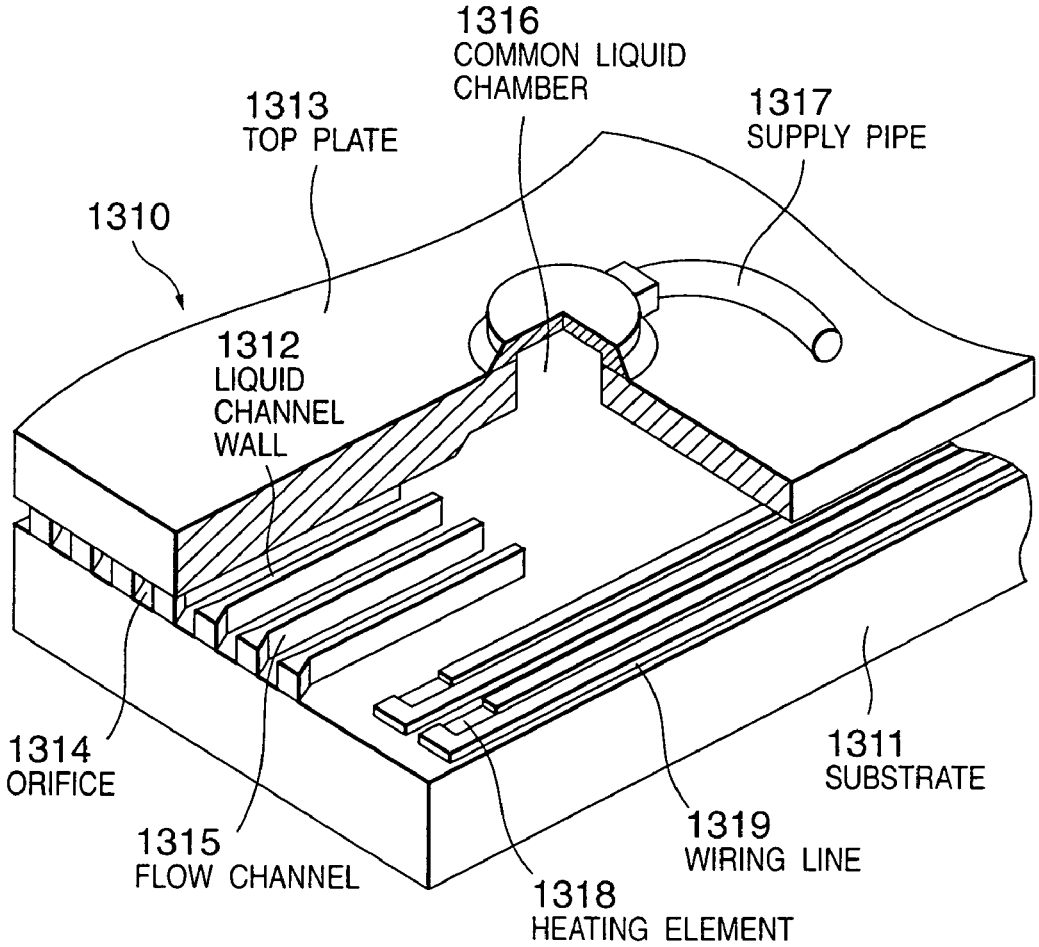
FIG. 46 is a perspective view showing the main part of a printing head used in the 13th embodiment.
Figure 47:
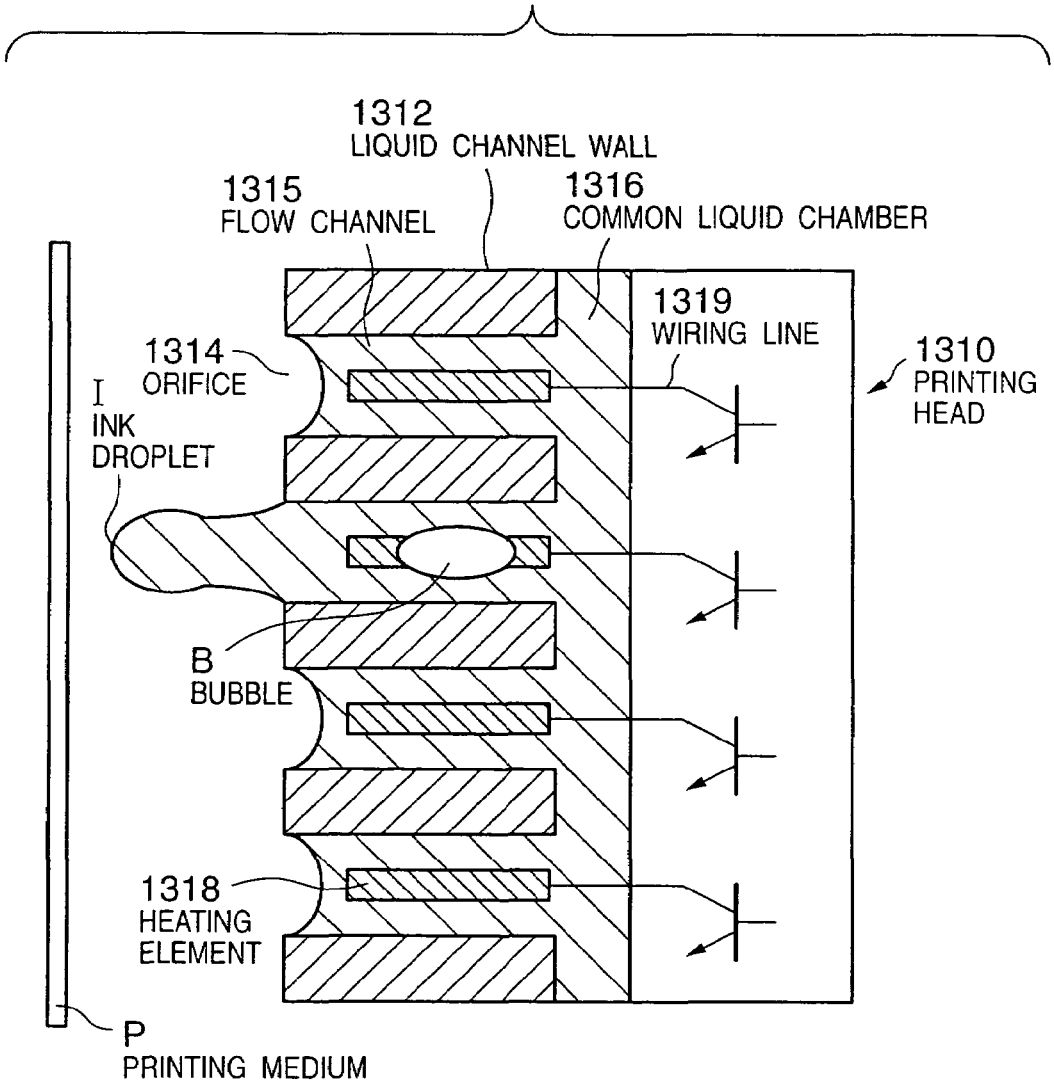
FIG. 47 is a schematic sectional view showing the main part of the printing head in FIG. 46.

FIG. 46 is an exploded perspective view showing another printing head (256 orifices are formed) which can be applied in the 13th embodiment. FIG. 47 is a schematic sectional view showing the main part of the printing head.

In a printing head 1310, reference numeral 1311 denotes a substrate in which a plurality of liquid channel walls 1312 are formed; 1313, a top plate; 1314, a plurality of orifices which constitute a plurality of nozzles; 1315, a plurality of flow channels which communicate with the respective orifices 1314; and 1316, a common liquid chamber which commonly communicates with the flow channels 1315. A portion from the orifice 1314 to the common liquid chamber 1316 is called a "nozzle". Image printing ink is supplied from an ink supply portion (not shown) to the common liquid chamber 1316 via a supply pipe 1317. Ink in the common liquid chamber 1316 is supplied to the flow channel 1315 by capillary action. Ink forms a meniscus in the orifice 1314 at the distal end of the flow channel 1315, and is stably held. Each flow channel 1315 comprises a heating element (to be also referred to as a printing element or "heater" hereinafter) 1318 serving as an electrothermal transducer. The heating element 1318 is energized via a wiring line 1319 to generate heat energy from the heating element 1318. Then, ink in the flow channel 1315 is heated to form bubbles by film boiling. The generation pressure of bubbles B discharges ink in the flow channel 1315 as an ink droplet I from the orifice 1314.

[Printing Head]

The printing head (for 64 nozzles) according to the first embodiment which is mounted in the above-described ink-jet printer will be described.

The printing head of the first embodiment can prevent an increase in the number of block enable signal lines, and can also prevent changes in printing ink density caused by interference under the pressure between nozzles generated in ink discharge. The printing head will be explained in detail with reference to FIG. 10.

Figure 10:
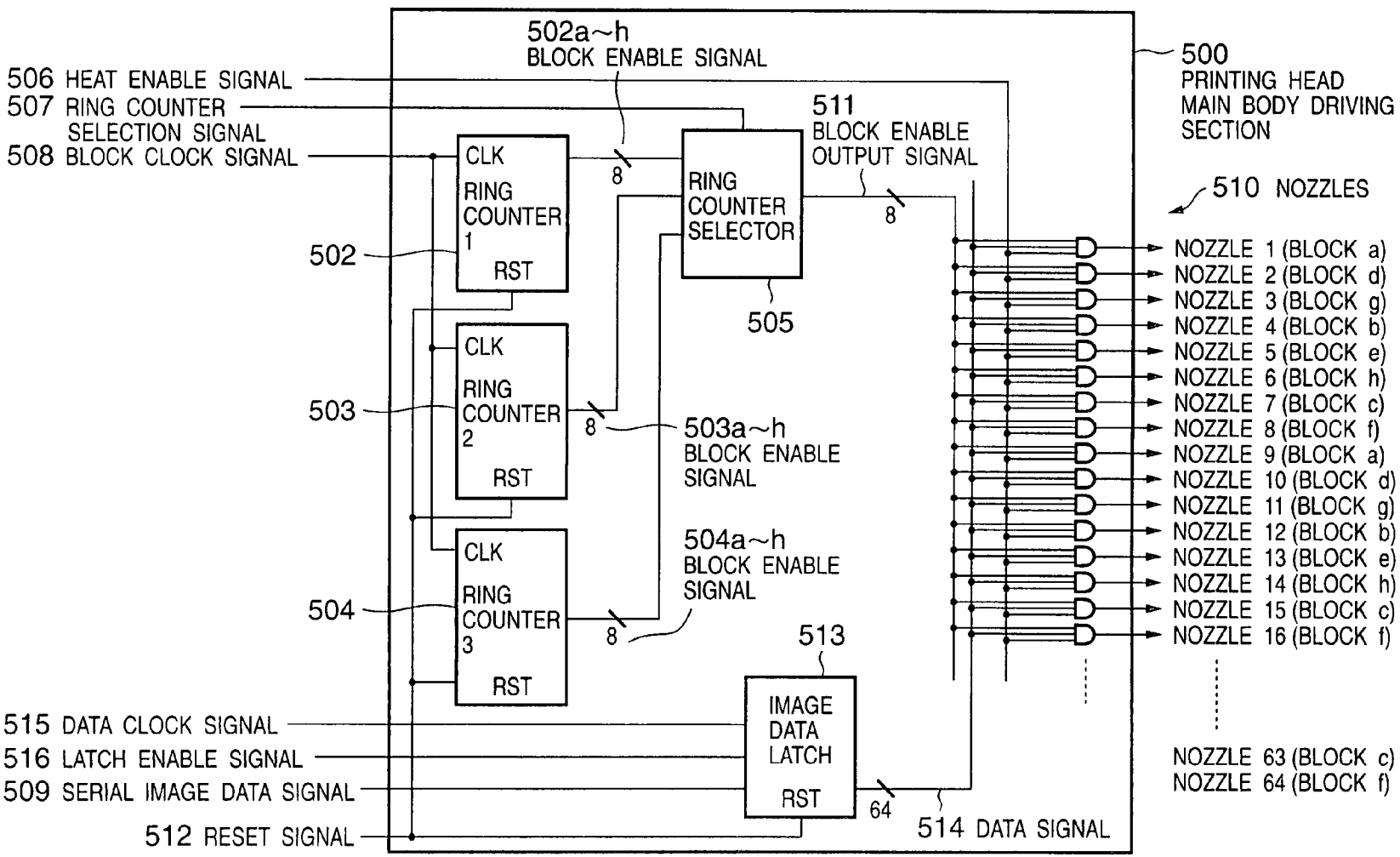
FIG. 10 is a block diagram showing the circuit arrangement of a printing head main body driving section used in the first embodiment.

FIG. 10 is a block diagram showing the arrangement of a printing head main body driving section in the printing head of the first embodiment.

The printing head main body driving section 500 is constituted by three ring counters 502 to 504, a ring counter selector 505, 64 nozzles 510, and an image data latch 513.

The 64 nozzles 510 are so set as to discharge ink at a 600-dpi pitch. The 64 nozzles are driven every eight nozzles as one block shown in FIG. 3. All the 64 nozzles discharge ink by eight driving operations.

All the 64 nozzles are grouped into block a (1, 9, 17, 25, 33, 41, 49, and 57), block b (4, 12, 20, 28, 36, 44, 52, and 60), block c (7, 15, 23, 31, 39, 47, 55, and 63), block d (2, 10, 18, 26, 34, 42, 50, and 58), block e (5, 13, 21, 29, 37, 45, 53, and 61), block f (8, 16, 24, 32, 40, 48, 56, and 64), block g (3, 11, 19, 27, 35, 43, 51, and 59), and block h (6, 14, 22, 30, 38, 46, 54, and 62).

In FIG. 10, ink is discharged from each nozzle by heating the nozzle by using three signals, i.e., a heat enable signal 506 for permitting heating of a nozzle, a block enable signal 511 for permitting heating of a block to which a nozzle belongs, and a latch enable signal 516 for permitting heating of a predetermined nozzle. The block enable signal 511 will be explained in more detail below.

If the heat enable signal 506 and block enable signal 511 are selected, and the latch enable signal 516 which is selected in the presence of image data for causing a nozzle at a predetermined position to discharge ink is selected, a predetermined nozzle is heated to print information on a printing medium by ink discharge.

[Generation of a Block Enable Output Signal]

A method of generating the block enable signal 511 will be described.

Figures 1A, 1B:
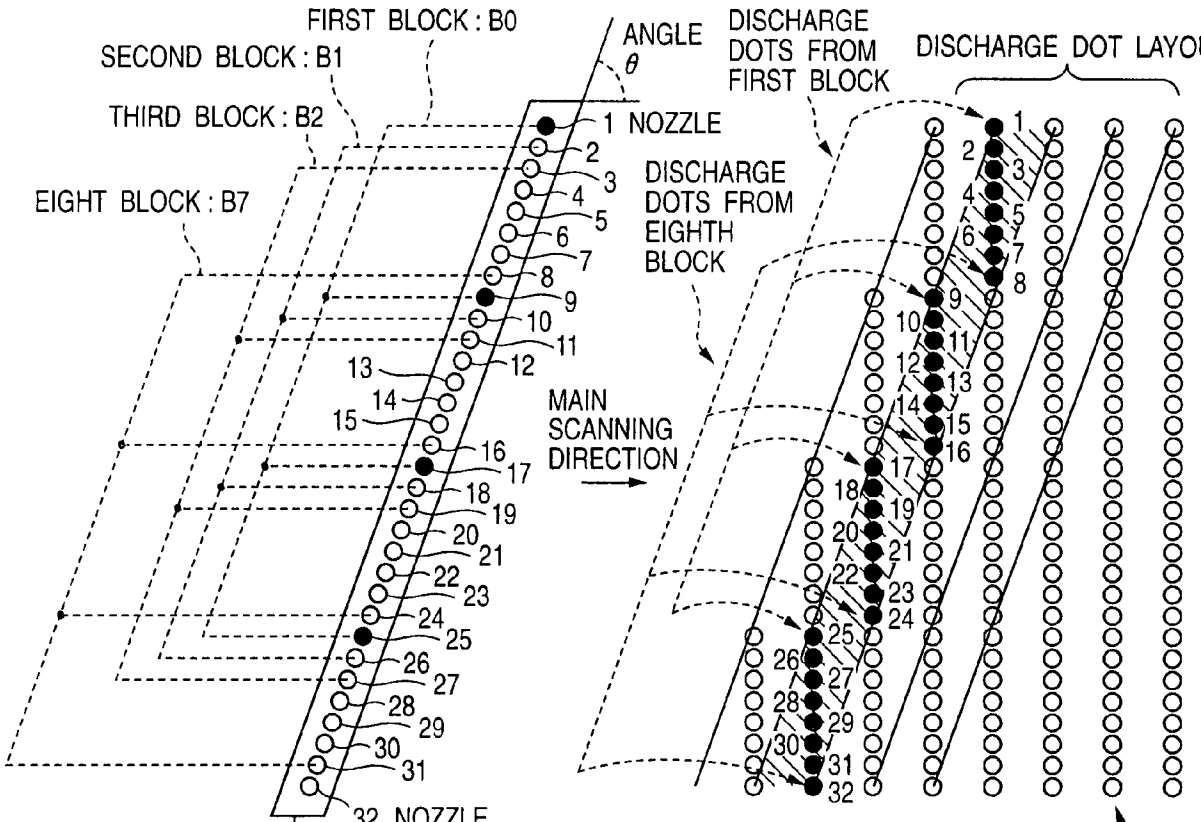
FIGS. 1A and 1B are views for explaining a printing head (8 blocks, 32 nozzles) and a discharge dot layout.
Figure 2:
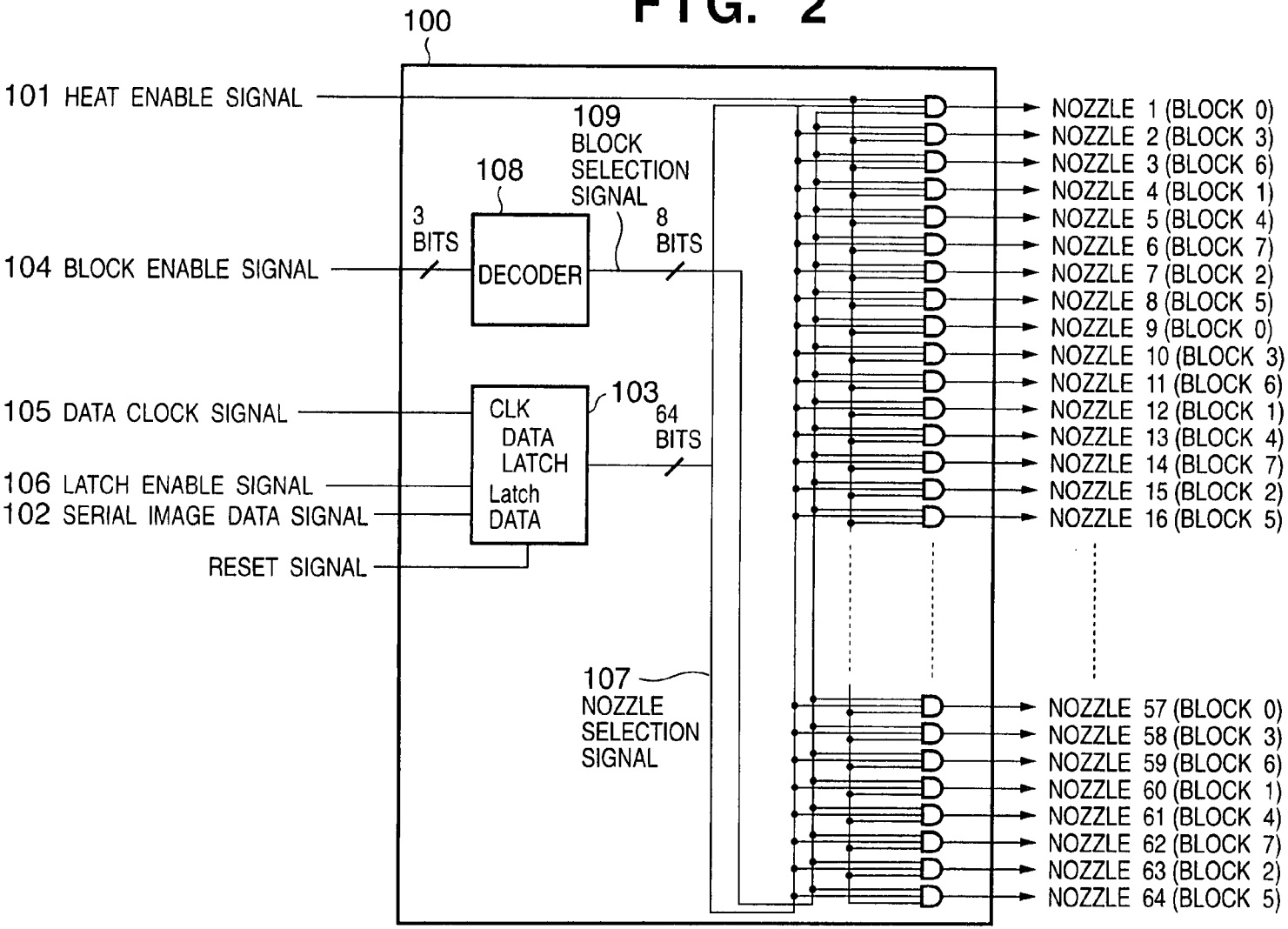
FIG. 2 is a block diagram showing the circuit arrangement of a printing head main body driving section in the first prior art (8 blocks, 64 nozzles)

With the use of a block clock signal 508 (one line), the printing head main body driving section 500 of the first embodiment can decrease the number of input signal lines to the printing head main body driving section 500, compared to the use of block enable signals (three lines in the conventional printer shown in FIG. 2). The block enable signal 511 is generated in the printing head main body driving section 500.

Figure 11:
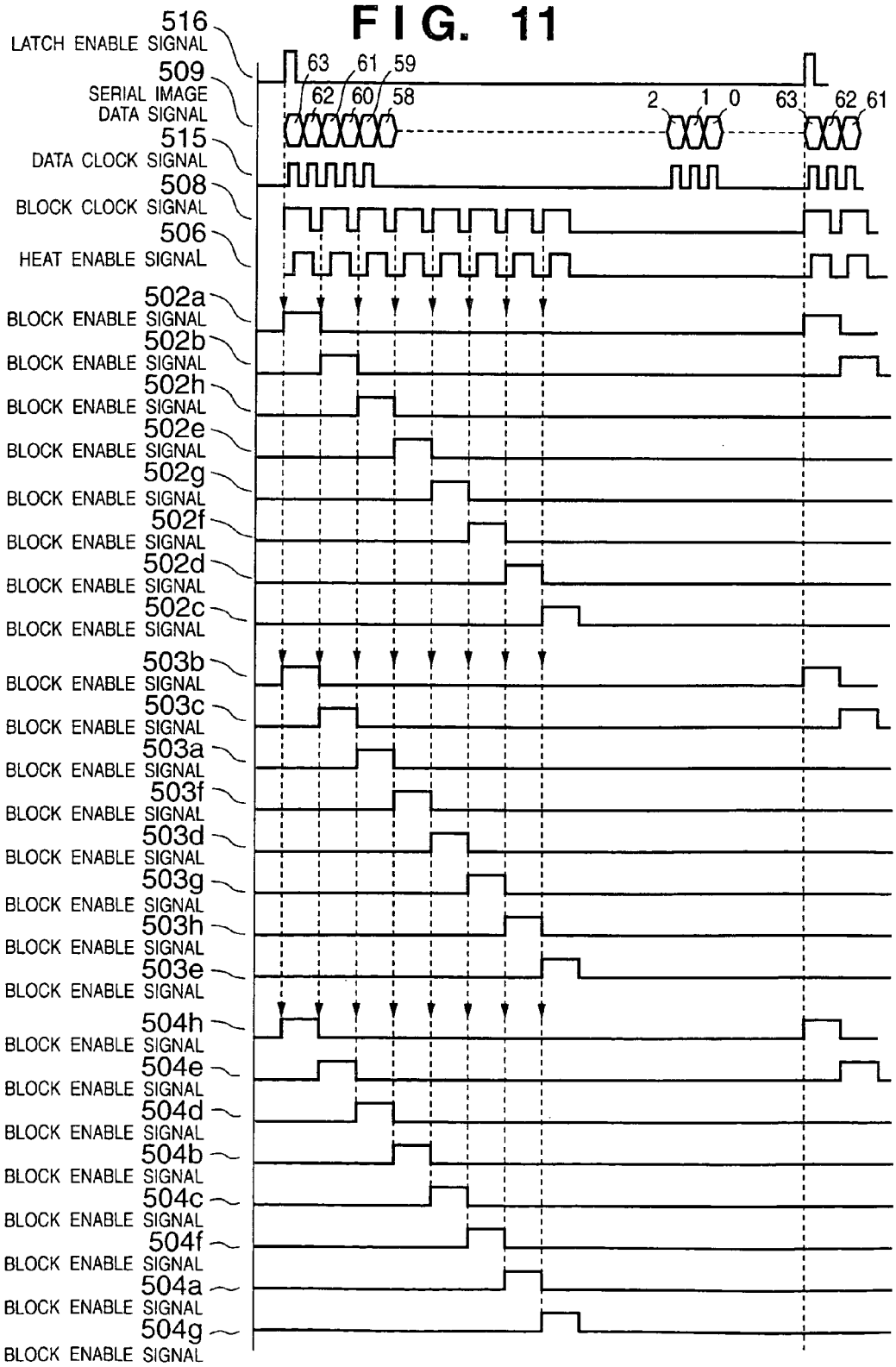
FIG. 11 is a timing chart for explaining signal generation timings used in the first embodiment.

The first ring counter 502 sequentially outputs, e.g., block enable signals 502*a*→502*b*→502*h*→502*e*→502*g*→502*f*→502*d*→502*c* shown in the timing chart of FIG. 11 in correspondence with the count output of the input block clock signals 508.

The block enable signals 502*a* to 502*h* are signals for operating (enabling) the eight blocks (FIG. 3) so as to go through them once sequentially from a to f.

The second ring counter 503 sequentially outputs, e.g., block enable signals 503*b*→503*c*→503*a*→503*f*→503*d*→503*g*→503*h*→503*e* shown in the timing chart of FIG. 11 in correspondence with the count output of the input block clock signals 508.

Similarly, the third ring counter 504 sequentially outputs, e.g., block enable signals 504*h*→504*e*→504*d*→504*b*→504*c*→504*f*→504*a*→504*g* shown in the timing chart of FIG. 11 in correspondence with the count output of the input block clock signals 508.

The block enable signals 502*a* to 502*c*, 503*b* to 503*e*, 504*h* to 504*g* as output signals from the first to third ring counters, and a ring counter selection signal 507 are input to the ring counter selector 505.

Based on the ring counter selection signal 507, the ring counter selector 505 selects signals from the block enable signals 502*a* to 502*c*, block enable signals 503*b* to 503*e*, and block enable signals 504*h* to 504*g*. The ring counter selector 505 outputs the selected signals as block enable output signals 511*a* to 511*h*, thereby selecting a block from which ink is to be discharged.

A serial image data signal 509 for selecting predetermined nozzles is sent to the image data latch 103 together with a data clock signal 515 and the latch enable signal 516. The image data latch 513 holds all the signals necessary to drive all the nozzles, and then transfers a data signal 514 to designated nozzles.

By controlling the above-described signals, one-path printing (64 nozzles are grouped into eight blocks every eight nozzles and discharge ink) can be executed using predetermined nozzles in the printing head main body driving section 500 shown in FIG. 10.

In FIG. 10, the latch enable signal 516, serial image data signal 509, and data clock signal 515 transmit next data signals.

[Driving of Each Block by the Ring Counter]

FIG. 12 shows the driving order of the respective blocks of the printing head in the use of the ring counters 502, 503, and 504.

Figure 3:
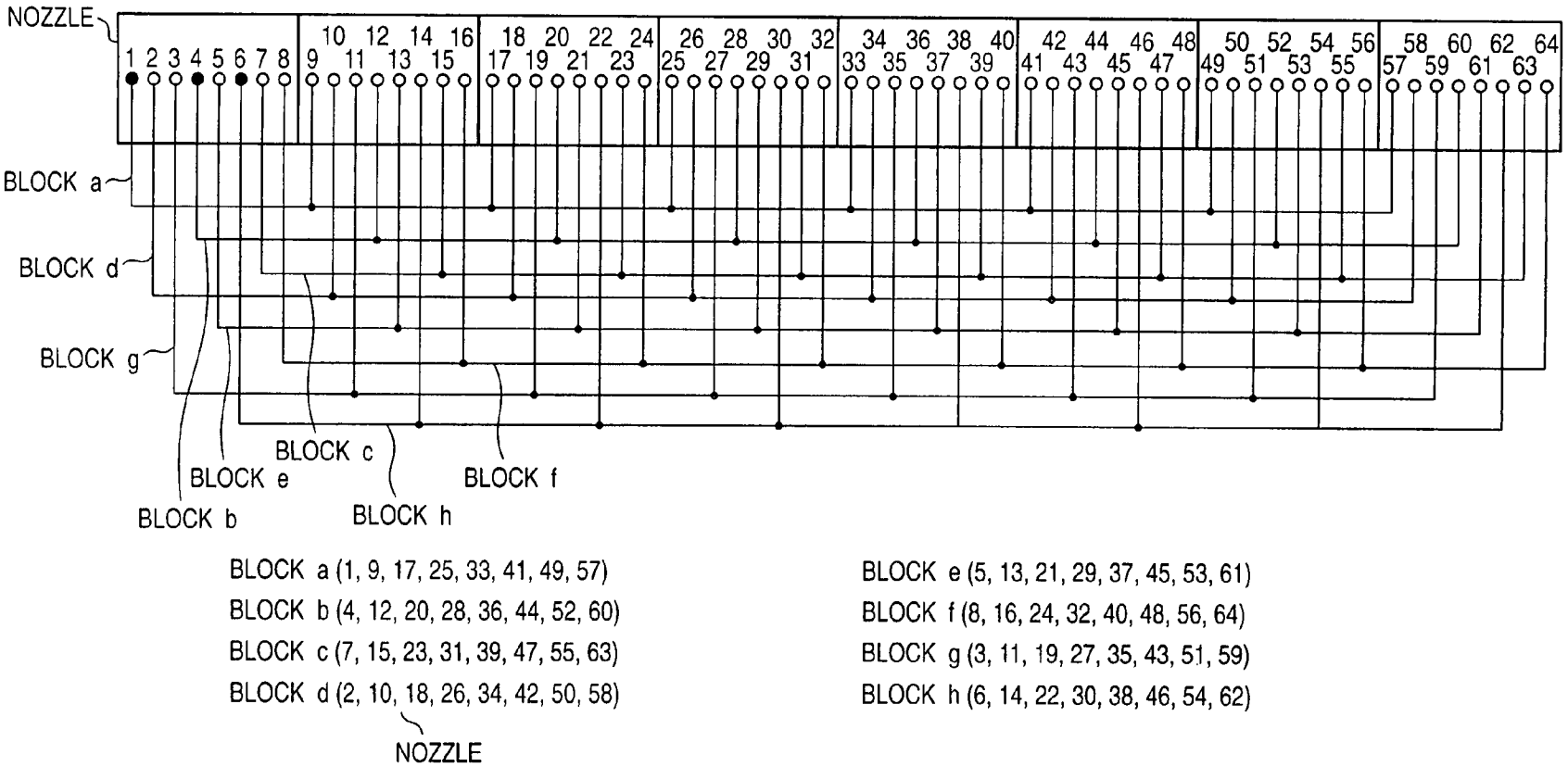
FIG. 3 is a view for explaining an 8-block, 64-nozzle printing head.
Figure 4:
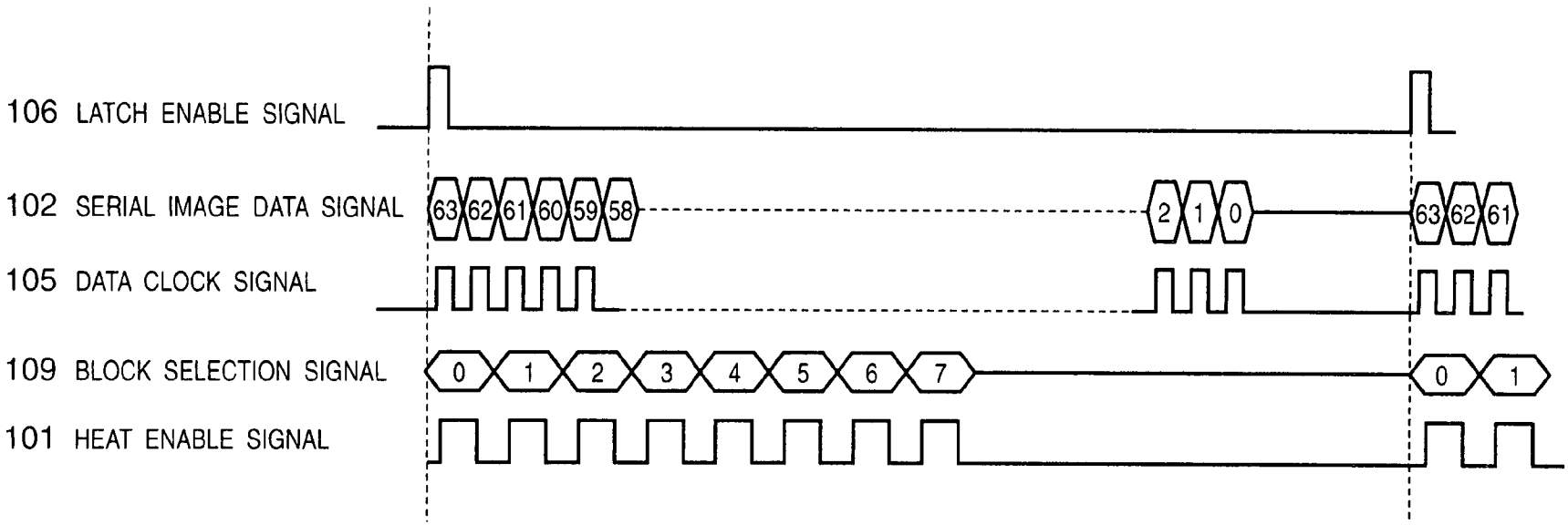
FIG. 4 is a timing chart for explaining signal generation timings in the first prior art.
Figure 5:
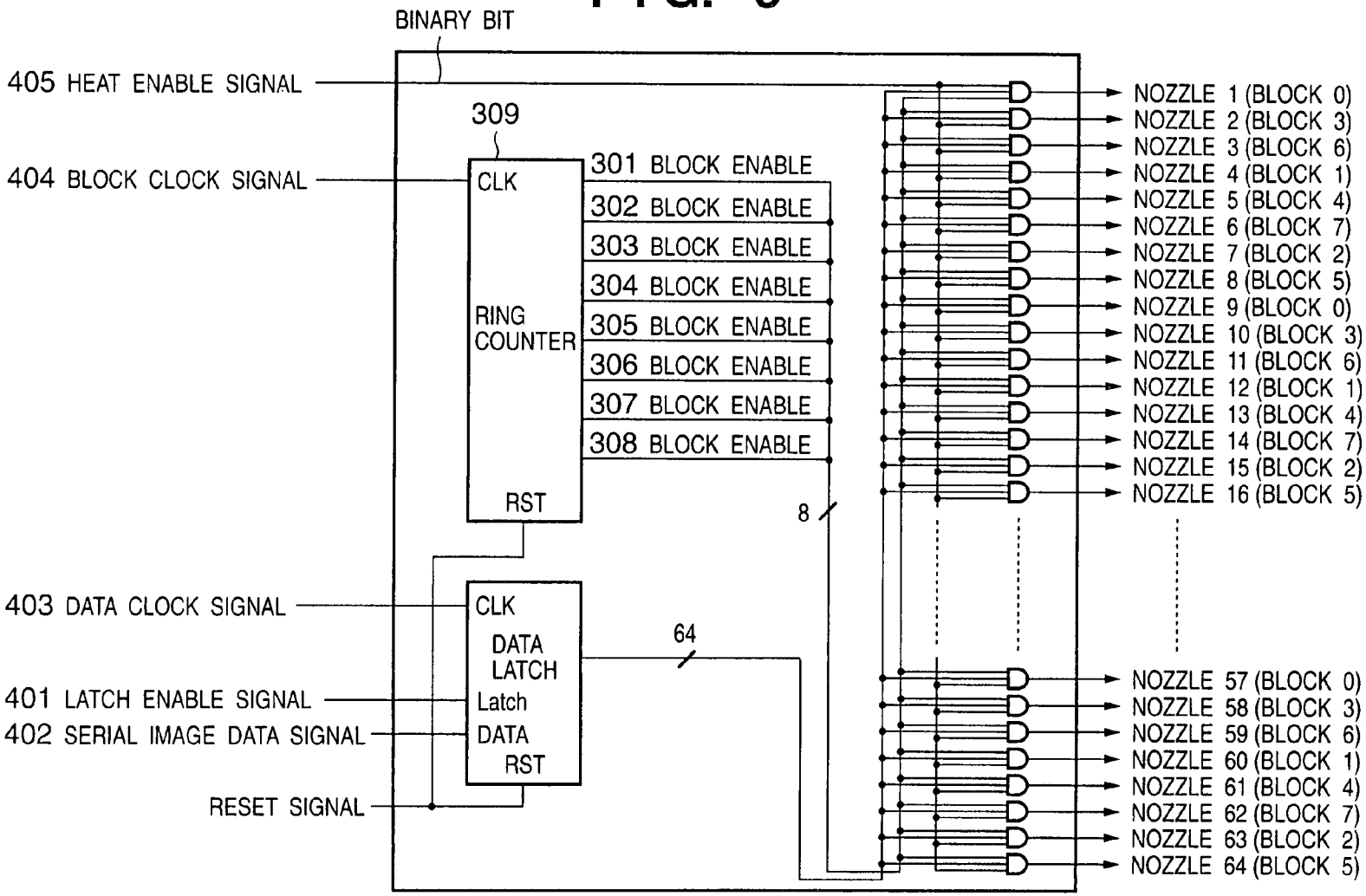
FIG. 5 is a block diagram showing the circuit arrangement of a printing head main body driving section in the second prior art (8 blocks, 64 nozzles)
Figure 6:
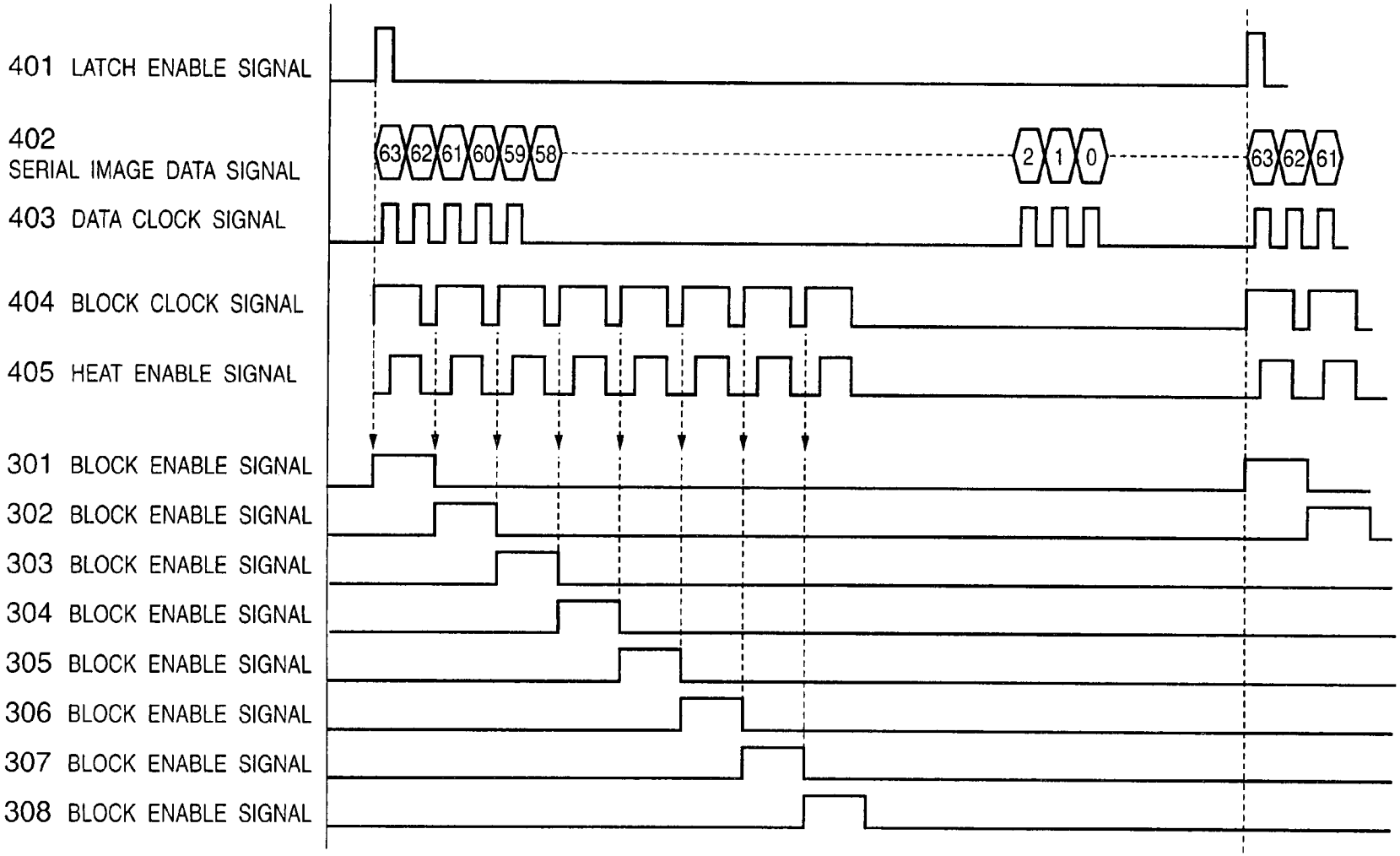
FIG. 6 is a timing chart for explaining signal generation timings in the second prior art.

In the first ring counter 502, the driving order used when the 64 nozzles shown in FIG. 3 are grouped into eight blocks and driven is so set as to drive block a first, block b second, block h third, block e fourth, block g fifth, block f sixth, block d seventh, and block c eighth.

Similarly, the block driving orders in the ring counters 503 and 504 are so set as to drive the eight blocks in accordance with driving orders shown in FIG. 12.

As is apparent from FIG. 12, the ring counters 502, 503, and 504 have different block driving orders.

The ring counter selector 505 selects ring counter signals shown in FIG. 11 so as to select the ring counter signal 502 first, then the ring counter signal 503, and finally the ring counter signal 504. This selection is successively repeated to change the block driving order every driving.

[Reduction of Changes in Ink Density Caused by Pressure Interference]

A method of reducing changes in ink density caused by pressure interference in ink discharge by using block enable output signals generated by sequentially selecting the three different ring counter signals described above will be explained with reference to FIGS. 13 to 16.

In the following description, the nozzle column direction will be a raster layout direction, and the scanning direction will be a column direction.

The motion of the printing head and an image to be printed will be described with reference to an example in FIG. 13.

Figure 13:
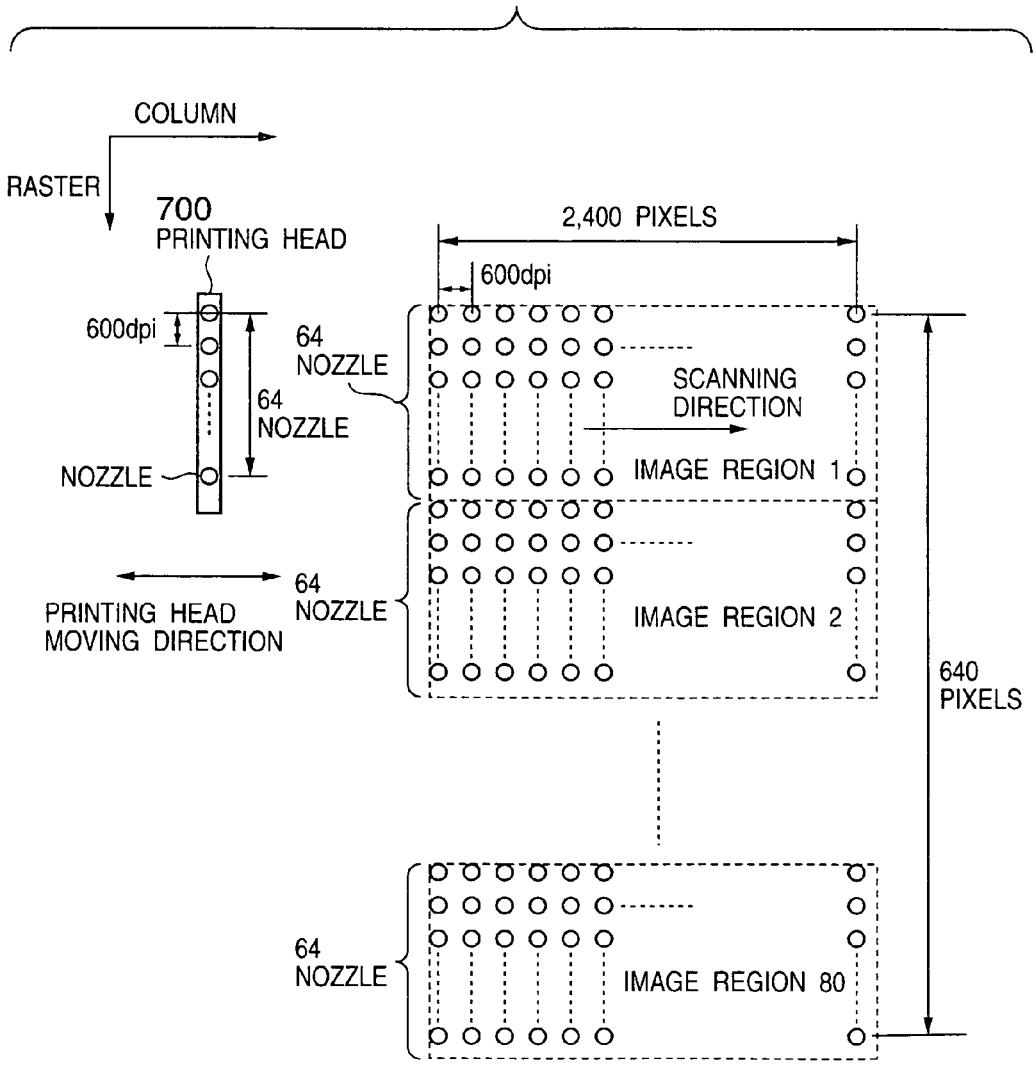
FIG. 13 is a view for explaining the printing order of dots (pixels) printed in the first embodiment.

In an image region 1 of FIG. 13, the printing head is scanned in the scanning direction indicated by an arrow in FIG. 13. Then, the 64 nozzles, i.e., eight nozzles×8 blocks sequentially discharge cyan ink eight times, forming pixels (dots) of cyan ink at a 600-dpi pitch in the scanning direction.

After printing of the image region 1 ends, a printing head 700 moves in a direction opposite to the scanning direction and returns to the home position.

In an image region 2, similar to the image region 1, the printing head is scanned in the scanning direction indicated by the arrow in FIG. 13. Similar to the image region 1, the 64 nozzles discharge cyan ink, forming pixels (dots) of cyan ink at a 600-dpi pitch in the scanning direction. After printing of the image region 2 ends, the printing head 700 moves in a direction opposite to the scanning direction and returns to the home position.

After printing of all the image regions end (e.g., 2,400 pixels (horizontal)×640 pixels (vertical) on one page), an image shown in FIG. 13 is obtained.

Figure 14:
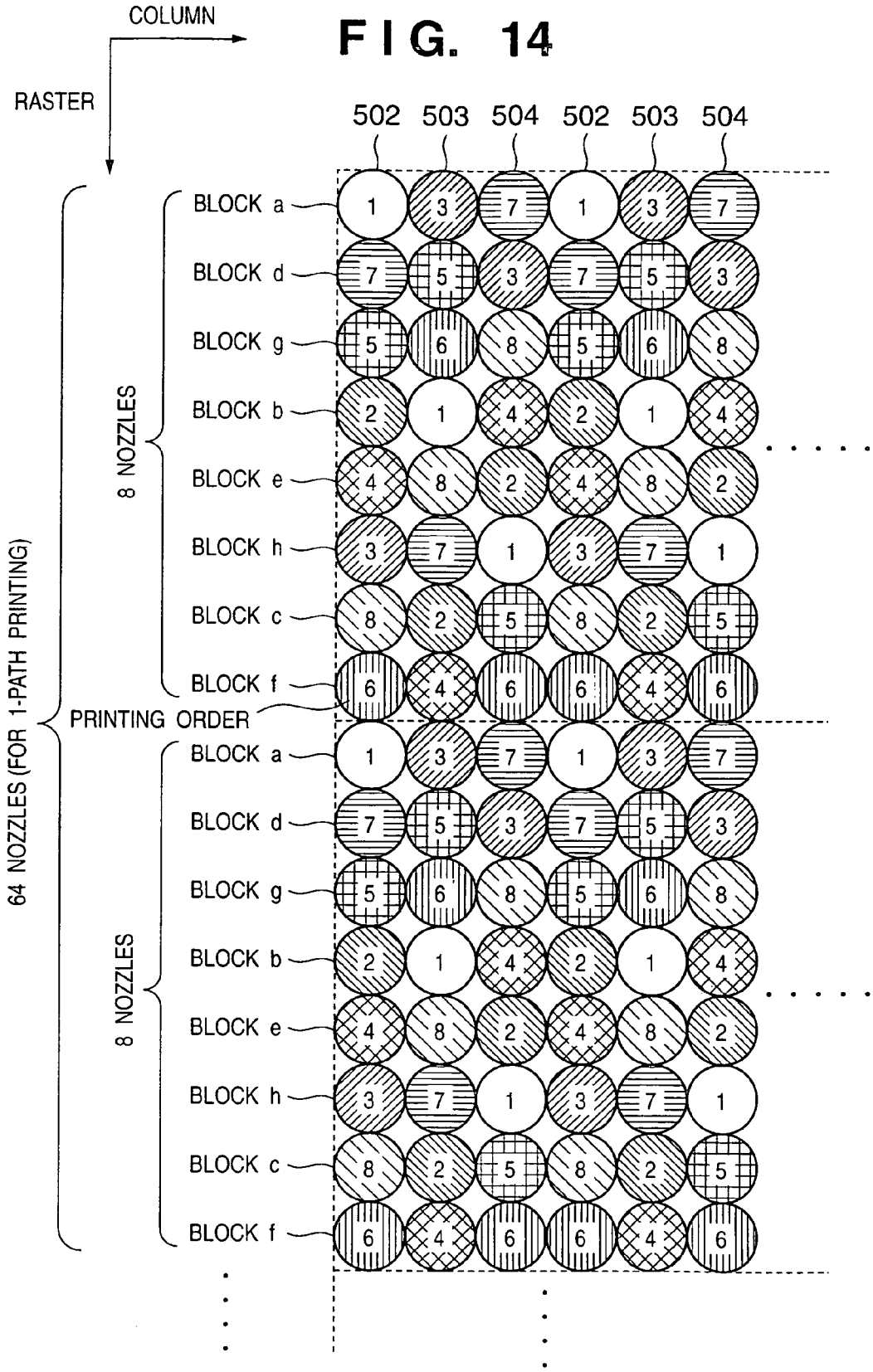
FIG. 14 is a view for explaining in detail the printing order of dots (pixels) printed in the first embodiment.

FIG. 14 is an enlarged view showing part (8 rasters×6 columns) of the first image (by the 64 nozzles) in the image region 1 of FIG. 13.

FIG. 14 shows an example in which ring counter signals to be selected are sequentially switched every column by the ring counter selector 505 in executing printing shown in FIG. 13.

For the first column (64 nozzles), ring counter signals are output once in the order of 502*a*→502*b*→502*h*→502*e*→502*g*→502*f*→502*d*→502*c*. For the second column, ring counter signals are output once in the order of 503*b*→503*c*→503*a*→503*f*→503*d*→503*g*→503*h*→502*e*. For the third column, ring counter signals are output once in the order of 504*h* →504*e*→504*d*→504*b*→504*c*→504*f*→504*a*→504*g*. Thereafter, the same ring counter signals are repetitively selected and output for the first to third columns.

On the first column, the ring counter signal 502*a* causes eight nozzles belonging to block a shown in FIG. 3 to discharge ink, forming the first dot (pixel) shown in FIG. 14. Then, the ring counter signal 502*b* causes eight nozzles belonging to block b shown in FIG. 3 to discharge ink, forming the second dot (pixel) shown in FIG. 14.

The ring counter signal 502*h* causes eight nozzles belonging to block h shown in FIG. 3 to discharge ink, forming the third dot (pixel) shown in FIG. 14. Similarly, the fourth to eighth dots (pixels) shown in FIG. 14 are formed, and 64 dots (pixels) are formed.

On the second column, the ring counter signal 503*b* causes eight nozzles belonging to block b shown in FIG. 3 to discharge ink, forming the first dot (pixel) shown in FIG. 14. Then, the ring counter signal 503*c* causes eight nozzles belonging to block c shown in FIG. 3 to discharge ink, forming the second dot (pixel) shown in FIG. 14.

The ring counter signal 503*a* causes eight nozzles belonging to block a shown in FIG. 3 to discharge ink, forming the third dot (pixel) shown in FIG. 14. Similarly, the fourth to eighth dots (pixels) shown in FIG. 14 are formed, and 64 dots (pixels) are formed.

On the third column, the ring counter signal 504*h* causes eight nozzles belonging to block h shown in FIG. 3 to discharge ink, forming the first dot (pixel) shown in FIG. 14. Then, the ring counter signal 504*e* causes eight nozzles belonging to block e shown in FIG. 3 to discharge ink, forming the second dot (pixel) shown in FIG. 14.

The ring counter signal 504*d* causes eight nozzles belonging to block d shown in FIG. 3 to discharge ink, forming the third dot (pixel) shown in FIG. 14. Similarly, the fourth to eighth dots (pixels) shown in FIG. 14 are formed, and 64 dots (pixels) are formed.

In the above description, the respective ring counter signals are repetitively used in an order of 502→503→504. Alternatively, for example, the respective ring counter signals may be repetitively used twice.

Alternatively, the respective ring counter signals may be used in an order of 502→503→504, then in an opposite order of 504→503→502, and in the original order of 502→503→504. Alternatively, the ring counter signals may be used at random.

Figure 15:
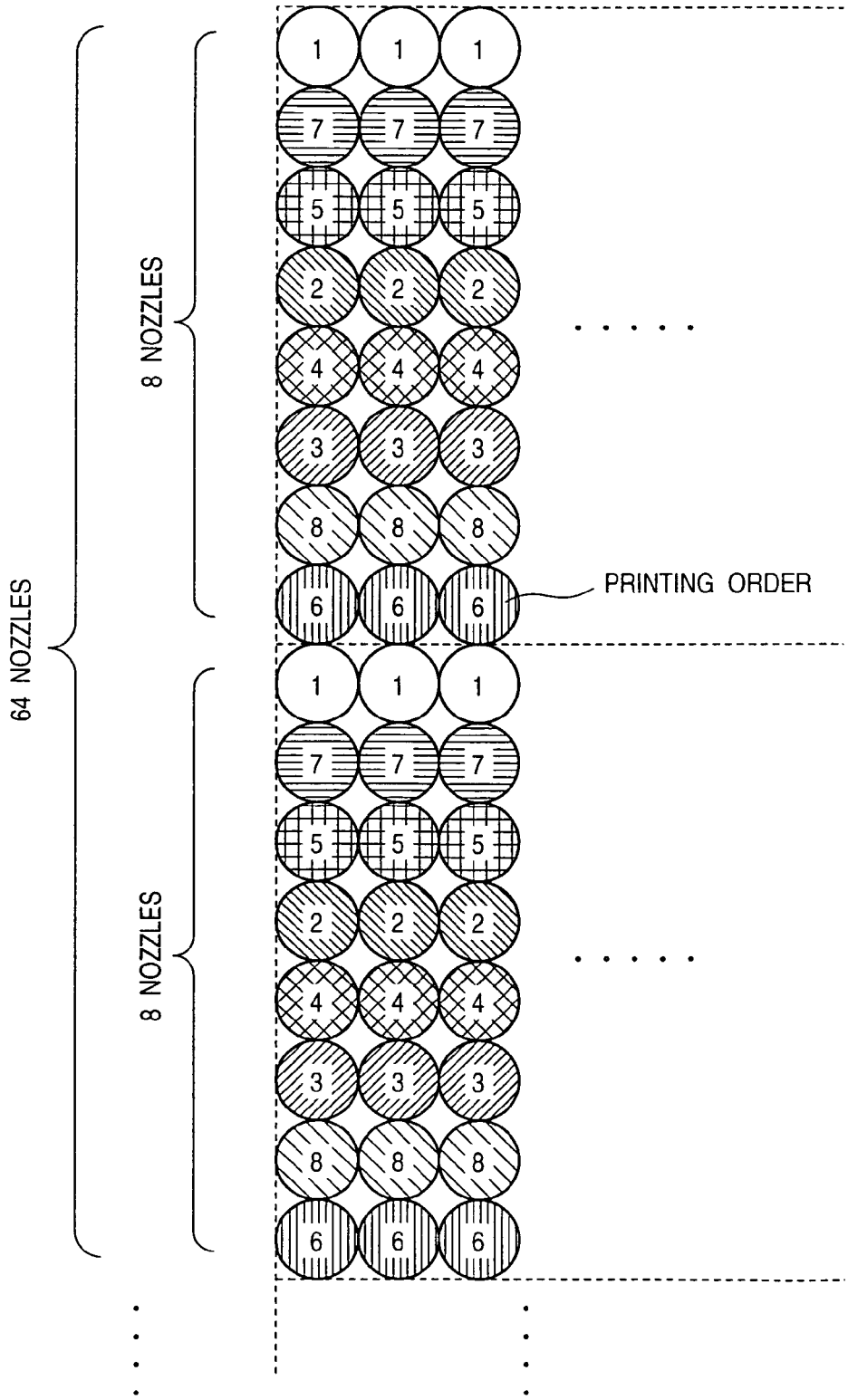
FIG. 15 is a view for explaining in detail the printing order of dots (pixels) printed in the prior art.

FIG. 15 shows a conventional printing method for comparison with FIG. 14.

FIG. 15 shows an example when selection of a ring counter signal in the ring counter selector 505 is fixed to only the ring counter signal 502.

In FIG. 15, for the first column (64 nozzles) ring counter signals are output once in the order of 502*a*→502*b*→502*h*→502*e*→502*g*→502*f*→502*d*→502*c*. For the second and third columns, ring counter signals are also output once in the order of 502*a*→502*b*→502*h*→502*e*→502*g*→502*f*→502*d*→502*c*.

Images shown in FIGS. 14 and 15 were printed using the same color ink with the same tone. On the image shown in FIG. 15 that was formed by fixing the conventional ring counter signal, unevenness (stripes) was conspicuous on the entire image due to the same printing order of dots (pixels) in respective raster directions.

To the contrary, on the image shown in FIG. 14 that was formed by sequentially selecting and using the three different ring counter signals of the first embodiment, no conspicuous unevenness (stripes) occurred on the entire image because of different printing orders of dots (pixels) in respective raster directions.

In the first embodiment, ring counter signals are switched and used for each column. Ring counter signals may be switched for a plurality of columns.

The number of ring counter signals is not limited to three, but may be two or four or more. The first embodiment has described the method of improving the image quality in 1-path printing. Also in multi-path printing, the image quality can be improved by the above-described method.

[Method of Reducing Changes in Ink Density Caused by Pressure Interference]

A control method executed by the MPU 1701 for the printing head main body driving section 500 described above will be explained with reference to the flow chart of FIG. 16.

In step S520, the block clock signal 508 is input to the three ring counters 502, 503, and 504, and the heat enable signal 506 is input to the nozzles 510.

In step S522, the data clock signal 515, the latch enable signal 516, the serial image data signal 509, and a reset signal 512 are input to the image data latch 513.

In step S524, each of the three ring counters generates block enable signals a to h and inputs them to the ring counter selector 505.

In step S526, the ring counter selection signal 507 is input to the ring counter selector 505.

In step S528, the ring counter selector 505 selects a ring counter on the basis of the ring counter selection signal 507, and outputs signals input from the selected ring counter as the block enable output signals 511*a* to 511*h* for designating each block.

In step S530, the data signal 514 for selecting nozzles designated by the serial image data signal or the like input to the image data latch 513 is output to the nozzles 510.

In step S532, selected nozzles among the nozzles 510 discharge ink on the basis of an AND logic circuit for three types of signals: the heat enable signal 506, block enable output signals 511*a* to 511*h*, and data signal 514. In step S534, whether all the pixels have been printed is checked. if NO in step S534, the flow returns to step S520 to continuously execute processing in the above-described steps. If YES in step S534, the flow advances to step S536 to end a series of processes.

Second Embodiment

An ink-jet printing head and an ink-jet printer in which the printing head is mounted will be described according to the second embodiment.

The ink-jet printer of the second embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the second embodiment will be explained.

The printing head of the second embodiment is a printing head whose arrangement is partially common to the printing head of the first embodiment. In the following description, a repetitive description of the common arrangement will be omitted, and only a difference will be explained.

The printing head of the second embodiment uses as an input signal a block clock signal instead of a block enable signal, in order to prevent an increase in the number of block enable signal lines along with an increase in the number of nozzles. This is the same as the first embodiment.

The printing head of the second embodiment is different from that of the first embodiment in a means for reducing the influence of pressure interference caused in ink discharge, i.e., a block enable output signal generation means for changing the printing order of dots (pixels) in the raster direction.

Figure 17:
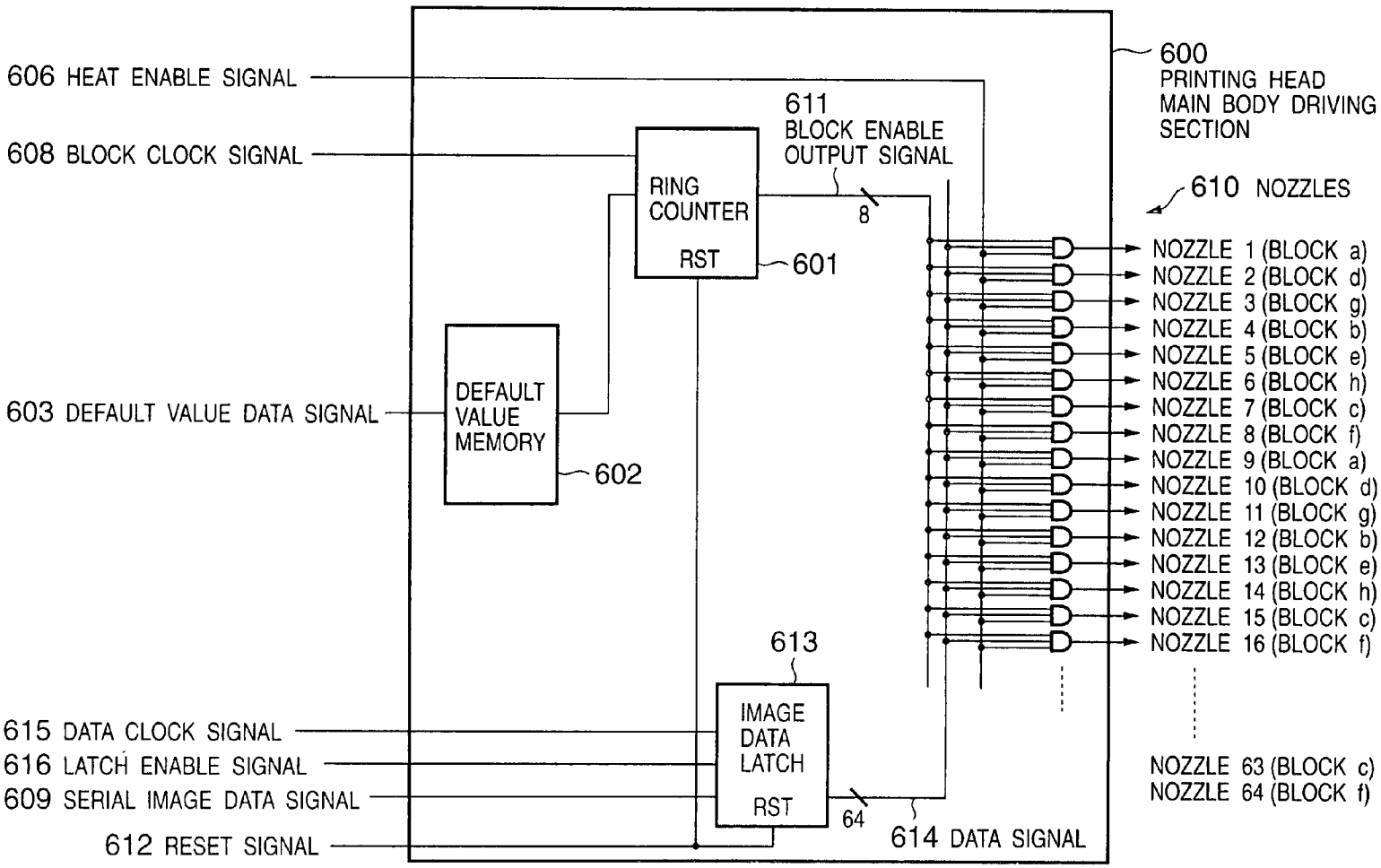
FIG. 17 is a block diagram showing the circuit arrangement of a printing head main body driving section used in the second embodiment.

FIG. 17 shows the arrangement of a printing head main body driving section 600 adopted in the second embodiment.

The printing head main body driving section 500 of the first embodiment uses the three ring counters 502, 503, and 504 and one ring counter selector 505. In place of them, the printing head main body driving section 600 of the second embodiment generates a block enable output signal 611 by using one default value memory 602, one ring counter 601, and a default value data signal 603.

More specifically, the default value data signal 603 is transmitted to the default value memory 602, and the default value memory 602 stores it.

The default value memory 602 supplies the stored default value to the ring counter 601, and the ring counter 601 outputs the block enable output signal 611 out of the received default value in synchronism with a block clock signal 608.

Note that the default value can be set every column, as shown in FIG. 19.

FIG. 18 shows an example of the block enable output signal 611 from the ring counter 601 that represents the driving order of respective blocks.

In executing printing of an image shown in FIG. 13, the default value of the ring counter 601 is switched every column by the above-described method.

For example, as shown in the example of FIG. 19, the default value for the first column is a; that of the second column, b; that of the third column, c; that of the fourth column, d; that of the fifth column, e; that of the sixth column, f; that of the seventh column, g; that of the eighth column, h; that of the ninth column, a; that of the 10th column, b; . . . . In this way, the default value of the ring counter 601 is repetitively set every column.

Upon the completion of one scanning, the default value is sequentially selected from a in the next scanning.

Figure 20:
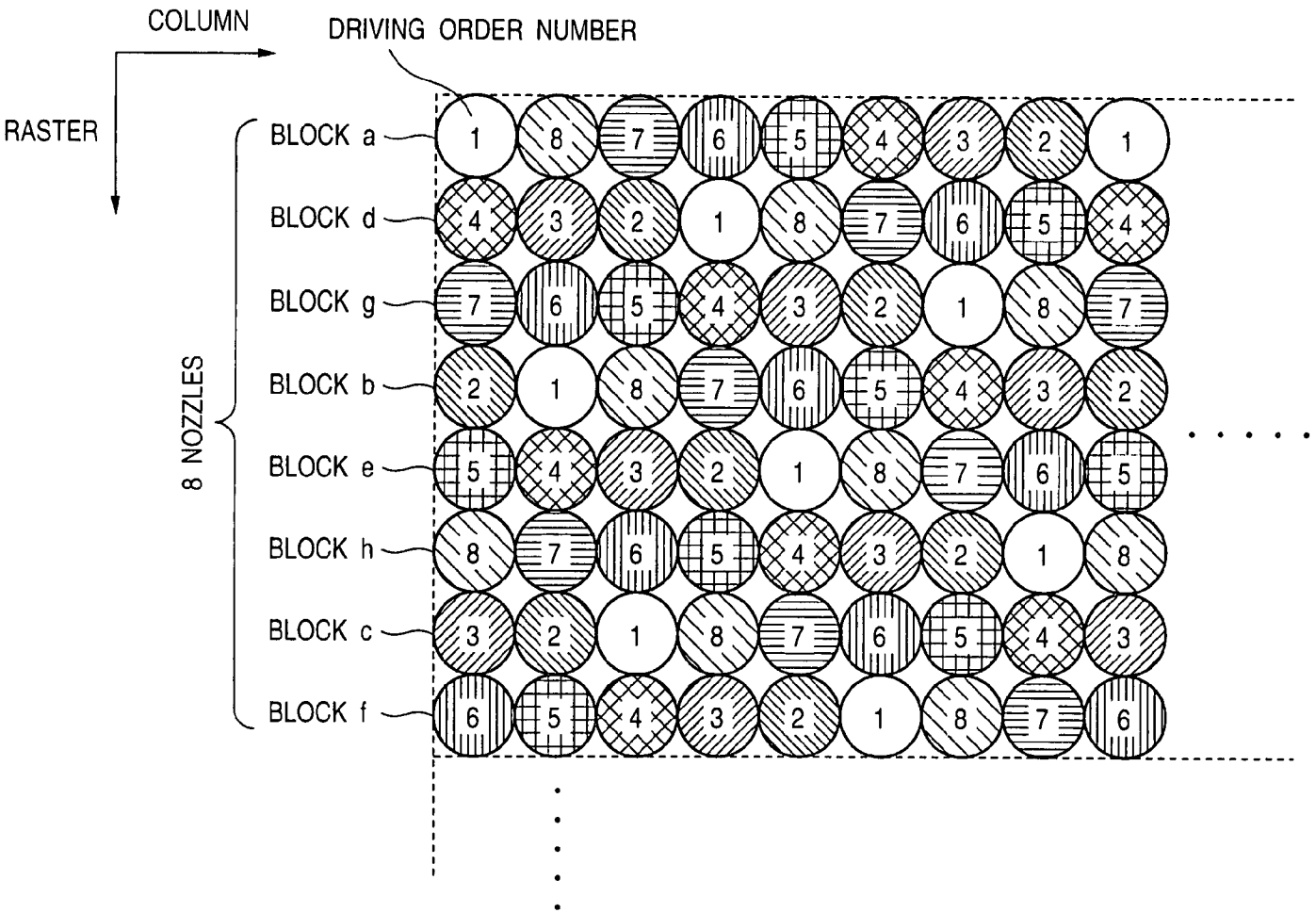
FIG. 20 is a view for explaining in detail the printing order of dots (pixels) printed in the second embodiment.

FIG. 20 shows the printing order of dots (pixels) when an image is printed using the default values of respective columns shown in FIG. 19. Numbers in ○ in FIG. 20 represent positions in the driving order.

The completed image is almost free from unevenness (stripes) as a whole because of different printing orders of dots in respective raster directions, similar to the image described in the first embodiment (FIG. 14).

Figure 21:
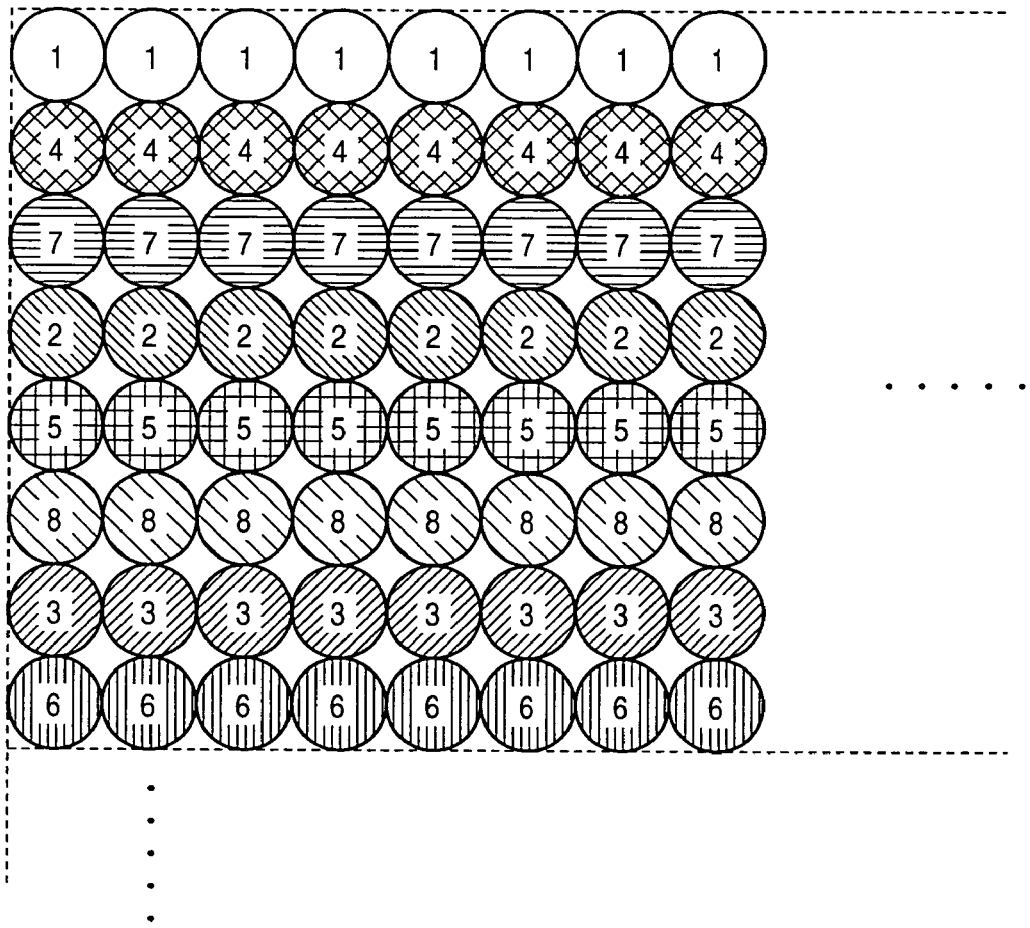
FIG. 21 is a view for explaining in detail the printing order of dots (pixels) printed in the prior art.

FIG. 21 shows an image printed by the conventional method for comparison with FIG. 20.

That is, FIG. 21 shows an image printed while the default value of the ring counter 601 is kept fixed to a every column. Numbers in ○ in FIG. 21 represent positions in the driving order. When an image is formed by the conventional method, dots at the same position in the driving order succeed in the raster direction. This generates stripe-like unevenness, degrading the image quality.

In the second embodiment, the ring counter default value to be selected is switched for each column. Alternatively, the ring counter default value may be switched for a plurality of columns.

[Method of Reducing Changes in Ink Density Caused by Pressure Interference]

A control method executed by an MPU 1701 for the printing head main body driving section 600 described above will be explained with reference to the flow chart of FIG. 22.

In step S620, the block clock signal 608 is input to the ring counters 601, and a heat enable signal 606 is input to nozzles 610.

In step S622, a data clock signal 615, latch enable signal 616, serial image data 609, and reset signal 612 are input to an image data latch 613.

In step S624, the default value data signal 603 (a to h) is input to the default value memory 602.

In step S626, the default value memory 602 outputs the default value of the block enable signal for each column to the ring counter.

In step S628, block enable output signals 611*a* to 611*h* for designating each block are generated based on the default value designated for each column, and output to respective nozzles.

In step S630, a data signal 614 for selecting nozzles designated by the serial image data signal or the like input to the image data latch is output to the nozzles 610.

In step S632, selected nozzles among the nozzles 610 discharge ink on the basis of an AND logic circuit for three types of signals: the heat enable signal 606, block enable output signals 611*a* to 611*h*, and data signal 614.

In step S634, whether all the pixels have been printed is checked. If NO in step S634, the flow returns to step S620 to continuously execute processing in the above-described steps. If YES in step S634, the flow advances to step S636 to end a series of processes.

Third Embodiment

An ink-jet printing head and an ink-jet printer in which the printing head is mounted will be described according to the third embodiment.

The printing head of the third embodiment, and the ink-jet printer of the third embodiment in which the ink-jet printing head is mounted can take the same arrangements as those of the printing head and ink-jet printer described in the first embodiment. A repetitive description of them will be omitted, and only a difference will be explained.

[Printing Head]

The arrangement of a printing head main body controller according to the third embodiment and an image to be formed are the same as those described in the first embodiment except that the counter is switched every scan.

Figure 23:
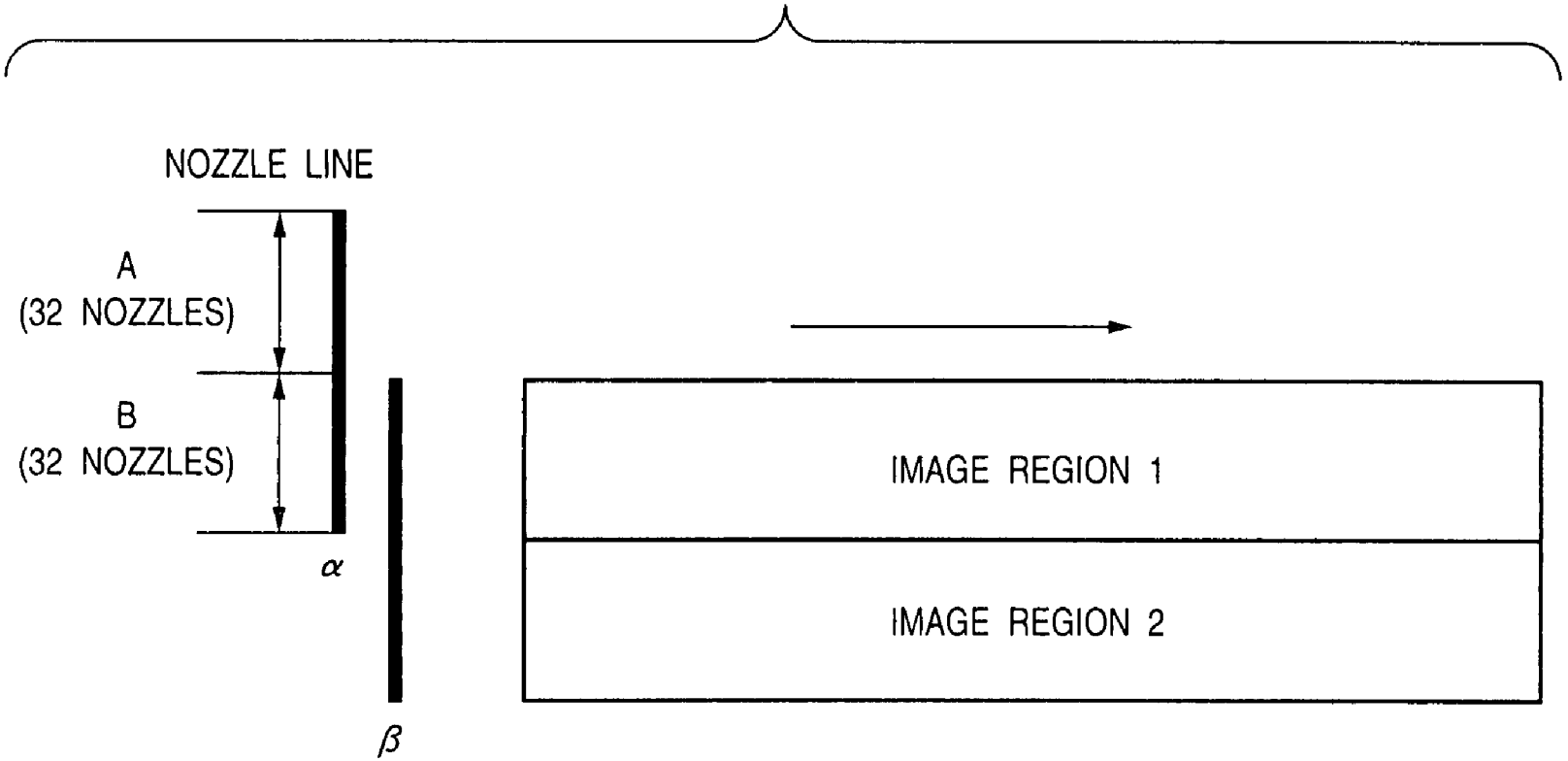
FIG. 23 is a view for explaining printing control in the third embodiment.

FIG. 23 shows a 2-path printing operation in the third embodiment.

Figure 24A:
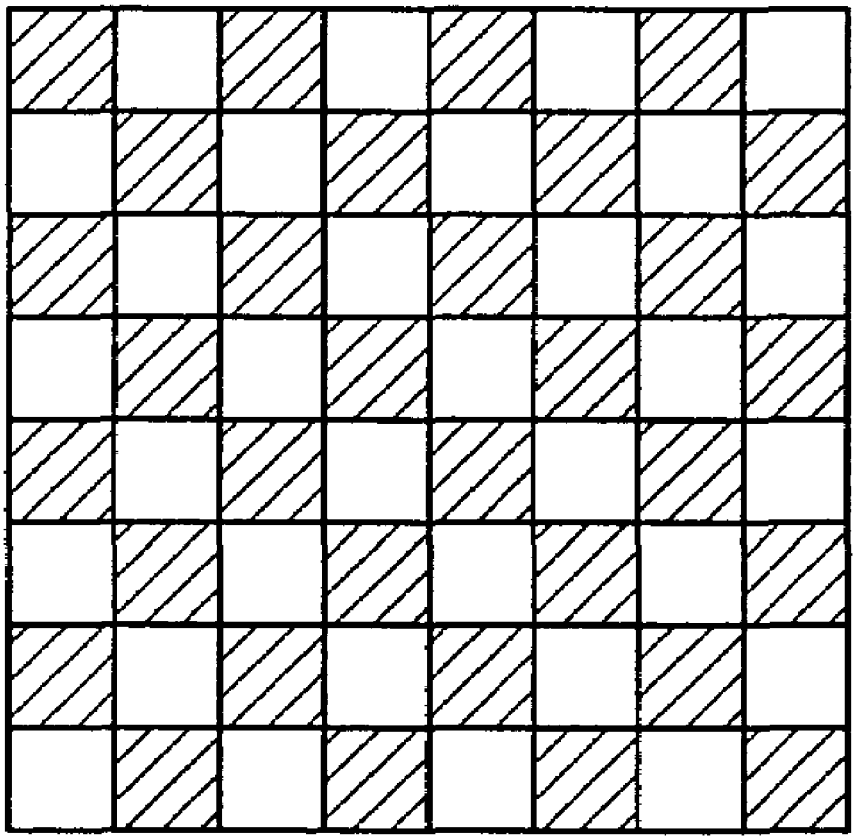
FIG. 24A is a view for explaining an example of a printing mask used to execute printing control in FIG. 23.
Figure 24B:
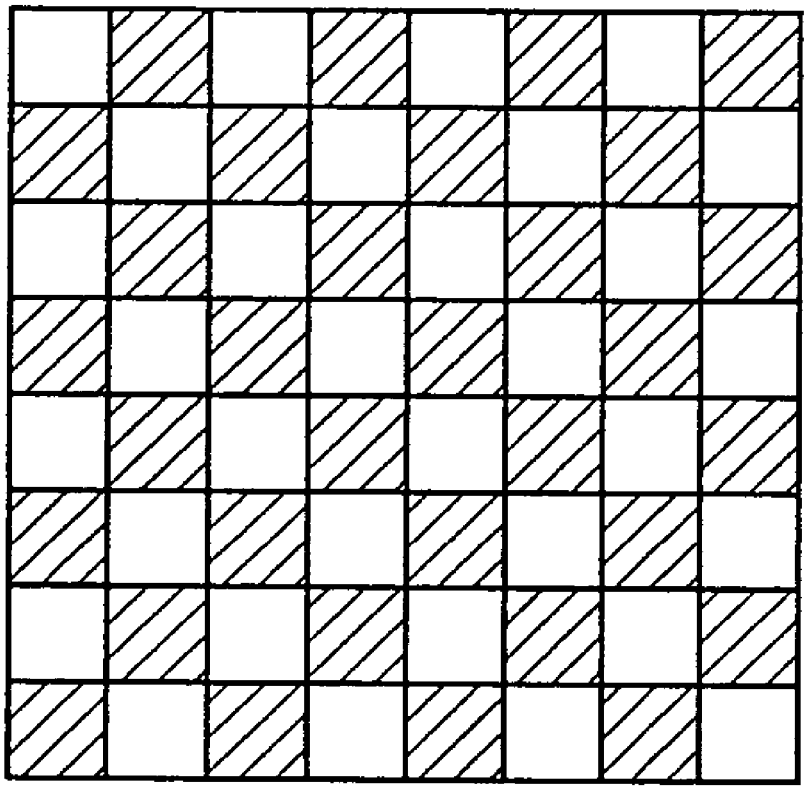
FIG. 24B is a view for explaining another example of the printing mask used to execute printing control in FIG. 23.

FIGS. 24A and 24B show 8×8 staggered and inverted staggered patterns as printing masks used. FIG. 24A shows a mask for 1-path printing, and FIG. 24B shows a mask for 2-path printing. A black portion represents a pixel to be printed, and an image is printed on a target path by an AND with image data.

FIG. 25 shows ring counters 502 and 503 used every scan. The ring counters 502 and 503 used are the same as those of the first embodiment (FIG. 10).

In FIG. 23, an image region 1 is printed on a printing medium by a region B of the printing head at a position α. At this time, the ring counter 502 is used.

The printing medium is fed by an amount corresponding to 32 nozzles, and an image region 2 is printed on the printing medium by a region A of the printing head at a position A. At this time, the ring counter 503 is used.

This operation is repeated to complete an image.

Figure 27:
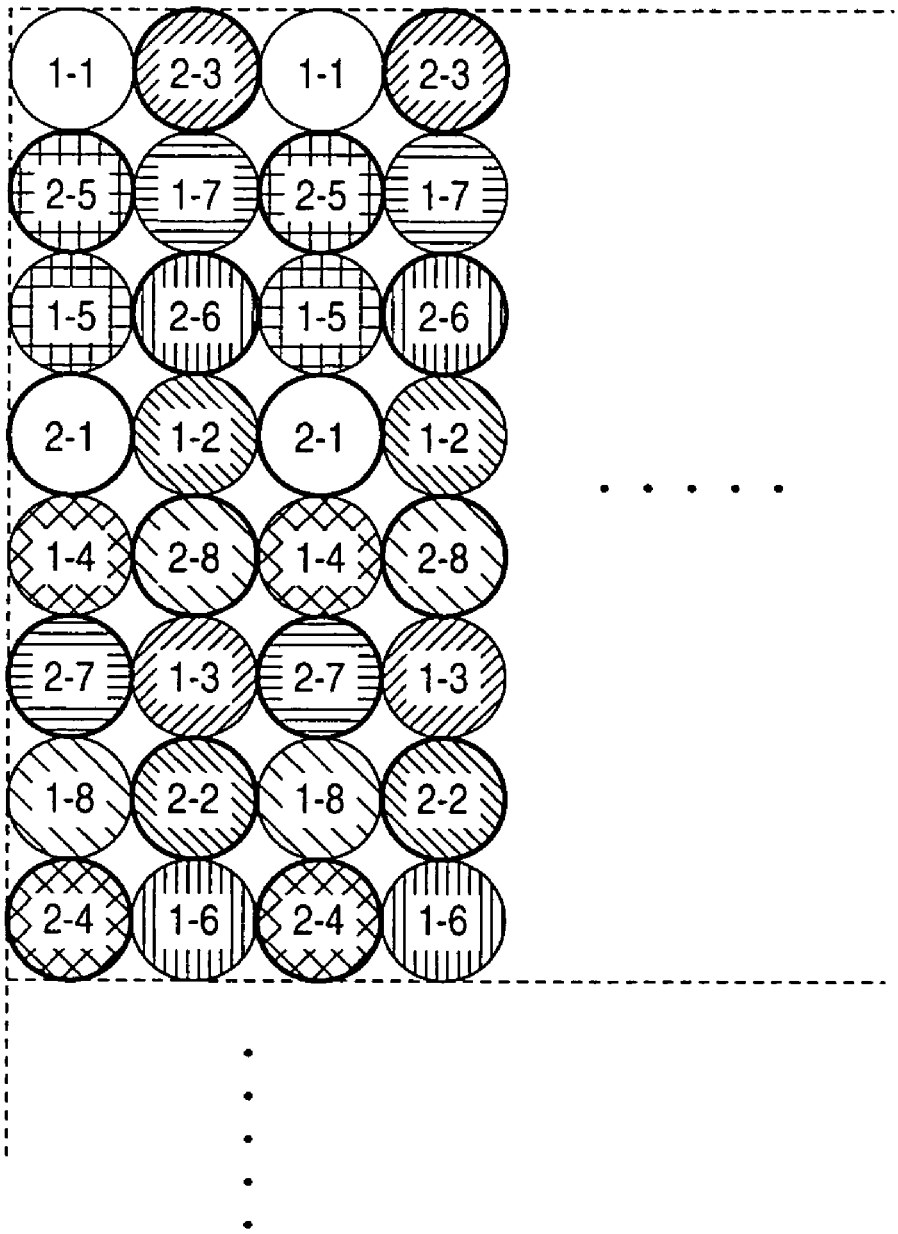
FIG. 27 is a view for explaining in detail the printing order of dots (pixels) printed in the second embodiment.

FIG. 27 shows the printing order of dots. Two variables X-Y in ○ represent X: path number and Y: position in the driving order.

A completed image exhibits high image quality while changes in density by driving are spread.

The third embodiment can be more easily practiced than the first embodiment because the switching timing of a ring counter selector 505 is decreased.

Figure 28:
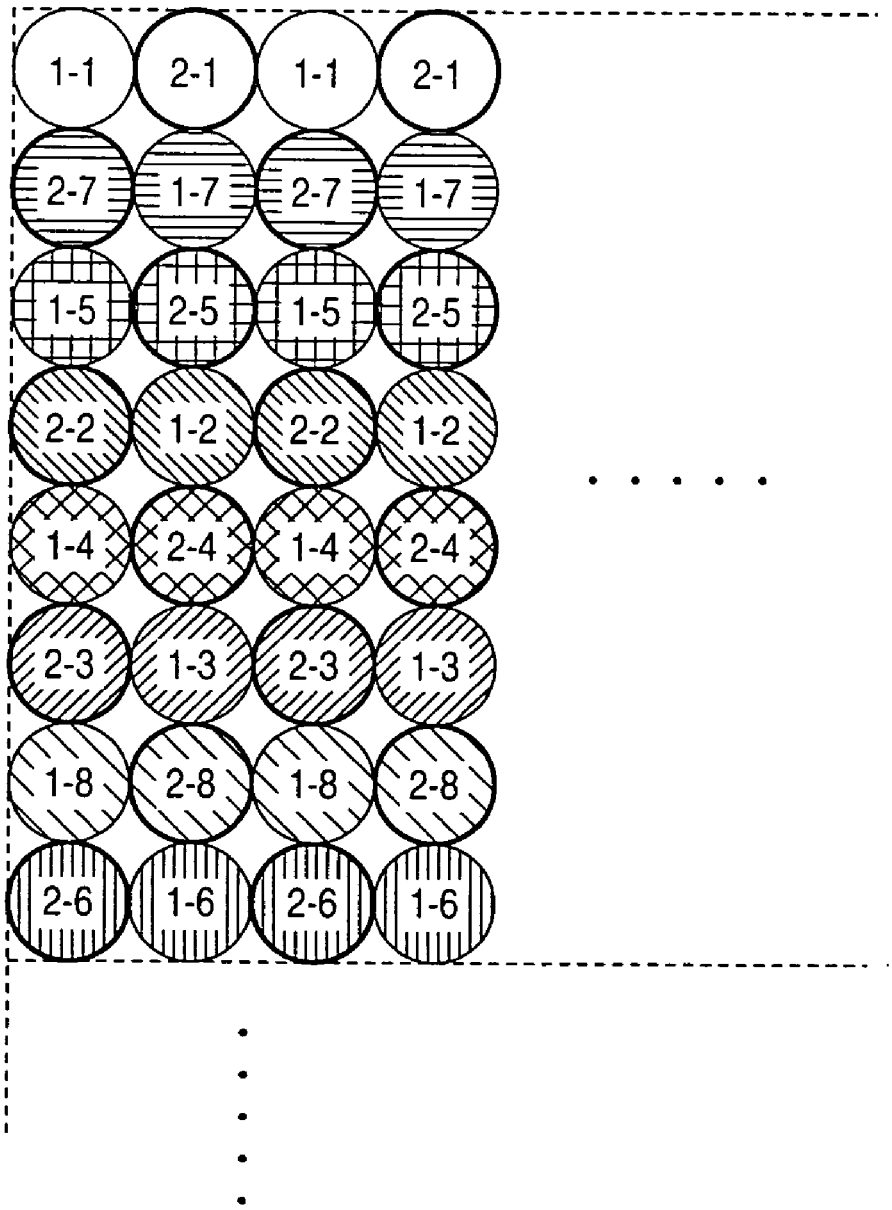
FIG. 28 is a view for explaining in detail the printing order of dots (pixels) printed in the prior art.

FIG. 28 shows an image printed by the conventional method for comparison with FIG. 27. In other words, the ring counter is fixed to the ring counter 502 in the third embodiment. FIG. 28 shows the printing order of dots. X-Y in ○ represent X: path number and Y: position in the driving order.

When an image is formed by the conventional method in FIG. 7, dots at the same position in the driving order succeed in the raster direction, compared to the third embodiment. This generates stripe-like unevenness, degrading the image quality.

Fourth Embodiment

An ink-jet printing head and an ink-jet printer in which the printing head is mounted will be described according to the fourth embodiment.

The printing head of the fourth embodiment, and the ink-jet printer of the fourth embodiment in which the ink-jet printing head is mounted can take the same arrangements as those of the printing head and ink-jet printer described in the second embodiment. A repetitive description of them will be omitted, and only a difference will be explained.

[Printing Head]

The arrangement of a printing head main body controller according to the fourth embodiment and an image to be formed are the same as those described in the second embodiment except that the counter is switched every scan. A printing operation in the fourth embodiment is the same 2-path printing as in the third embodiment.

Figure 29:
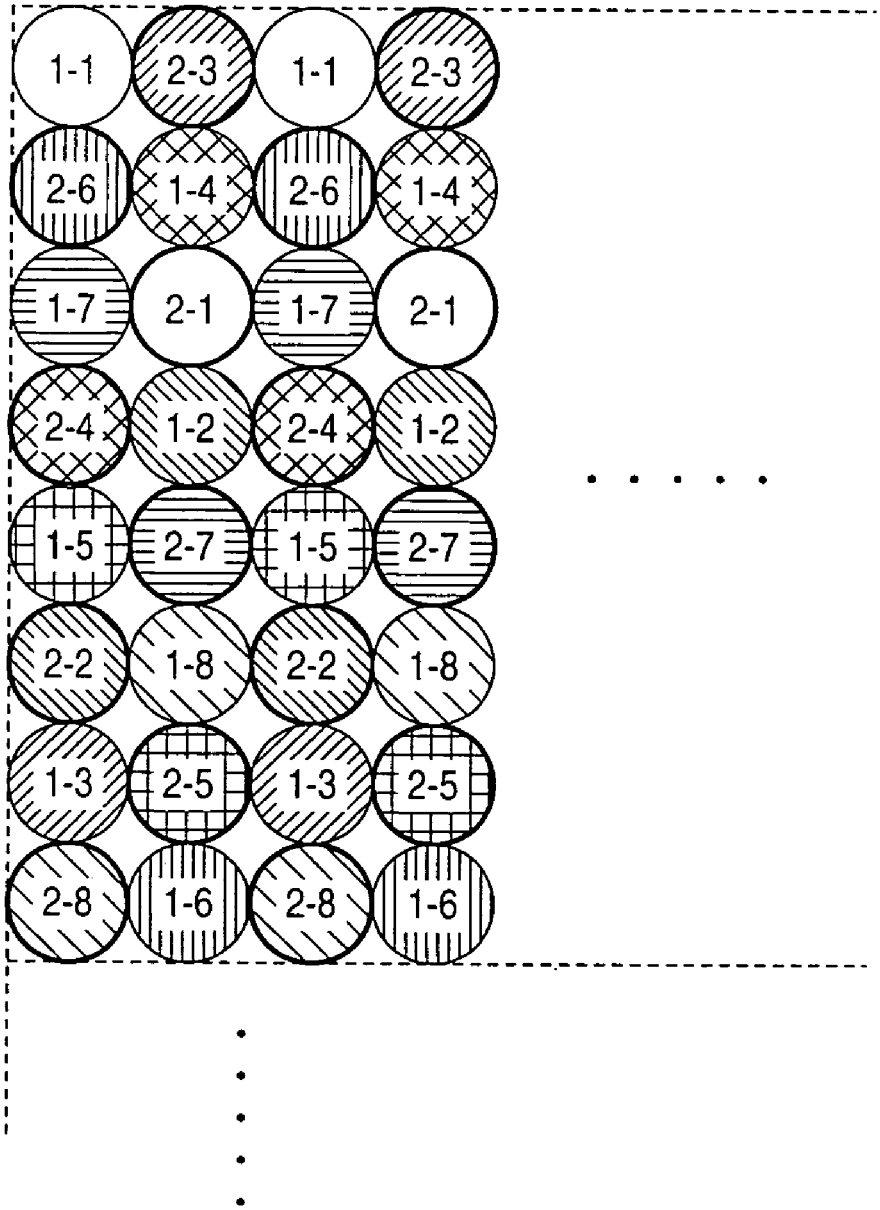
FIG. 29 is a view for explaining the printing order of dots (pixels) printed in the fourth embodiment.

FIG. 29 shows the setting of the default value for each scan. Further, FIG. 29 shows the printing order of dots. X-Y in ○ represent X: path number and Y: position in the driving order.

Similar to the third embodiment, changes in density by driving are spread, and the image quality is improved.

The third embodiment can be more easily practiced than the second embodiment because the default value setting timing is decreased.

Fifth Embodiment

An ink-jet printing head and an ink-jet printer in which the printing head is mounted will be described according to the fifth embodiment.

The ink-jet printer of the fifth embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the fifth embodiment will be explained.

The printing head of the fifth embodiment is a printing head whose arrangement is partially common to the printing head of the first embodiment. In the following description, a repetitive description of the common arrangement will be omitted, and only a difference will be explained.

The printing head of the fifth embodiment uses as an input signal a block clock signal instead of a block enable signal, in order to prevent an increase in the number of block enable signal lines along with an increase in the number of nozzles. This is the same as the first embodiment.

The printing head of the fifth embodiment is different from that of the first embodiment in a means for reducing the influence of pressure interference caused in ink discharge, i.e., a block enable output signal generation means for changing the printing order of dots (pixels) in the raster direction.

Figure 30:
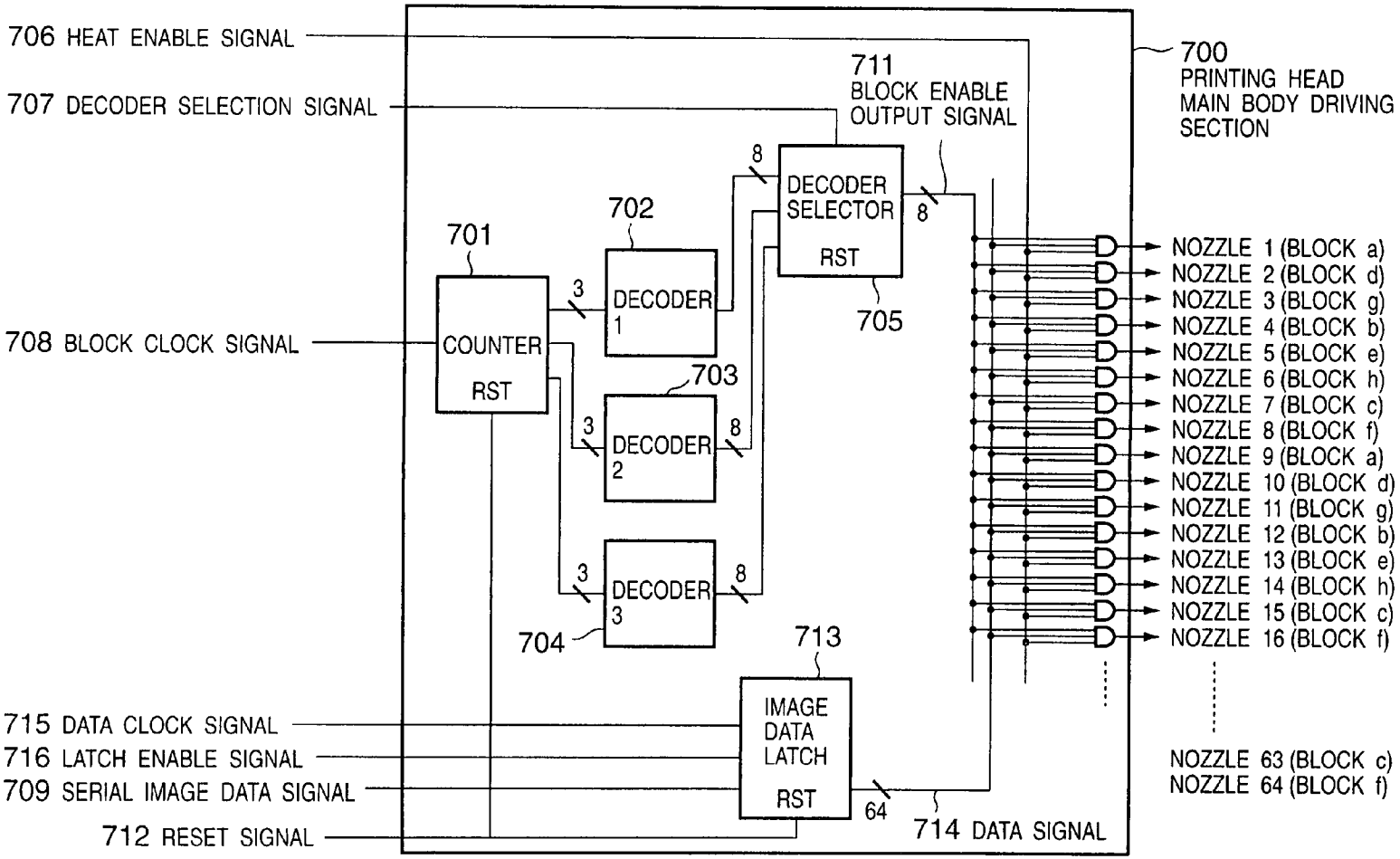
FIG. 30 is a block diagram showing the circuit arrangement of a printing head main body driving section used in the fifth embodiment.

FIG. 30 shows the arrangement of a printing head main body driving section 700 adopted in the fifth embodiment.

The printing head main body driving section 500 of the first embodiment uses the three ring counters 502, 503, and 504 and one ring counter selector 505. In place of them, the printing head main body driving section 700 of the fifth embodiment generates a block enable output signal 711 by using one counter 701, three decoders 702, 703, and 704, a decoder selection signal 707, and a decoder selector 705.

More specifically, a block clock signal (count output) is input to the three decoders 702, 703, and 704. Each of the three decoders 702, 703, and 704 converts a signal input from the counter into a block enable signal, as shown in FIG. 31. Then, the decoder outputs the block enable signal to the decoder selector 705. The decoder selector 705 also receives the decoder selection signal 707.

The decoder selector 705 supplies, as the block enable output signal 711 to nozzles, one of the signals from the three decoders that is selected based on the decoder selection signal 707.

As is apparent from a comparison between FIGS. 31 and 12, the functions of the three decoders 702, 703, and 704 are the same as those of the three ring counters 502, 503, and 504 in the first embodiment. The function of the decoder selector 705 is the same as that of the ring counter selector 505 in the first embodiment.

When the decoders are changed every column in an order of the decoder 702→703→704, the effects of increasing the image quality of an output image in the fifth embodiment are the same as those described in the first embodiment.

When the decoders are changed every scan in an order of the decoder 702→703→704, the effects of increasing the image quality are the same as those described in the third embodiment.

Sixth Embodiment

An ink-jet printing head and an ink-jet printer in which the printing head is mounted will be described according to the sixth embodiment.

The ink-jet printer of the sixth embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the sixth embodiment will be explained.

The printing head of the sixth embodiment is a printing head whose arrangement is partially common to the printing head of the second embodiment. In the following description, a repetitive description of the common arrangement will be omitted, and only a difference will be explained.

Figure 32:
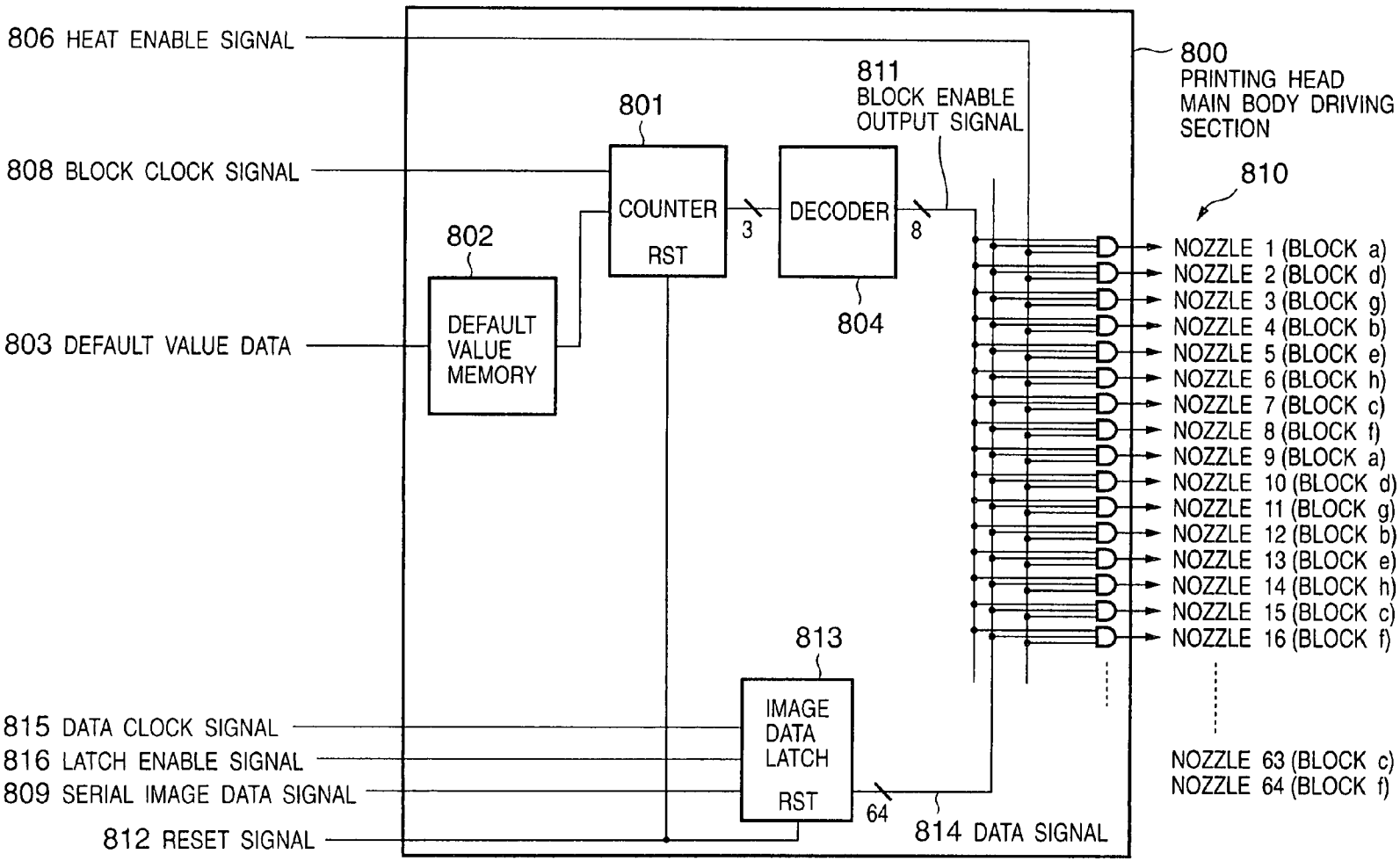
FIG. 32 is a block diagram showing the circuit arrangement of a printing head main body driving section used in the sixth embodiment.

In the sixth embodiment, the same operation as those of the second and fourth embodiments is performed using the arrangement of a printing head main body driving section 800 shown in FIG. 32.

A block clock signal 808 and default value data signal 803 are input to a counter 801. The count output of the block clock signals 808 is input to a decoder 804.

As shown in FIG. 33, the decoder 804 converts the signal input from the counter 801 into a block enable signal 811, and supplies it to nozzles 810.

When the default value changes to 0, 1, 0, . . . every column, the effects of an output image in the sixth embodiment are the same as those of the second embodiment. When the default value changes to 0, 6, 0, . . . every scan, the effects are the same as those of the fourth embodiment.

Seventh Embodiment

An ink-jet printing head and an ink-jet printer in which the printing head is mounted will be described according to the seventh embodiment.

The ink-jet printer of the seventh embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the seventh embodiment will be explained.

The printing head of the seventh embodiment is a printing head whose arrangement is partially common to the printing head of the first embodiment. In the following description, a repetitive description of the common arrangement will be omitted, and only a difference will be explained.

Figure 34:
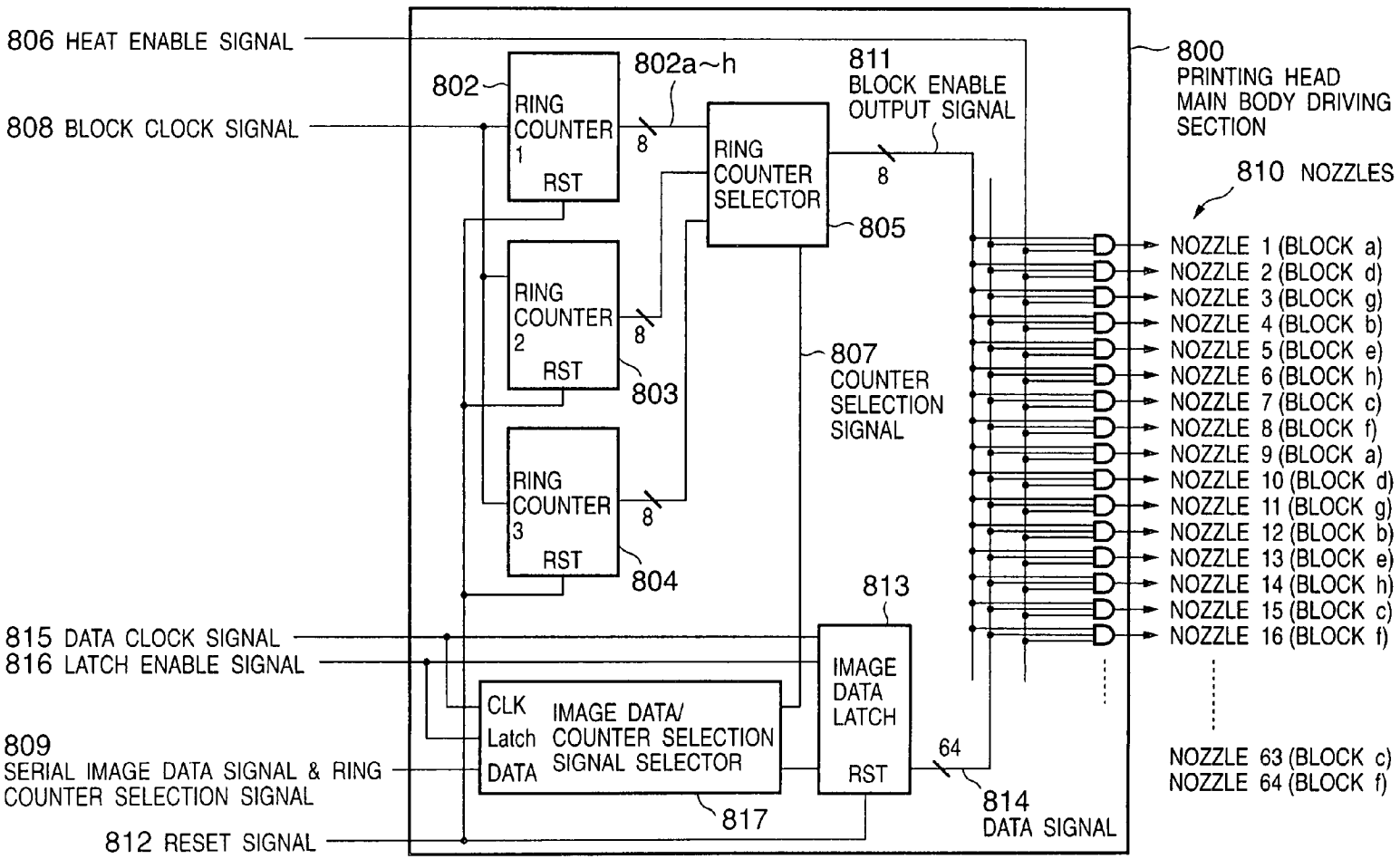
FIG. 34 is a block diagram showing the circuit arrangement of a printing head main body driving section used in the seventh embodiment.

FIG. 34 shows the arrangement of a printing head main body driving section 800 used in the seventh embodiment.

The difference between FIGS. 10 and 34 is that, in FIG. 34, instead of the counter selection signal 507 shown in FIG. 10, a counter selection signal is transmitted in serial image data 809, the image data and counter selection signal are selected by an image data/counter selection signal selector 817, and the selected counter selection signal is transmitted as a counter selection signal 807 to a counter selector 805.

Figure 35:
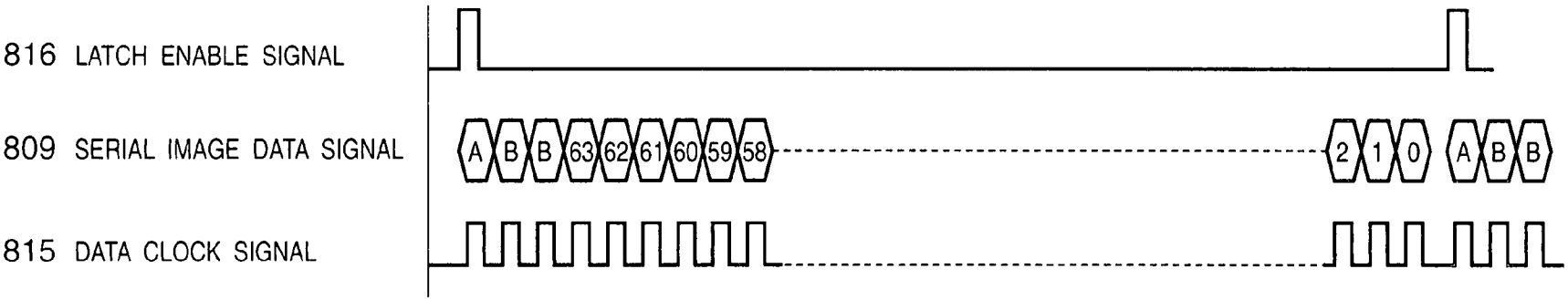
FIG. 35 is a timing chart for explaining signal generation timings used in the seventh embodiment.

FIG. 35 is a timing chart showing data transfer.

The image data/counter selection signal selector 817 uses A contained in the serial image data signal 809 shown in FIG. 35, and determines whether the serial image data 809 contains the counter selection signal 807.

If the bit is 1 and "the selection signal exists" is determined, 2 bits of B contained in the serial image data signal 809 are sent as the counter selection signal 807 to the counter selector 805. The remaining data shown in FIG. 35 serves as a serial image data signal. If the bit is 0, the serial image data signal 809 is determined to contain only image data. The serial image data 809 except for the determination bit is supplied as image data.

The effects of an image in the application of the seventh embodiment are the same as those of the first and third embodiments.

In addition, the seventh embodiment has an advantage of decreasing the number of signal lines because the counter selection signal is contained in the serial image data signal and transmitted.

In the seventh embodiment, 1 bit (determination bit)+2 bits (selection signal)+64 bits (data signal)=67 bits suffices to be transmitted at most for one column. Compared to 88 bits ((8 data bits+3 block bits)×8) in the prior art, the data amount can be greatly reduced.

Eighth Embodiment

An ink-jet printing head and an ink-jet printer in which the printing head is mounted will be described according to the eighth embodiment.

The ink-jet printer of the eighth embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the eighth embodiment will be explained.

The printing head of the eighth embodiment is a printing head whose arrangement is partially common to the printing head of the second embodiment. In the following description, a repetitive description of the common arrangement will be omitted, and only a difference will be explained.

Figure 36:
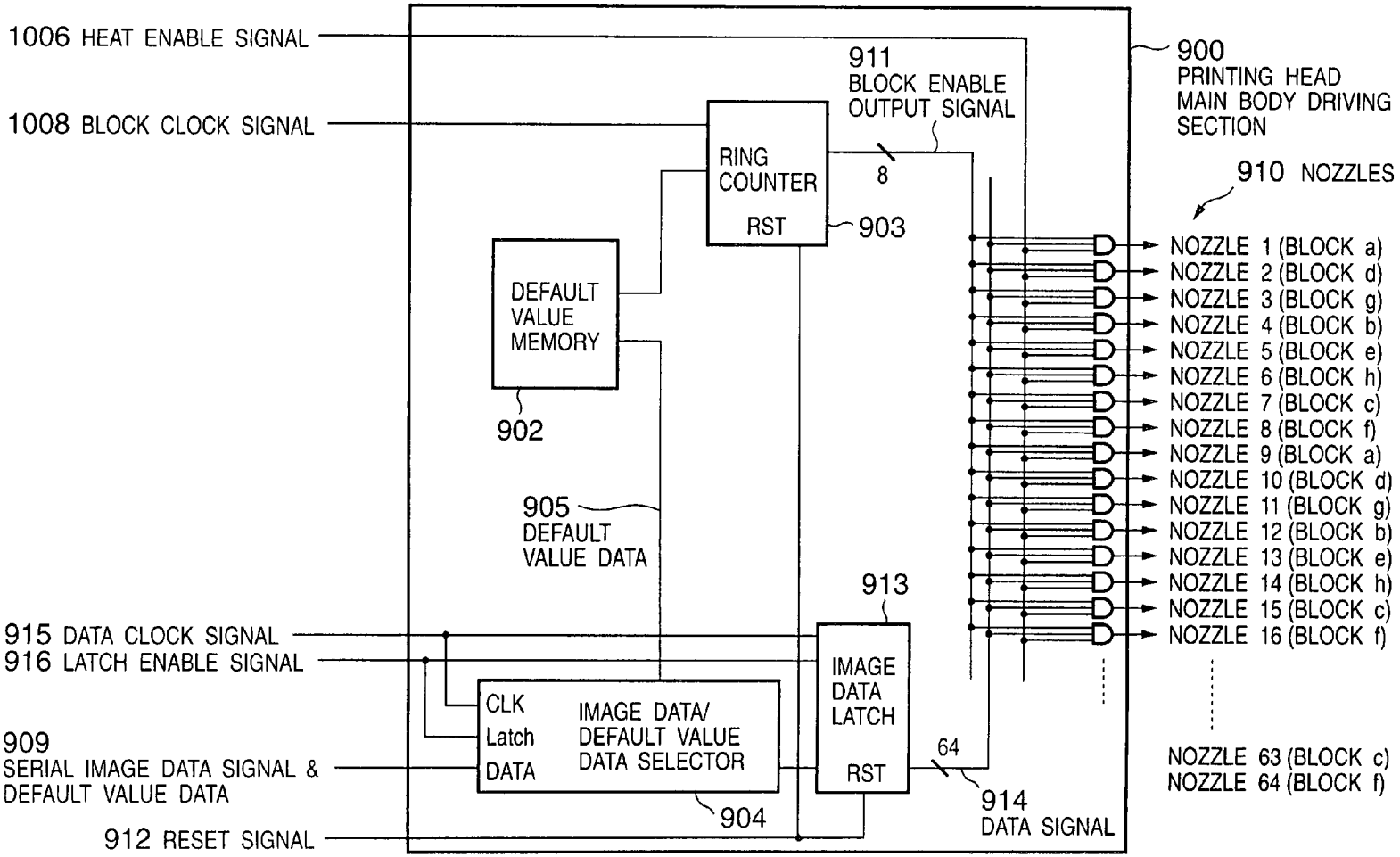
FIG. 36 is a block diagram showing the circuit arrangement of a printing head main body driving section used in the eighth embodiment.

FIG. 36 shows the arrangement of a printing head main body driving section 900 used in the eighth embodiment.

The difference between FIGS. 17 and 36 is that, in FIG. 36, instead of the default value data 603 shown in FIG. 17, default value data is transmitted in serial image data 909, the image data and default value data are selected by an image data/default value data selector 904, and default value data 905 is transmitted to a default value memory 902.

Figure 37:
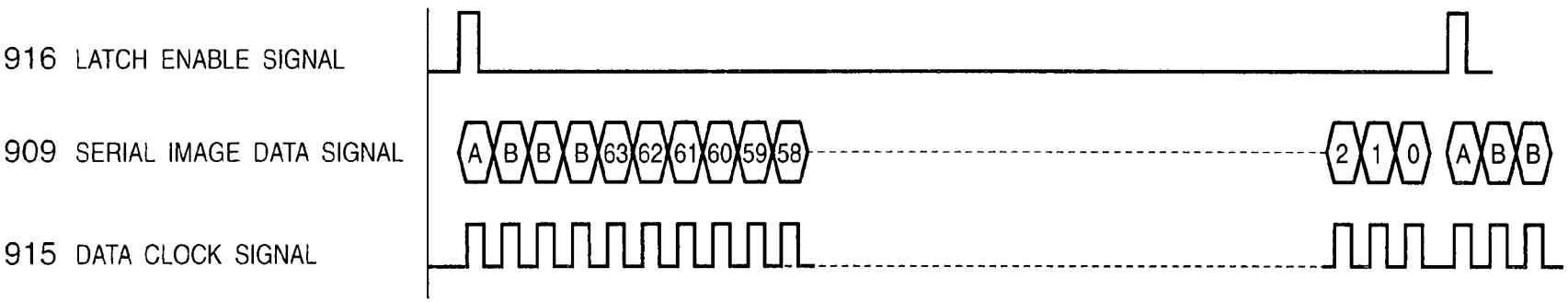
FIG. 37 is a timing chart for explaining signal generation timings used in the eighth embodiment.

FIG. 37 is a timing chart showing data transfer.

The image data/default value data selector 904 uses A contained in the serial image data signal 909, and determines whether the serial image data contains the default value data 905.

If the bit is 1 and "default value data exists" is determined, 3 bits of B contained in the serial image data signal 909 are sent as the default value data 905 to the default value memory 902. The remaining data serves as a serial data signal. If the bit is 0, the serial image data signal 909 is determined to contain only image data. The serial image data signal 909 except for the determination bit is supplied as image data.

The effects of an image in the application of the eighth embodiment are the same as those of the second and fourth embodiments.

Moreover, the eighth embodiment has an advantage of decreasing the number of signal lines because default value data is also transferred as image data.

In the eighth embodiment, 1 bit (determination bit)+3 bits (default value data)+64 bits (data signal)=68 bits suffices to be transmitted at most for one column. Compared to 88 bits ((8 data bits+3 block bits)×8) in the prior art, the data amount can be greatly reduced.

Ninth Embodiment

An ink-jet printing head and an ink-jet printer in which the printing head is mounted will be described according to the ninth embodiment.

The ink-jet printer of the ninth embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the ninth embodiment will be explained.

The printing head of the ninth embodiment is a printing head whose arrangement is partially common to the printing head of the fifth embodiment. In the following description, a repetitive description of the common arrangement will be omitted, and only a difference will be explained.

Figure 38:
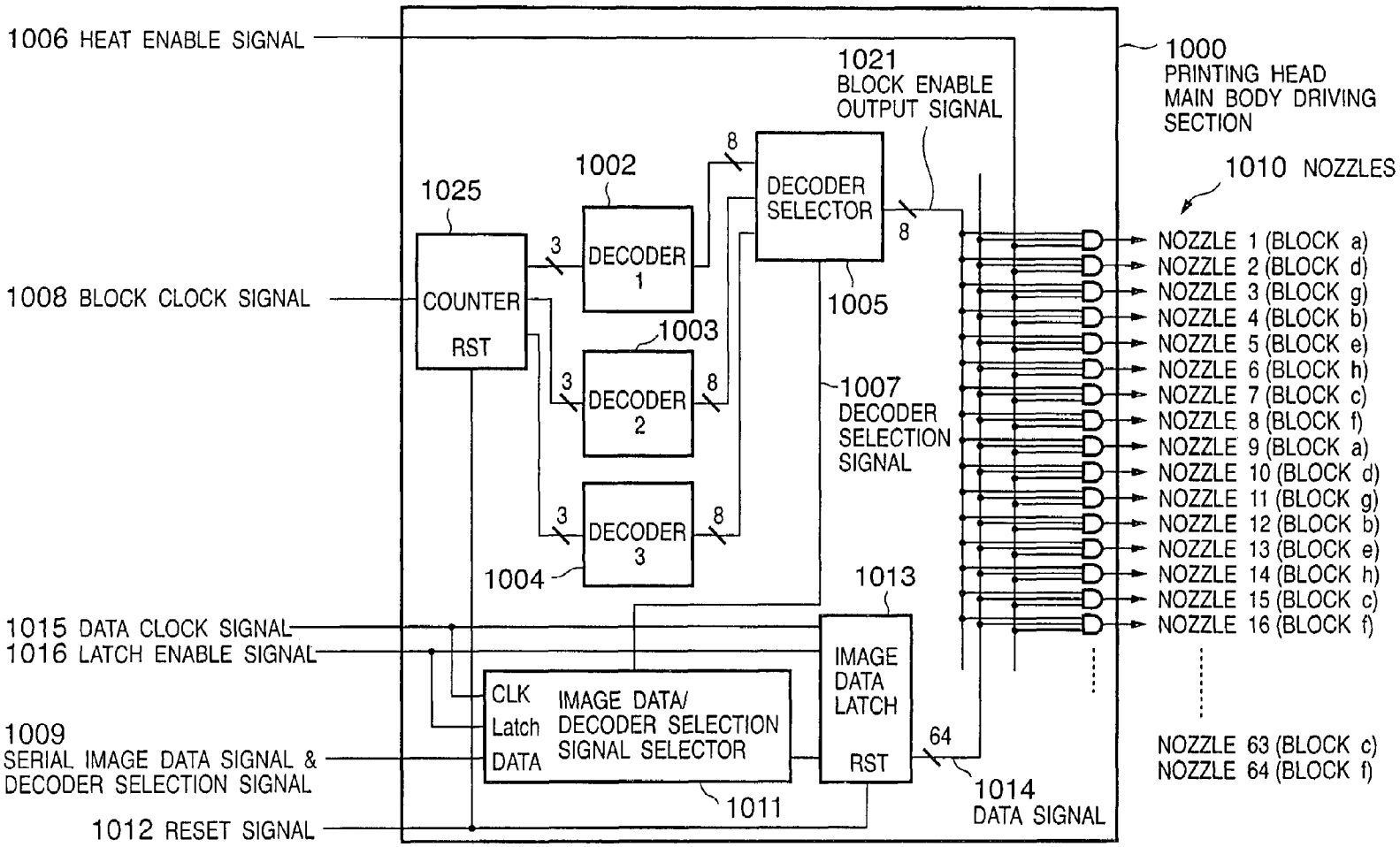
FIG. 38 is a block diagram showing the circuit arrangement of a printing head main body driving section used in the ninth embodiment.

FIG. 38 shows the arrangement of a printing head main body driving section 1000 used in the ninth embodiment.

The difference between FIGS. 30 and 38 is that, in FIG. 38, instead of the decoder selection signal 707 shown in FIG. 30, a decoder selection signal 1007 is transmitted in a serial image data signal 1009, the image data and decoder selection signal 1007 are selected by an image data/decoder selection signal selector 1011, and the decoder selection signal 1007 is transmitted to a decoder selector 1005.

Figure 39:
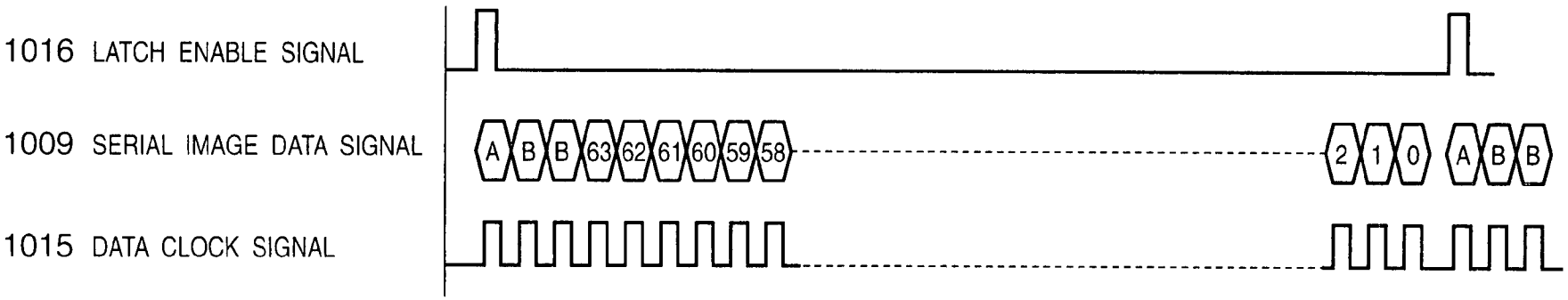
FIG. 39 is a timing chart for explaining signal generation timings used in the ninth embodiment.

FIG. 39 is a timing chart showing data transfer.

The image data/decoder selection signal selector 1011 uses A contained in the serial image data signal 1009, and determines whether the serial image data signal 1009 contains the decoder selection signal 1007.

If the bit is 1 and "the selection signal exists" is determined, 2 bits of B contained in the serial image data signal 1009 are sent as the decoder selection signal 1007 to the counter selector 1005.

The remaining data serves as a serial image data signal. If the bit is 0, the serial image data signal 1009 is determined to contain only image data. The serial image data signal 1009 except for the determination bit is supplied as serial image data.

The effects of an image in the application of the ninth embodiment are the same as those of the fifth embodiment.

The ninth embodiment further has an advantage of decreasing the number of signal lines because the decoder selection signal is contained in the serial image data signal and transmitted. In the ninth embodiment, 1 bit (determination bit)+2 bits (selection signal)+64 bits (data signal)=67 bits suffices to be transmitted at most for one column. Compared to 88 bits ((8 data bits+3 block bits)×8) in the prior art, the data amount can be greatly reduced.

10th Embodiment

An ink-jet printing head and an ink-jet printer in which the printing head is mounted will be described according to the 10th embodiment.

The ink-jet printer of the 10th embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the 10th embodiment will be explained.

The printing head of the 10th embodiment is a printing head whose arrangement is partially common to the printing head of the second embodiment. In the following description, a repetitive description of the common arrangement will be omitted, and only a difference will be explained.

Figure 40:
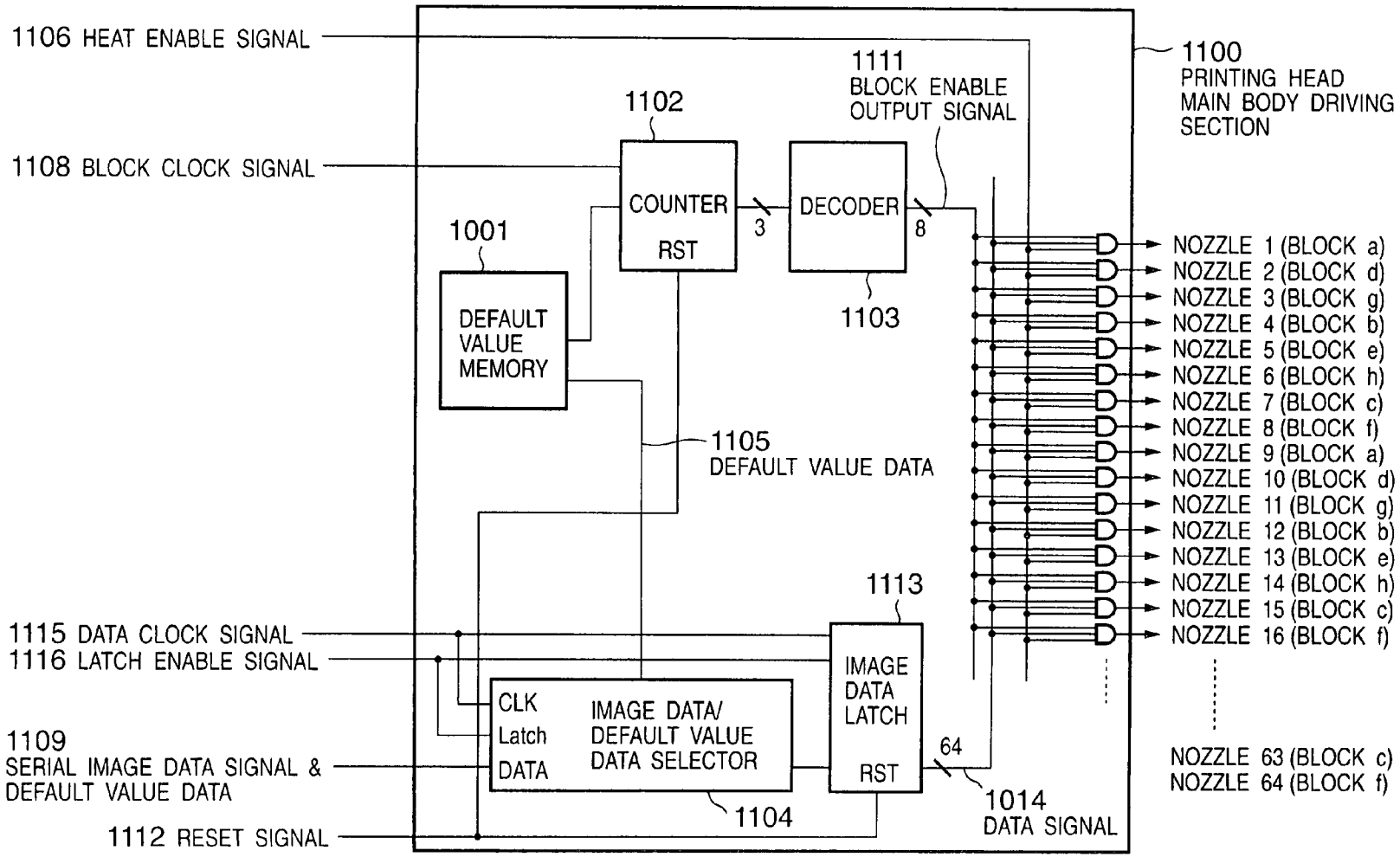
FIG. 40 is a block diagram showing the circuit arrangement of a printing head main body driving section used in the 10th embodiment.

FIG. 40 shows the arrangement of a printing head main body driving section 1100 used in the 10th embodiment.

The difference between FIGS. 17 and 40 is that, in FIG. 40, instead of the default value data shown in FIG. 17, default value data is transmitted in a serial image data signal 1109, the image data and default value data 1105 are selected by an image data/default value data selector 1104, and the default value data 1105 is transmitted to a default value memory 1001.

Figure 41:
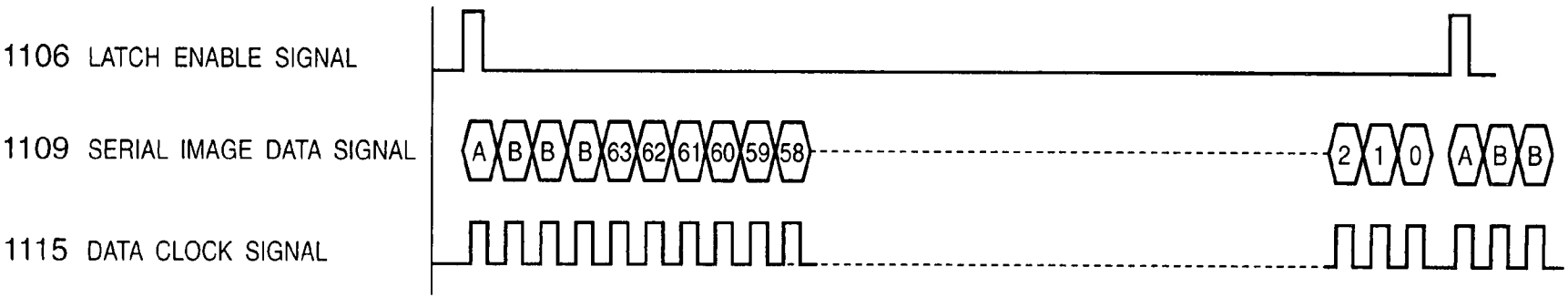
FIG. 41 is a timing chart for explaining signal generation timings used in the 10th embodiment.

FIG. 41 is a timing chart showing data transfer.

The image data/default value data selector 1104 uses A contained in the serial image data signal 1109, and determines whether the serial image data contains the default value data 1105.

If the bit is 1 and "default value data exists" is determined, 3 bits of B contained in the serial image data signal 1109 are sent as the default value data 1105 to the default value memory 1001. The remaining data serves as a serial data signal. If the bit is 0, the serial image data signal 1109 is determined to contain only image data. The serial image data signal 1109 except for the determination bit is supplied as image data.

The effects of an image in the application of the 10th embodiment are the same as those of the sixth embodiment.

The 10th embodiment has an advantage of decreasing the number of signal lines because default value data is contained in the serial image data and transferred.

In the 10th embodiment, 1 bit (determination bit)+3 bits (default value data)+64 bits (data signal)=68 bits suffices to be transmitted at most for one column. Compared to 88 bits ((8 data bits+3 block bits)×8) in the prior art, the data amount can be greatly reduced.

11th Embodiment

An ink-jet printing head and an ink-jet printer in which the printing head is mounted will be described according to the 11th embodiment.

The ink-jet printer of the 11th embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the 11th embodiment will be explained.

The printing head of the 11th embodiment is a printing head whose arrangement is partially common to the printing head of the seventh embodiment. In the following description, a repetitive description of the common arrangement will be omitted, and only a difference will be explained.

Figure 42:
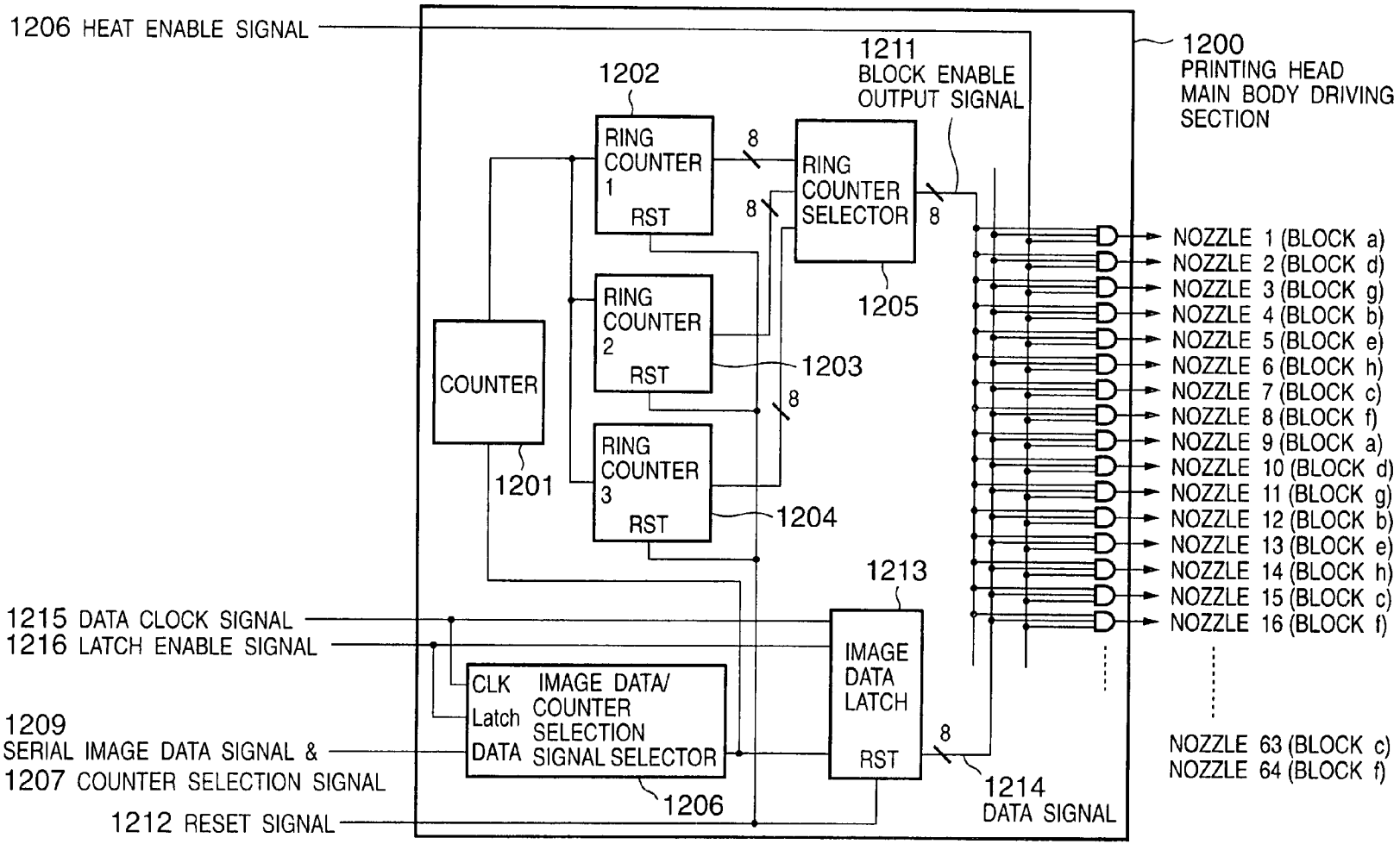
FIG. 42 is a block diagram showing the circuit arrangement of a printing head main body driving section used in the 11th embodiment.

FIG. 42 is a block diagram showing the circuit arrangement of a printing head section adopted in the 11th embodiment. FIG. 42 shows an improvement of FIG. 34.

In FIG. 34, an image data latch 813 is executed for all the 64 nozzles. In the 11th embodiment shown in FIG. 42, an image data latch 1213 is executed every 8 bits of nozzles to be driven within the same block. Further, a counter 1201 is employed to eliminate a block clock signal in FIG. 34.

Figure 43:
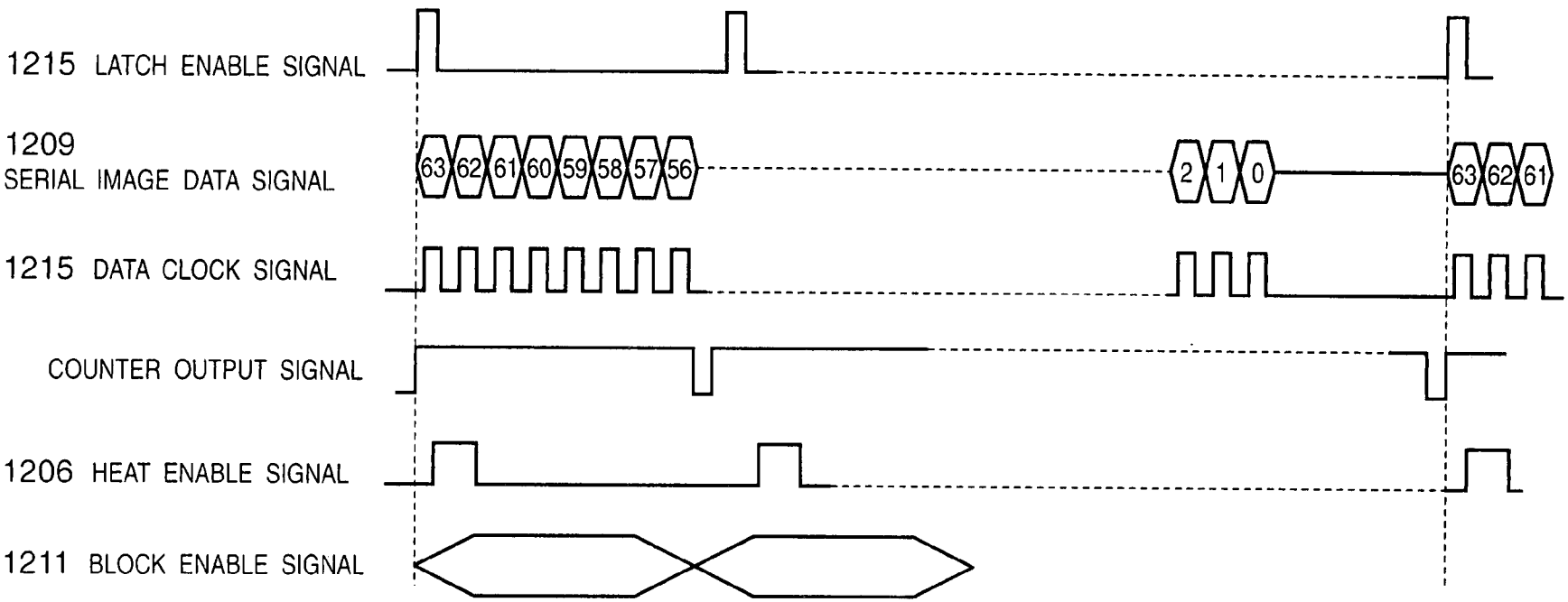
FIG. 43 is a timing chart for explaining signal generation timings used in the 11th embodiment.

FIG. 43 shows signal waveforms in the above arrangement.

The counter 1201 outputs one clock signal for a count "8" of serial image data signals 1209.

Along with this, ring counters 1202, 1203, and 1204 operate, and the block enable signal shifts to the next block. The serial image data signal 1209 is data of the next block enable signal. Nozzles corresponding to "block enable" and "heat enable" after eight serial data are latched are heated.

With this arrangement, the counter output can be utilized as a block clock. Compared to the seventh to 10th embodiments, the number of data lines can be further decreased.

12th Embodiment

An ink-jet printing head and an ink-jet printer in which the printing head is mounted will be described according to the 12th embodiment.

The ink-jet printer of the 12th embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the 12th embodiment will be explained is The printing head of the 12th embodiment is a printing head whose arrangement is partially common to the printing head of the 11th embodiment. In the following description, a repetitive description of the common arrangement will be omitted, and only a difference will be explained.

Figure 44:
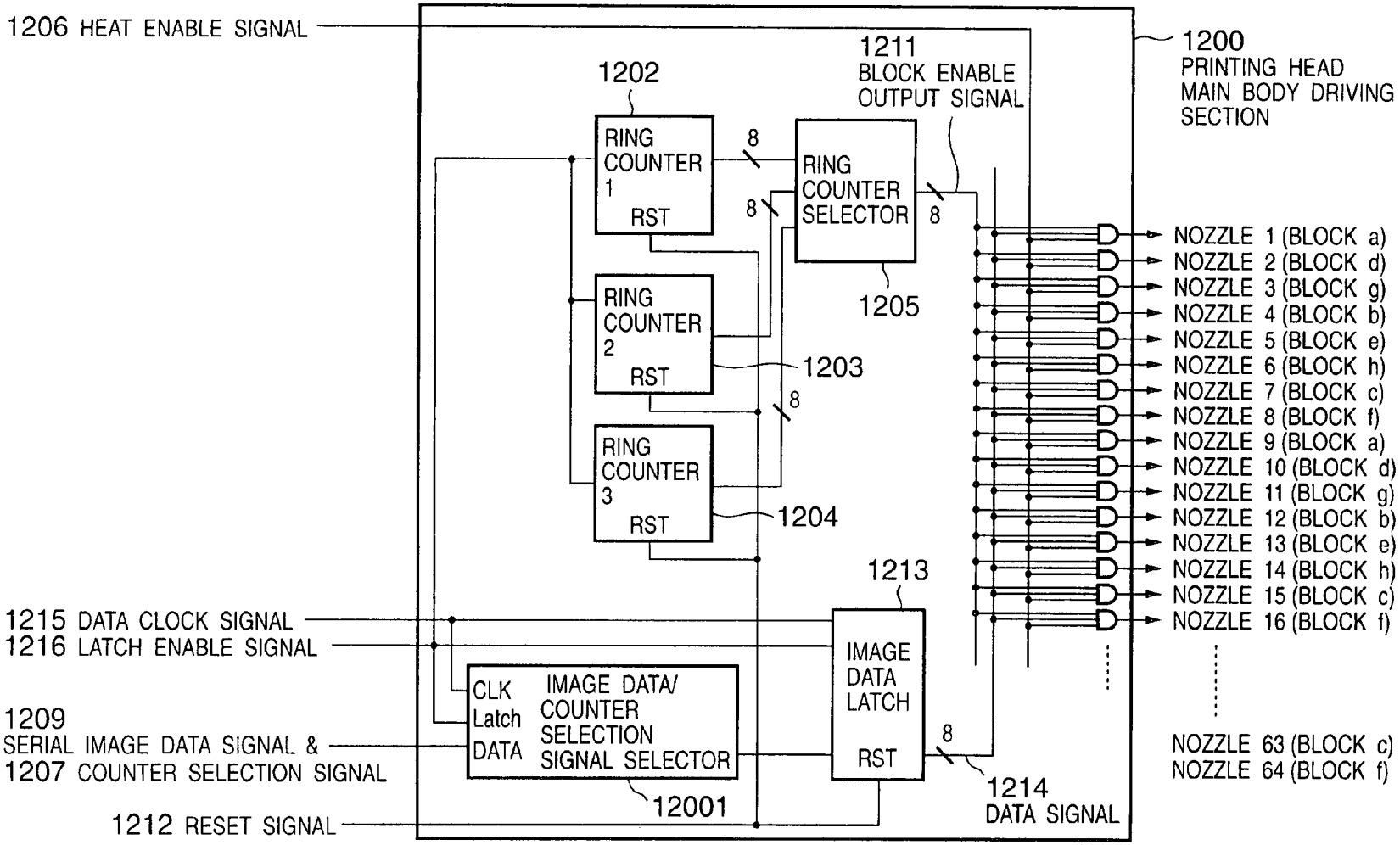
FIG. 44 is a block diagram showing the circuit arrangement of a printing head main body driving section used in the 12th embodiment.

FIG. 44 is a block diagram showing the circuit arrangement of a printing head section adopted in the 12th embodiment.

In the 12th embodiment, a latch enable signal 1216 is used in place of an output from the counter 1201 in the 11th embodiment.

Figure 45:
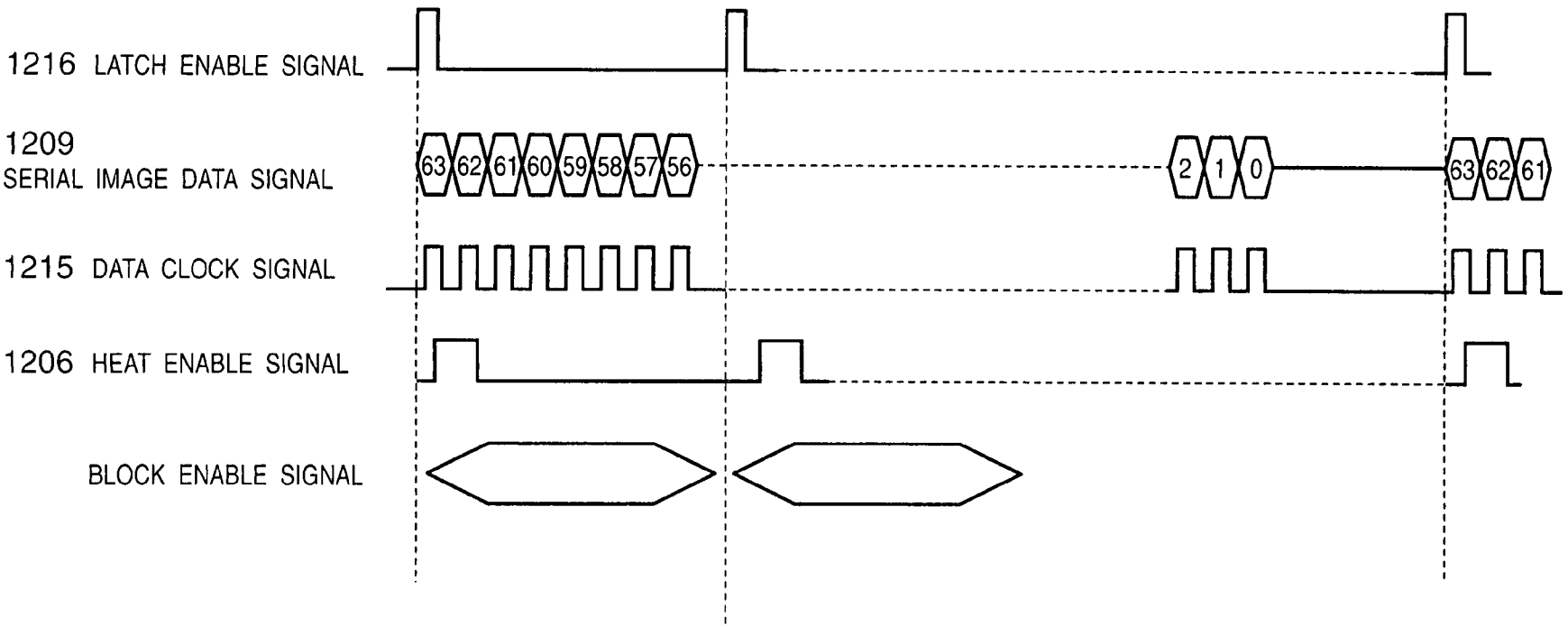
FIG. 45 is a timing chart for explaining signal generation timings used in the 12th embodiment.

FIG. 45 shows signal waveforms in the above arrangement.

The latch enable signal is output after eight serial image data signals are output. Then, ring counters 1202, 1203, and 1204 operate, and the block enable signal shifts to the next block.

The serial image data is data of the next block enable signal. Nozzles corresponding to a block enable signal and heat enable signal after eight serial data signals are latched are heated. With this arrangement, the latch enable signal can be utilized as a block clock signal. Compared to the seventh to 10th embodiments, the number of data lines can be further decreased.

13th Embodiment

An ink-jet printing head and an ink-jet printer in which the printing head is mounted will be described according to the 13th embodiment.

The ink-jet printer of the 13th embodiment in which the ink-jet printing head is mounted can take the same arrangement as that of the ink-jet printer described in the first embodiment. A repetitive description of the ink-jet printer and its control method will be omitted.

[Printing Head]

The printing head and its control method according to the 13th embodiment will be explained. Note that the printing head of the 13th embodiment is the printing head shown in FIG. 46.

Figure 48:
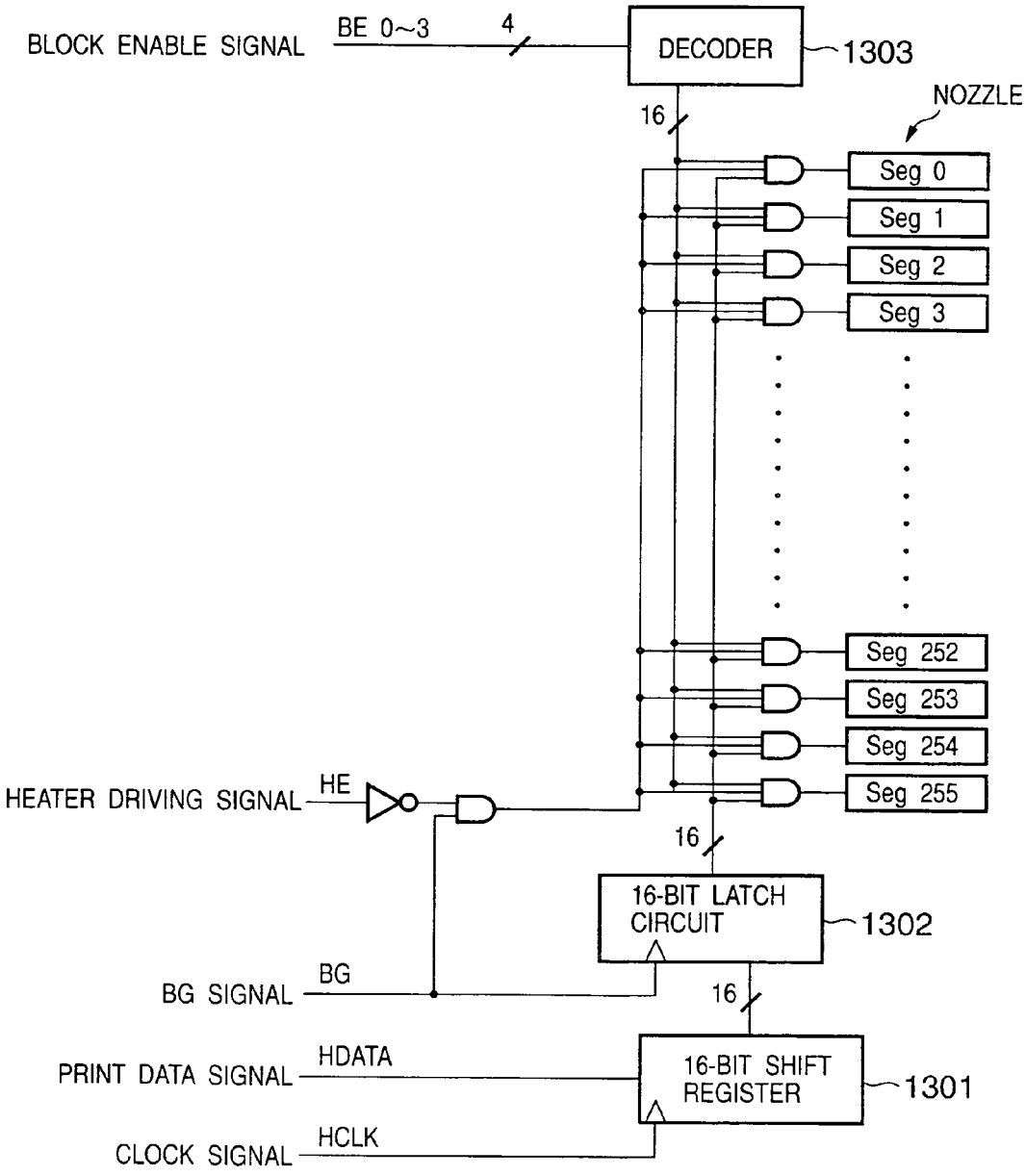
FIG. 48 is a block diagram showing the schematic arrangement of the driving circuit of the printing head used in the 13th embodiment.
Figure 49:
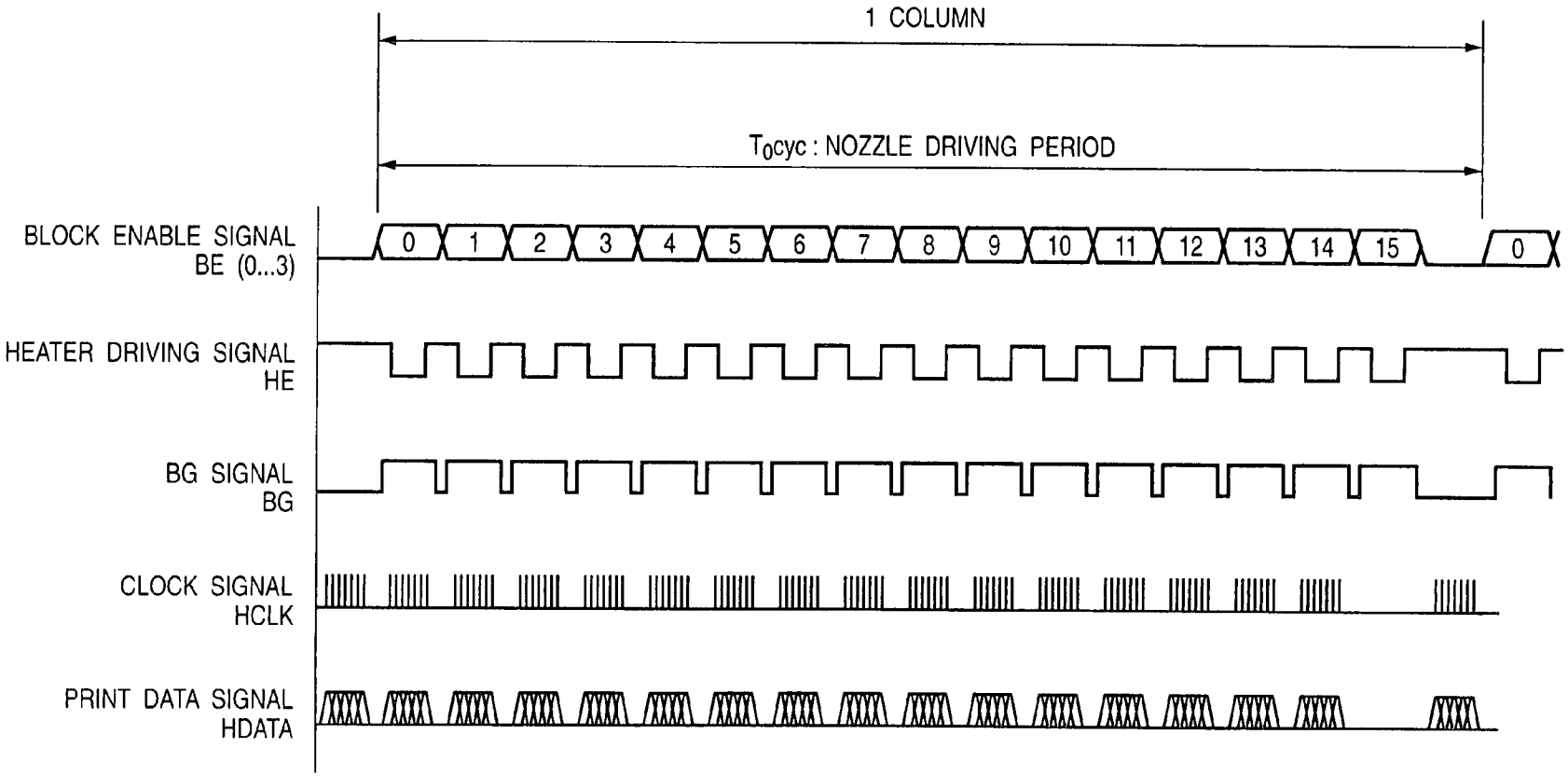
FIG. 49 is a timing chart for explaining the driving timing of the printing head as a comparative example of the 13th embodiment.

FIG. 48 is a block diagram showing a driving circuit for driving a printing head 1310. This driving circuit can be formed on a substrate 1311 of a head driver 1705 or the printing head 1310. FIG. 49 is a timing chart for explaining the conventional driving timing of the printing head 1310 by the driving circuit of FIG. 48.

In the driving circuit of FIG. 48, a total of 256 heaters 1318 at 256 nozzles of the printing head 1310 are grouped into 16 blocks every 16 heaters, and driven. The 16 heaters 1318 are driven every block. Print data signals HDATA are serially transferred to the printing head 1310 in synchronism with clock signals HCLK. The print data signals HDATA are received by a 16-bit shift register 1301, and latched by a latch circuit 1302 in response to the rise of a background signal BG. A block to be driven is designated by four block enable signals BE (BE0 to BE3). The designation signals are decoded by a decoder 1303 to select the segments of the designated block to be driven. The segments (Seg0 to Seg255) correspond to the respective heaters 1318 at the 256 nozzles. Note that driving transistors 1319 for the respective heaters 1318 are not illustrated in FIG. 48. Only segments designated by both the block enable signals BE and print data signals HDATA are driven by a driving signal HE. Ink droplets are discharged from nozzles corresponding to the designated segments (segments designated by BE, HDATA, and HE).

[Conventional Problem: Constant Nozzle Driving Period]

In the driving method of FIG. 49 as a comparative example of the printing head of the 13th embodiment, the block designation signal BE sequentially designates the 16 blocks from block 0 to block 15, and similarly for the next column, sequentially designates the 16 blocks from block 0 to block 15. For this reason, a nozzle driving period T0cyc is constant for the nozzles of all the blocks, as shown in FIG. 49. However, the constant driving period T0cyc for all the nozzles induces periodical vibrations in ink within the printing head 1310. The vibrations influence discharge from other nozzles via a common liquid chamber 1316.

[Method of Changing Nozzle Driving Period]

The printing head of the 13th embodiment changes the driving period of a specific nozzle at an arbitrary timing to minimize the influence of vibrations on the printing image quality without giving any periodicity to ink vibrations.

Figure 50:
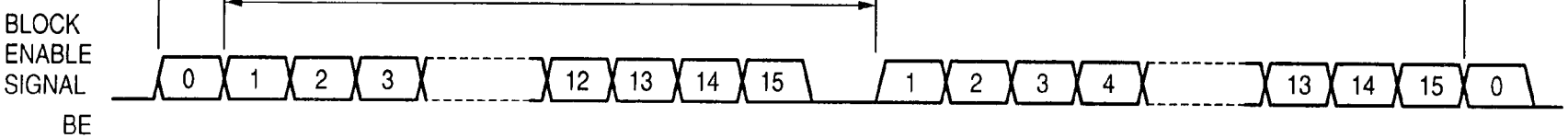
FIG. 50 is a timing chart for explaining an example of the driving timing of the printing head used in the 13th embodiment.

FIG. 50 is a timing chart for explaining a driving timing of the printing head 1310 by the driving circuit of FIG. 48, as the printing head of the 13th embodiment.

In this example, the block designation signal BE sequentially designates and drives the 16 blocks from block 0 to block 15. For the next column, the block designation signal BE sequentially designates and drives the blocks from block 1 to block 15. Then, the block designation signal BE designates and drives block 0.

As a result, as shown in FIG. 50, the driving period changes to T'0cyc for the nozzles of block 0, and T'1cyc for the nozzles of blocks 1 to 15. The nozzle driving interval changes depending on the block. This can spread ink vibrations.

Examples of a driving order change circuit for changing the block driving order described above will be explained.

[Example 1 of Driving Order Change Circuit]

Figure 51:
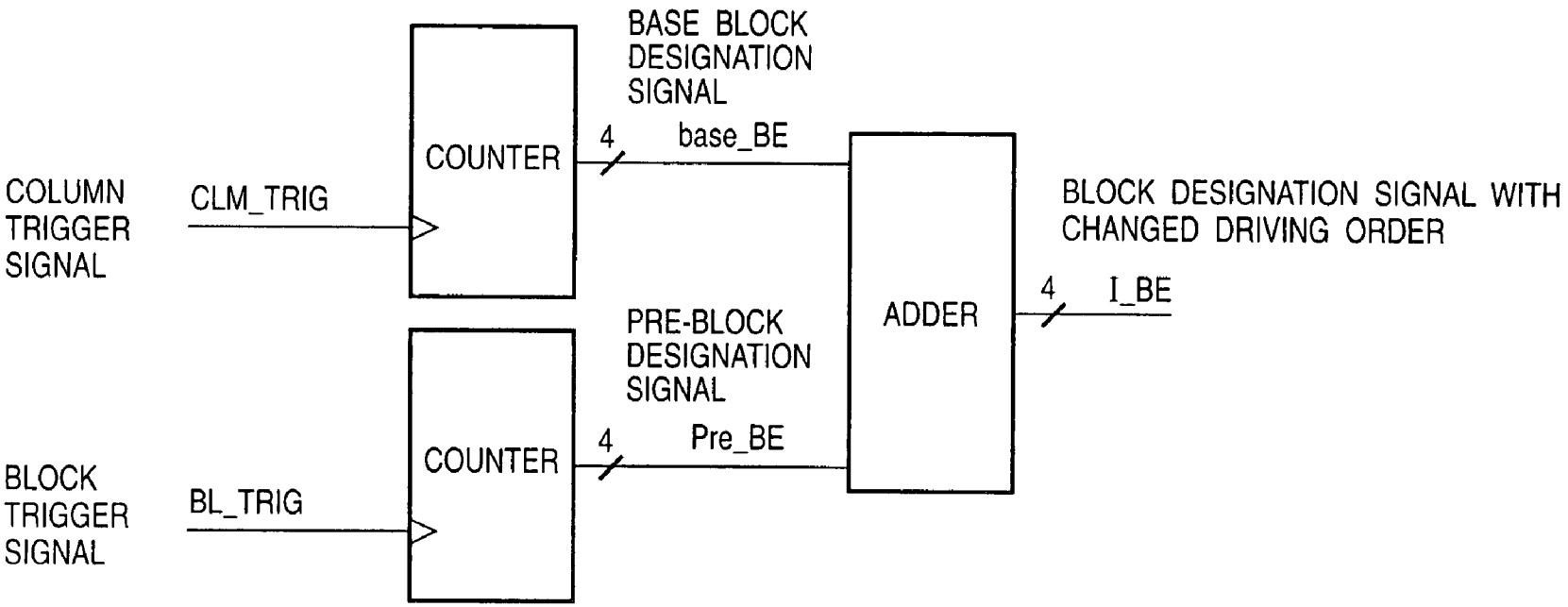
FIG. 51 is a block diagram showing a circuit for changing the block driving order by using an adder.
Figure 52:
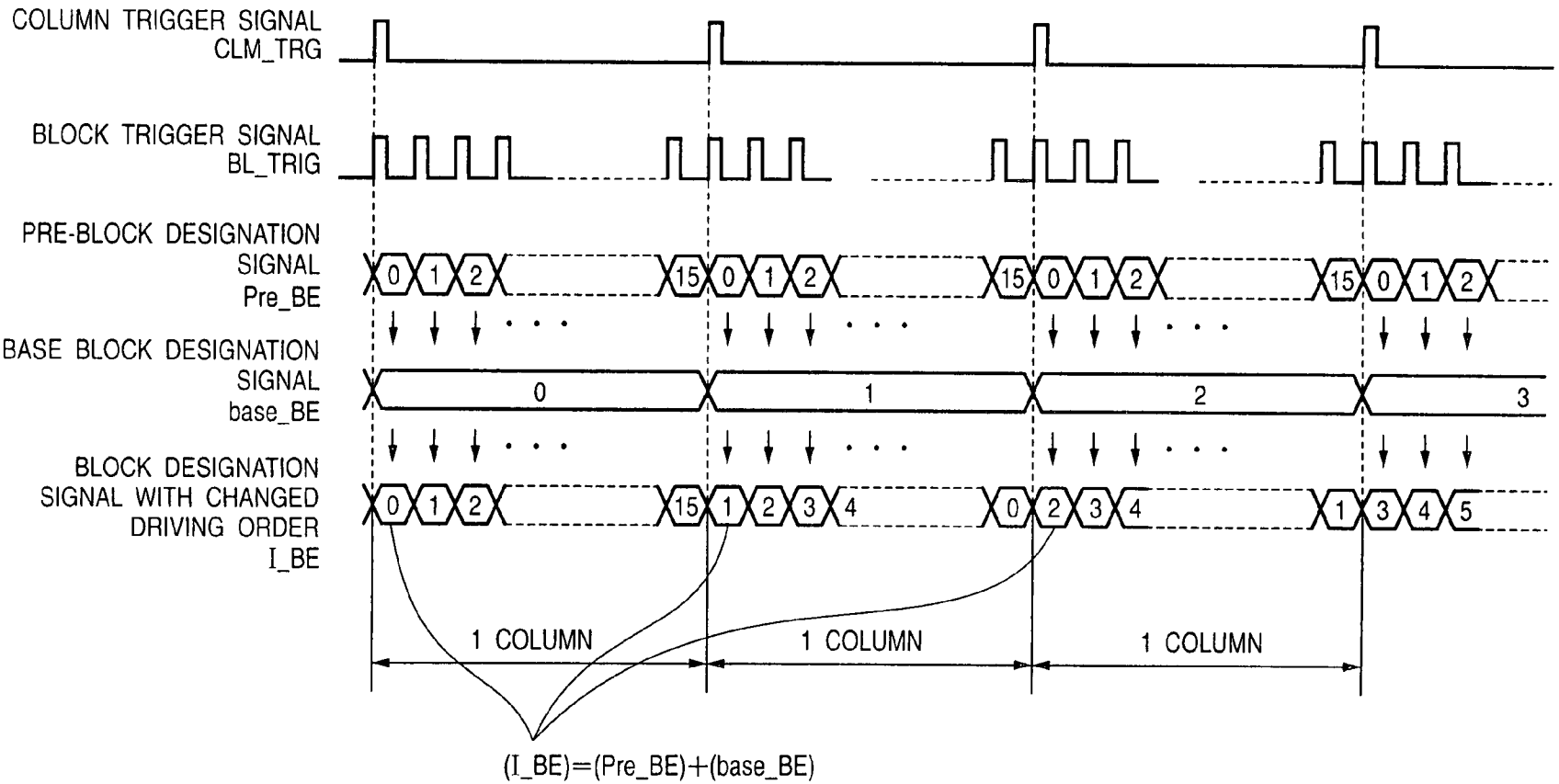
FIG. 52 is a timing chart for explaining an example of changing the block driving order by using the circuit in FIG. 51.

FIG. 51 is a block diagram of the driving order change circuit for explaining a method of changing the block driving order. FIG. 52 is a timing chart for explaining the driving timing of the driving order change circuit.

In FIGS. 51 and 52, a column trigger signal CLM_TRIG is a trigger signal output for each column, and a block trigger signal BL_TRIG is a trigger signal output in switching a block. Since 16 blocks must be driven for one column, as described above, 16 block trigger signals BL_TRIG are output at the trigger interval of the column trigger signal CLM_TRIG, as shown in FIG. 52. By counting up the block trigger signals BL_TRIG, pre-block designation signals pre_BE identical to the conventional block designation signal BE can be generated, as shown in FIG. 52. Base block designation signals base_BE generated by counting up the column trigger signals CLM_TRIG change to 1, 2, 3, . . . every column, as shown in FIG. 52. By adding the pre-block designation signal pre BE and base block designation signal base_BE, a block designation signal I_BE representing a changed driving order can be obtained. With the use of this driving order change circuit, the block designation signal I_BE representing the changed driving order can be output as the BE signal in FIG. 50, i.e., block signal shifted by one block every column.

[Example 2 of Driving Order Change Circuit]

Figure 53:
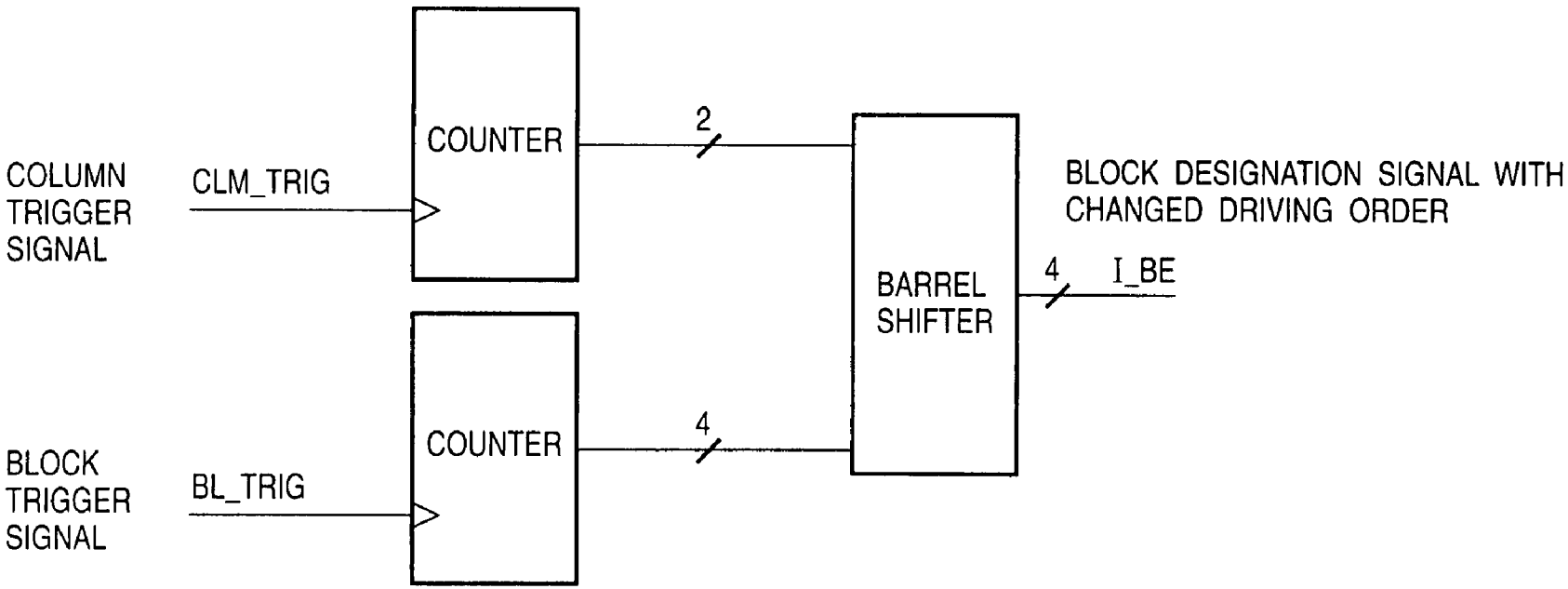
FIG. 53 is a block diagram showing a circuit for changing the block driving order by using a barrel shifter.
Figure 54:
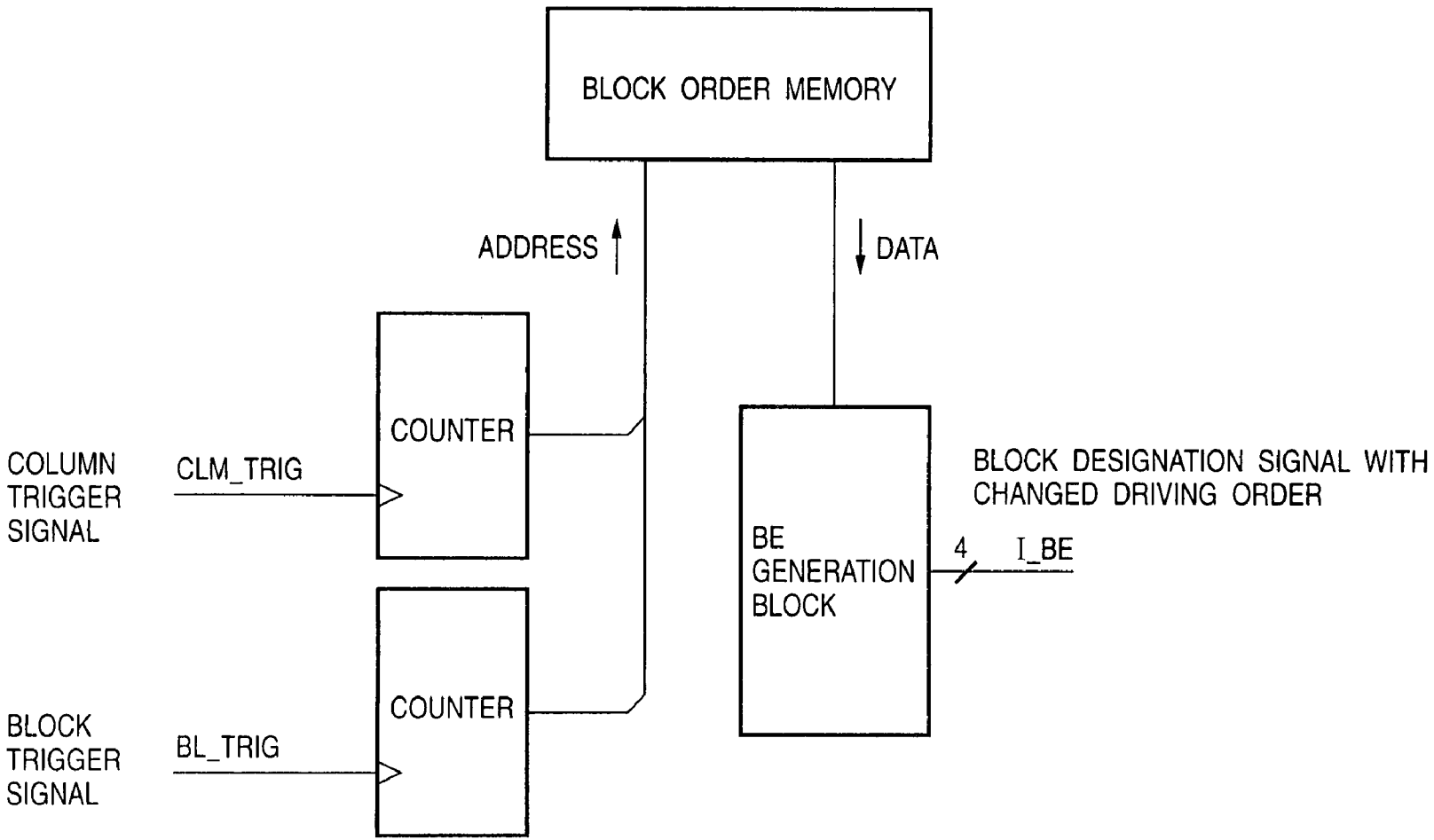
FIG. 54 is a block diagram showing a circuit for changing the block driving order by using a memory.

FIG. 53 is a block diagram showing a driving order change circuit when the block driving order is changed using a barrel shifter capable of generating a predetermined driving order. FIG. 54 is a block diagram showing a circuit when block driving orders are stored in a memory in advance and sequentially read out to generate the block designation signal I_BE representing a changed driving order by a BE generation block.

When block driving orders are stored in the memory, as shown in FIG. 54, random driving orders are prepared as the driving orders. This can spread ink vibrations.

If the printing head 1310 is not assembled into the ink-jet printer main body, vibration avoidance information unique to a printing head is given to the printing head 1310, and the printing head can be controlled with high precision by using this information. For example, a printing head is tested in shipping, and block driving orders in FIG. 54 are written in a nonvolatile memory built in the printing head. The present invention can be applied to an ink-jet printer in which a plurality of printing heads are mounted, like a color printer. In this case, the block driving orders of the respective printing heads can be individually changed.

The present invention can be applied to a full line type printing apparatus using a long printing head, in addition to a serial scan type printing apparatus. In other words, the present invention can be widely applied to block driving type printing apparatuses in which a plurality of nozzles in a printing head are grouped into a plurality of blocks and driven every block. As described above, in this embodiment, a plurality of orifices in a printing head are grouped into a plurality of blocks. When the driving period of discharging ink from the orifices is shifted every block, the shift order is changed. This can satisfy both high-speed printing and prevention of degradation in the image quality of a printing image while efficiently suppressing periodical ink vibrations within the printing head.

In the above embodiments, droplets discharged from the printhead are ink droplets, and a liquid stored in the ink tank is ink. However the liquid to be stored in the ink tank is not limited to ink. For example, a treatment solution to be discharged onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of a so-called on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In this case, as described in Japanese Patent laid Open No. 54-56847 or Japanese Patent Laid Open No. 60-71260, an ink may be supplied in a form of perforated sheet opposed to the electrothermal transducer in which the ink is maintained in liquid or solid within a dent or a through-hole thereon. In the present invention, the above-mentioned film boiling system is most effective for the above-mentioned inks.

The form of the printing apparatus according to the present invention may be an integrated or separate image output terminal for an information processing apparatus such as a computer. Alternatively, the form of the printing apparatus may be a copying machine combined with a reader or the like, or a facsimile apparatus having transmission and reception functions.

As described above, according to the embodiments, a counter is formed in the semiconductor of a printing head section in the head control method of grouping a plurality of nozzles into blocks and driving the nozzles. The order of nozzles to be driven can be changed by (1) changing the default value of the counter or (2) enabling selecting a plurality of counters.

Accordingly, periodic changes in density depending on the driving order due to crosstalk can be reduced to improve the image quality.

The use of the counter for block selection can prevent an increase in the number of signal lines along with an increase in the number of blocks.

Changing the block driving order in the column direction can prevent generation of continuous driving nonuniformity in the raster direction. A more uniform image can be formed as a whole.

Since the counter can select a block, the number of block enable signals transmitted to the head does not increase even with an increase in the number of blocks. Furthermore, the data amount can be reduced if image data and a selection signal are transmitted via the same signal line.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program code for performing the aforesaid processes to a computer system or apparatus (e.g., a personal computer), reading the program code, by a CPU or MPU of the computer system or apparatus, from the storage medium, then executing the program. In this case, the program code read from the storage medium realize the functions according to the embodiments, and the storage medium storing the program code constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program code.

Furthermore, additional functions according to the above embodiments are realized by executing the program code which are read by a computer. The present invention includes a case where an OS (operating system) or the like working on the computer performs a part or entire process in accordance with designations of the program code and realizes functions according to the above embodiments.

Furthermore, the present invention also includes a case where, after the program code read from the storage medium are written in a function expansion card which is inserted into the computer or in a memory provided in a function expansion unit which is connected to the computer, a CPU or the like contained in the function expansion card or function expansion unit performs a part or entire process in accordance with designations of the program code and realizes functions of the above embodiments.

Figure 16:
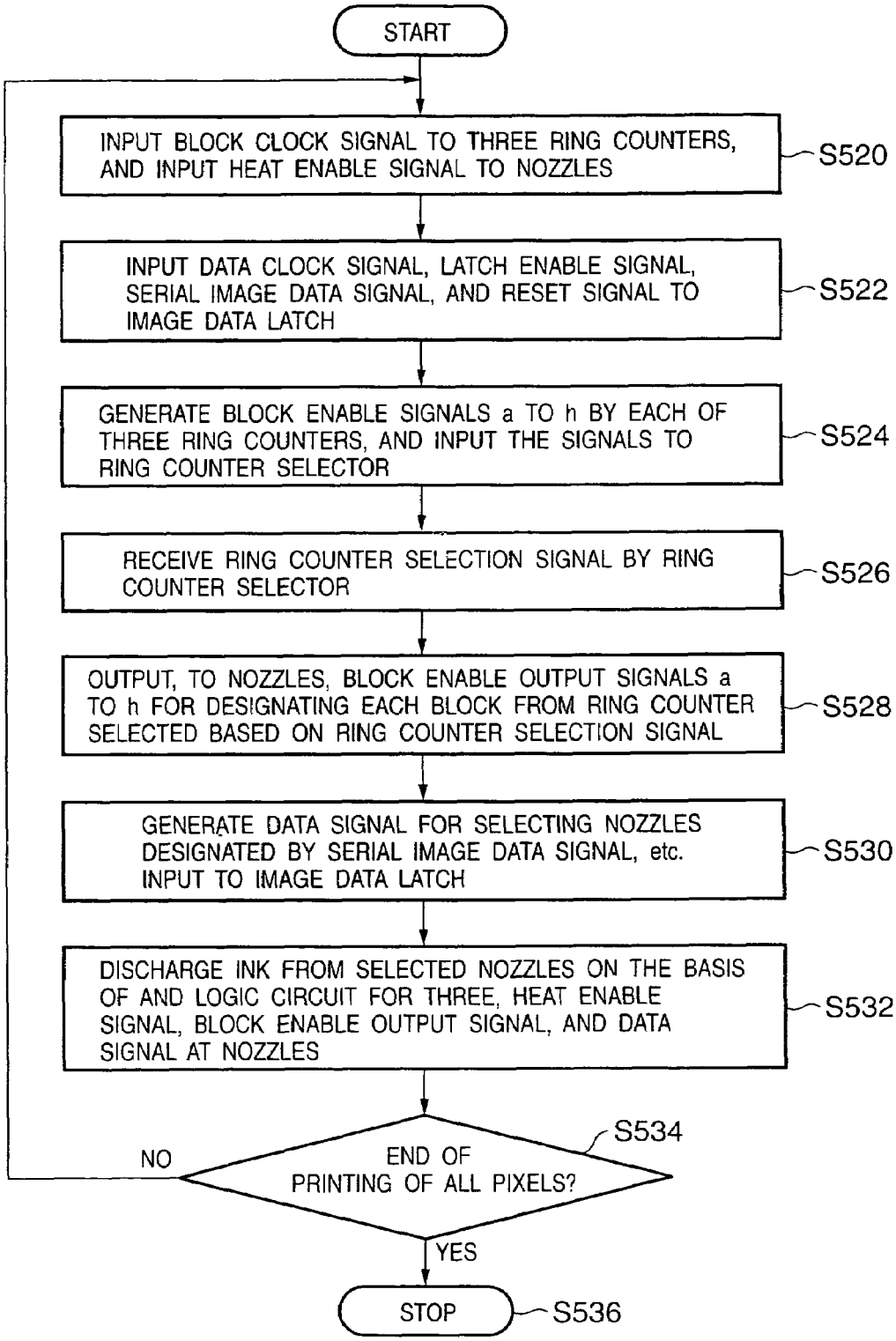
FIG. 16 is a flow chart for explaining a method of controlling the printing head main body driving section used in the first embodiment.
Figure 22:
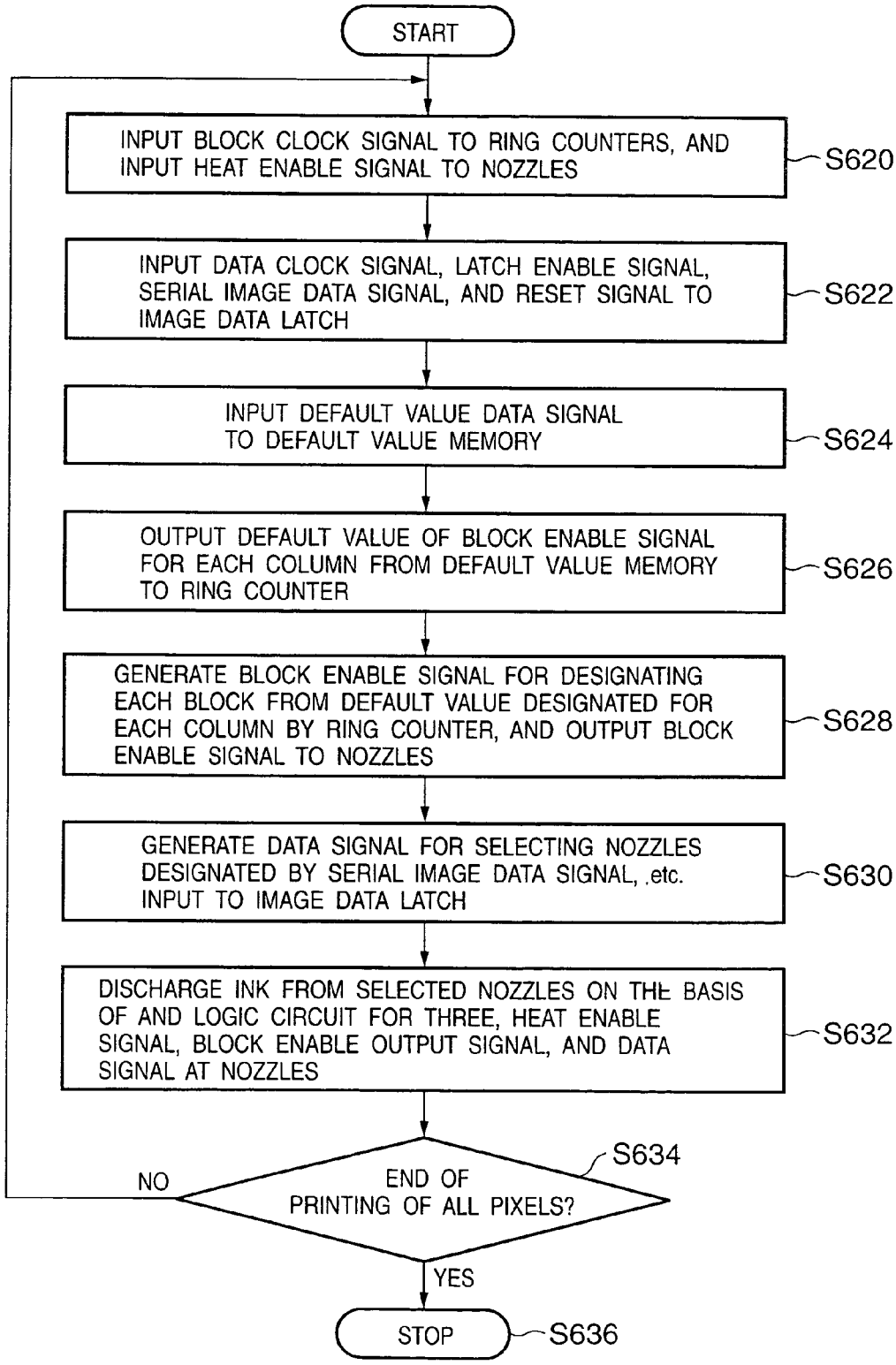
FIG. 22 is a flow chart for explaining a method of controlling the printing head main body driving section used in the second embodiment.

In the case where the present invention is provided in the form of the above storage medium, the storage medium stores program code corresponding to the above-mentioned flow charts (FIGS. 16 and 22).

As has been described above, the present invention can provide a printing head which can prevent an increase in the number of block enable signal lines, can efficiently suppress ink vibrations within the printing head that occur in ink discharge even when an image is printed at high speed, and can reduce degradation in the image quality of a printed image caused by changes in ink density, an image printing apparatus using the printing head, and a control method therefor.

The present invention can provide a printing head which can decrease the number of block enable signal lines, can minimize data transfer, can efficiently suppress ink vibrations within the printing head that occur in ink discharge even when an image is printed at high speed, and can reduce degradation in the image quality of a printed image caused by changes in ink density, an image printing apparatus using the printing head, and a control method therefor.

As many apparently widely different embodiments of the present invention can be made without departing from the spirit and scope thereof, it is to be understood that the invention is not limited to the specific embodiments thereof except as defined in the claims.

What is claimed is:

1. An ink-jet printing apparatus which prints an image on the basis of print data by scanning, relative to a printing medium in a direction transverse to a layout direction of a plurality of printing elements, a carriage which supports a printing head having the plurality of printing elements, said ink-jet printing apparatus comprising:

driving means for grouping the plurality of printing elements into a plurality of blocks every predetermined number of printing elements, and for driving printing elements belonging to each block at the same driving timing;

holding means for holding a plurality of different patterns respectively indicating different driving orders of the plurality of blocks; and driving order determination means for selecting any one pattern from the plurality of different patterns, and outputting the selected pattern as the driving order of the plurality of blocks, wherein the driving order of the plurality of blocks is changed according to the selected pattern outputted by said driving order determination means, wherein the plurality of different patterns includes a first pattern and a second pattern that does not indicate a driving order that is the reverse of a driving order indicated by the first pattern, and wherein said driving order determination means changes the driving order for every predetermined number of columns, each column corresponding to a pixel in the direction perpendicular to the layout direction of a plurality of printing elements.

2. The apparatus according to claim 1, wherein the printing head discharges ink by using heat energy and comprises, as the printing elements, heat energy transducers for generating the heat energy to be applied to the ink.

3. A printing head having a plurality of printing elements and used in an ink-jet printing apparatus which prints an image on the basis of print data by scanning, relative to a printing medium in a direction transverse to a layout direction of the plurality of printing elements, a carriage which supports said printing head, said printing head comprising:

driving means for grouping the plurality of printing elements into a plurality of blocks every predetermined number of printing elements, and for driving printing elements belonging to each block at the same driving timing;

holding means for holding a plurality of different patterns respectively indicating different driving orders of the plurality of blocks; and driving order determination means for selecting any one pattern from the plurality of different patterns, and outputting the selected pattern as the driving order of the plurality of blocks, wherein the driving order of the plurality of blocks is changed according to the selected pattern outputted by said driving order determination means, wherein the plurality of different patterns includes a first pattern and a second pattern that does not indicate a driving order that is the reverse of a driving order indicated by the first pattern, and wherein said driving order determination means sequentially drives the plurality of blocks within a predetermined period in a predetermined order, and shifts the predetermined order by a predetermined number for every predetermined period to determine the subsequent driving order of the plurality of blocks.

4. The head according to claim 3, wherein the printing head discharges ink by using heat energy and comprises, as the printing elements, heat energy transducers for generating the heat energy to be applied to the ink.

5. The head according to claim 3, wherein the predetermined period includes a period during which an image of one column is printed on the printing medium.

6. The head according to claim 3, wherein the predetermined number includes a predetermined number of blocks.

7. A control method for an ink-jet printing apparatus which prints an image on the basis of print data by scanning, relative to a printing medium in a direction transverse to a layout direction of a plurality of printing elements, a carriage which supports a printing head having the plurality of printing elements, said control method for the ink-jet printing apparatus comprising:

a driving step of grouping the plurality of printing elements into a plurality of blocks every predetermined number of printing elements, and of driving printing elements belonging to each block at the same driving timing;

a holding step of holding a plurality of different patterns respectively indicating different driving orders of the plurality of blocks;

a driving order determination step of selecting any one pattern from the plurality of different patterns, and outputting the selected pattern as the driving order of the plurality of blocks, wherein the driving order of the plurality of blocks is changed according to the selected pattern outputted in said driving order determination step, wherein the plurality of different patterns includes a first pattern and a second pattern that does not indicate a driving order that is the reverse of a driving order indicated by the first pattern, and wherein in said driving order determination step, the driving order of the plurality of blocks is determined by sequentially driving the plurality of blocks within a predetermined period in a predetermined order, and shifting the predetermined order by a predetermined number every predetermined period.

* * * * *